US008811874B2

(12) United States Patent
Shimokawa et al.

(10) Patent No.: US 8,811,874 B2
(45) Date of Patent: Aug. 19, 2014

(54) BELT DEVICE WITH MECHANISM CAPABLE OF MINIMIZING INCREASE OF ROTATION TORQUE OF ENDLESS BELT AND FIXING DEVICE AND IMAGE FORMING APPARATUS INCORPORATING SAME

(75) Inventors: Toshihiko Shimokawa, Kanagawa (JP); Kenji Ishii, Kanagawa (JP); Masaaki Yoshikawa, Tokyo (JP); Hiroshi Yoshinaga, Chiba (JP); Naoki Iwaya, Tokyo (JP); Yoshiki Yamaguchi, Kanagawa (JP); Yutaka Ikebuchi, Kanagawa (JP); Tetsuo Tokuda, Kanagawa (JP); Takahiro Imada, Kanagawa (JP); Takamasa Hase, Shizuoka (JP); Ippei Fujimoto, Kanagawa (JP); Takuya Seshita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 169 days.

(21) Appl. No.: 13/557,841

(22) Filed: Jul. 25, 2012

(65) Prior Publication Data

US 2013/0045032 A1 Feb. 21, 2013

(30) Foreign Application Priority Data

Aug. 17, 2011 (JP) ..... 2011-178227

(51) Int. Cl.
*G03G 15/20* (2006.01)

(52) U.S. Cl.
USPC ..... 399/329; 399/320; 399/328; 219/216

(58) Field of Classification Search
USPC ..... 399/122, 320, 328, 329; 219/216
See application file for complete search history.

(56) References Cited

U.S. PATENT DOCUMENTS

| | | | | |
|---|---|---|---|---|
| 7,660,553 | B2 * | 2/2010 | Kikuchi | 399/329 |
| 2002/0067936 | A1 | 6/2002 | Yasui et al. | |
| 2006/0029411 | A1 | 2/2006 | Ishii et al. | |
| 2006/0116230 | A1 | 6/2006 | Satoh et al. | |
| 2006/0165429 | A1 | 7/2006 | Satoh et al. | |
| 2006/0165443 | A1 | 7/2006 | Yoshinaga et al. | |

(Continued)

FOREIGN PATENT DOCUMENTS

| | | |
|---|---|---|
| JP | 2002-323821 | 11/2002 |
| JP | 2004-163464 | 6/2004 |

(Continued)

*Primary Examiner* — David Gray
*Assistant Examiner* — Francis Gray
(74) *Attorney, Agent, or Firm* — Oblon, Spivak, McClelland, Maier & Neustadt, L.L.P.

(57) ABSTRACT

A belt device includes a flange assembly including a tube inserted into a loop formed by an endless belt at each lateral end of the endless belt in an axial direction thereof and a slip ring slidably contacting a groove mounted on the tube. An inner diameter ID 51 of the slip ring through a rotation axis of the slip ring is smaller than a minimum outer diameter OD50*a* of the tube through the rotation axis of the slip ring. The minimum outer diameter OD50*a* is smaller than a maximum outer diameter OD21 of a track of the endless belt rotating in a predetermined direction of rotation through the rotation axis of the slip ring. The maximum outer diameter OD21 is smaller than an outer diameter OD51 of the slip ring through the rotation axis of the slip ring.

18 Claims, 19 Drawing Sheets

(56) References Cited

U.S. PATENT DOCUMENTS

2006/0165448 A1 7/2006 Yoshinaga
2006/0257183 A1 11/2006 Ehara et al.
2006/0285893 A1 12/2006 Ishii
2007/0014600 A1 1/2007 Ishii et al.
2007/0014603 A1 1/2007 Satoh et al.
2007/0218385 A1 9/2007 Kojima et al.
2007/0292175 A1 12/2007 Shinshi
2008/0063443 A1 3/2008 Yoshinaga et al.
2008/0219721 A1 9/2008 Ito et al.
2008/0226326 A1 9/2008 Seo et al.
2008/0232873 A1 9/2008 Ueno et al.
2008/0253789 A1 10/2008 Yoshinaga et al.
2008/0317532 A1 12/2008 Ehara et al.
2009/0003867 A1 1/2009 Fujimoto
2009/0010687 A1 1/2009 Yamada et al.
2009/0047047 A1* 2/2009 Ardery et al. ..... 399/329
2009/0067902 A1 3/2009 Yoshinaga et al.
2009/0123201 A1 5/2009 Ehara et al.
2009/0148205 A1 6/2009 Seo et al.
2009/0169232 A1 7/2009 Kunii et al.
2009/0245865 A1 10/2009 Shinshi et al.
2009/0245897 A1 10/2009 Seo et al.
2009/0297197 A1 12/2009 Hase
2010/0061753 A1 3/2010 Hase
2010/0074667 A1 3/2010 Ehara et al.
2010/0092220 A1 4/2010 Hasegawa et al.
2010/0092221 A1 4/2010 Shinshi et al.
2010/0202809 A1 8/2010 Shinshi et al.
2010/0290822 A1 11/2010 Hasegawa et al.
2010/0303521 A1 12/2010 Ogawa et al.
2011/0026988 A1 2/2011 Yoshikawa et al.
2011/0044706 A1 2/2011 Iwaya et al.
2011/0044734 A1 2/2011 Shimokawa et al.
2011/0052237 A1 3/2011 Yoshikawa et al.
2011/0052245 A1 3/2011 Shinshi et al.
2011/0052277 A1 3/2011 Ueno et al.
2011/0052282 A1 3/2011 Shinshi et al.
2011/0058862 A1 3/2011 Yamaguchi et al.
2011/0058863 A1 3/2011 Shinshi et al.
2011/0058864 A1 3/2011 Fujimoto et al.
2011/0058865 A1 3/2011 Tokuda et al.
2011/0058866 A1 3/2011 Ishii et al.
2011/0064437 A1 3/2011 Yamashina et al.
2011/0064443 A1 3/2011 Iwaya et al.
2011/0064450 A1 3/2011 Ishii et al.
2011/0064490 A1 3/2011 Imada et al.
2011/0064502 A1 3/2011 Hase et al.
2011/0076071 A1 3/2011 Yamaguchi et al.
2011/0085832 A1 4/2011 Hasegawa et al.
2011/0116848 A1 5/2011 Yamaguchi et al.
2011/0129268 A1 6/2011 Ishii et al.
2011/0150518 A1 6/2011 Hase et al.
2011/0170917 A1 7/2011 Yoshikawa et al.
2011/0176820 A1 7/2011 Kadota et al.
2011/0176822 A1 7/2011 Ishii et al.
2011/0182634 A1 7/2011 Ishigaya et al.
2011/0182638 A1 7/2011 Ishii et al.
2011/0194869 A1 8/2011 Yoshinaga et al.
2011/0194870 A1 8/2011 Hase et al.
2011/0200368 A1 8/2011 Yamaguchi et al.
2011/0200370 A1 8/2011 Ikebuchi et al.
2011/0206427 A1 8/2011 Iwaya et al.
2011/0211876 A1 9/2011 Iwaya et al.
2011/0217056 A1 9/2011 Yoshinaga et al.
2011/0217057 A1 9/2011 Yoshinaga et al.
2011/0217093 A1 9/2011 Tokuda et al.
2011/0217095 A1 9/2011 Ishii et al.
2011/0222875 A1 9/2011 Imada et al.
2011/0222876 A1 9/2011 Yuasa et al.
2011/0222888 A1 9/2011 Ikebuchi et al.
2011/0222926 A1 9/2011 Ueno et al.
2011/0222929 A1 9/2011 Fujimoto et al.
2011/0222930 A1 9/2011 Fujimoto et al.
2011/0222931 A1* 9/2011 Shinshi et al. ..... 399/329
2011/0229161 A1 9/2011 Ueno et al.
2011/0229162 A1 9/2011 Ogawa et al.
2011/0229178 A1 9/2011 Ogawa et al.
2011/0229181 A1 9/2011 Iwaya et al.
2011/0229200 A1 9/2011 Yamaguchi et al.
2011/0229225 A1 9/2011 Ishii et al.
2011/0229226 A1 9/2011 Tokuda et al.
2011/0229227 A1 9/2011 Yoshikawa et al.
2011/0229228 A1 9/2011 Yoshikawa et al.
2011/0274453 A1 11/2011 Shimokawa et al.
2011/0286758 A1 11/2011 Yoshinaga
2011/0293309 A1 12/2011 Hase
2012/0045226 A1 2/2012 Hase et al.
2012/0051766 A1 3/2012 Ueno et al.
2012/0051774 A1 3/2012 Ikebuchi et al.
2012/0093531 A1 4/2012 Yuasa et al.
2012/0093551 A1 4/2012 Ogawa et al.
2012/0107005 A1 5/2012 Hase et al.
2012/0114345 A1 5/2012 Fujimoto et al.
2012/0114354 A1 5/2012 Saito et al.
2012/0121303 A1 5/2012 Takagi et al.
2012/0121304 A1 5/2012 Tokuda et al.
2012/0121305 A1 5/2012 Yoshikawa et al.
2012/0148303 A1 6/2012 Yamaguchi et al.
2012/0155935 A1 6/2012 Yoshikawa et al.
2012/0155936 A1 6/2012 Yamaguchi et al.
2012/0177388 A1 7/2012 Imada et al.
2012/0177393 A1 7/2012 Ikebuchi et al.
2012/0177420 A1 7/2012 Shimokawa et al.
2012/0177423 A1 7/2012 Imada et al.
2012/0177424 A1 7/2012 Saito et al.
2012/0207523 A1* 8/2012 Ueno et al. ..... 399/322
2012/0219312 A1* 8/2012 Yuasa et al. ..... 399/69
2012/0224878 A1* 9/2012 Ikebuchi et al. ..... 399/70
2012/0237273 A1* 9/2012 Yoshinaga et al. ..... 399/328
2012/0301161 A1* 11/2012 Fujimoto ..... 399/33

FOREIGN PATENT DOCUMENTS

JP 2007-334205 12/2007
JP 2010-096782 4/2010
JP 2011-133839 7/2011

* cited by examiner

BELT DEVICE WITH MECHANISM CAPABLE OF MINIMIZING INCREASE OF ROTATION TORQUE OF ENDLESS BELT AND FIXING DEVICE AND IMAGE FORMING APPARATUS INCORPORATING SAME

CROSS-REFERENCE TO RELATED APPLICATION

This patent application is based on and claims priority pursuant to 35 U.S.C. §119 to Japanese Patent Application No. 2011-178227, filed on Aug. 17, 2011, in the Japanese Patent Office, the entire disclosure of which is hereby incorporated by reference herein.

BACKGROUND OF THE INVENTION

1. Field of the Invention

Exemplary aspects of the present invention relate to a belt device, a fixing device, and an image forming apparatus, and more particularly, to a belt device for conveying a recording medium and a fixing device and an image forming apparatus incorporating the belt device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to render the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device installed in such image forming apparatuses may include a flexible endless belt and an opposed pressing roller that apply heat and pressure to a recording medium bearing a toner image. For example, the pressing roller is pressed against the endless belt heated by a heater to form a fixing nip therebetween through which the recording medium bearing the toner image is conveyed. As the endless belt and the pressing roller rotate and convey the recording medium through the fixing nip, they apply heat and pressure to the recording medium, melting and fixing the toner image on the recording medium.

For example, the flexible endless belt is rotatably attached to a flange at each lateral end of the endless belt in the axial direction thereof in such a manner that the endless belt, as it rotates, slides over the outer circumferential surface of the flange. The flange is mounted on a frame of the fixing device, thus supporting the endless belt.

However, as the endless belt rotates for a long time, it may skew and its circumferential edge may strike and scratch the flange, scraping particles off the flange by frictional contact with the flange. The scraped particles may enter the slight gap between the inner circumferential surface of the endless belt and the outer circumferential surface of the flange, increasing friction between the flange and the endless belt sliding over the flange. As a result, the increased friction may increase rotation torque of the endless belt, destabilizing rotation of the endless belt.

SUMMARY OF THE INVENTION

This specification describes below an improved belt device. In one exemplary embodiment of the present invention, the belt device includes an endless belt formed into a loop rotatable in a predetermined direction of rotation; and a flange assembly disposed at each lateral end of the endless belt in an axial direction thereof to support the endless belt. The flange assembly includes a flange having a substantially circular flange face facing a circumferential edge of the endless belt; a tube projecting from the flange face of the flange and inserted into the loop formed by the endless belt at each lateral end of the endless belt in the axial direction thereof; a groove mounted on an outer circumferential surface of the tube along a circumferential direction thereof; and a slip ring slidably contacting the groove. The slip ring includes a through-hole contacting the groove; and an inner disk face separatably contacting the circumferential edge of the endless belt. The belt device satisfies a formula of $ID\mathbf{51}<OD\mathbf{50}a<OD\mathbf{21}<OD\mathbf{51}$ where ID51 is an inner diameter of the slip ring through a rotation axis of the slip ring, OD50*a* is a minimum outer diameter of the tube through the rotation axis of the slip ring, OD21 is a maximum outer diameter of a track of the endless belt rotating in the predetermined direction of rotation through the rotation axis of the slip ring, and OD51 is an outer diameter of the slip ring through the rotation axis of the slip ring.

This specification further describes an improved fixing device. In one exemplary embodiment of the present invention, the fixing device includes the belt device described above; a heater disposed opposite the endless belt to heat the endless belt; a pressing rotary body contacting an outer circumferential surface of the endless belt; and a nip formation pad disposed inside the loop formed by the endless belt and pressing against the pressing rotary body via the endless belt to form a fixing nip between the endless belt and the pressing rotary body through which a recording medium bearing a toner image is conveyed.

This specification further describes an improved image forming apparatus. In one exemplary embodiment of the present invention, the image forming apparatus includes the belt device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
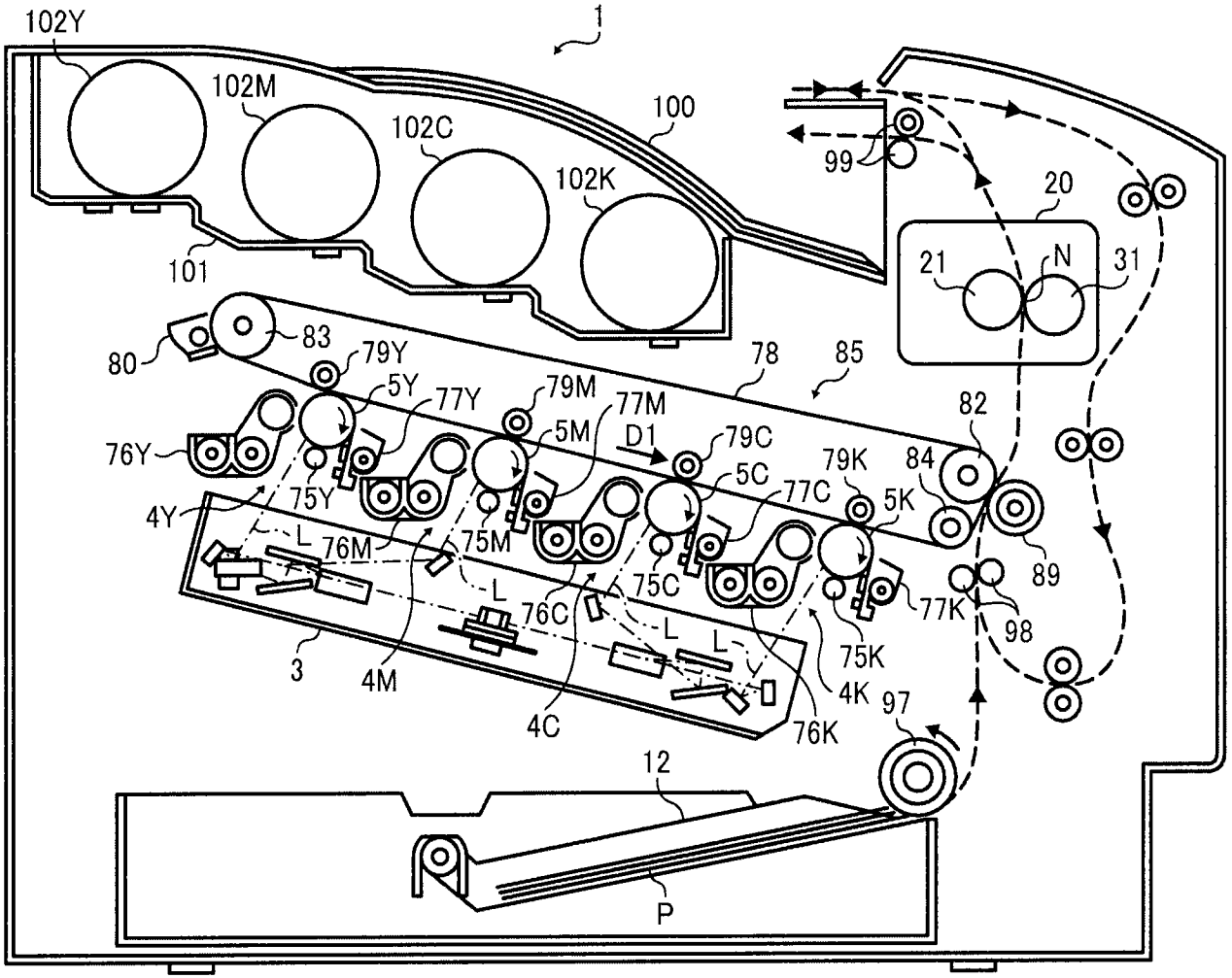
FIG. 1 is a schematic vertical sectional view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic vertical sectional view of the image forming apparatus 1. As illustrated in FIG. 1, the image forming apparatus 1 may be a copier, a facsimile machine, a printer, a multifunction printer having at least one of copying, printing, scanning, plotter, and facsimile functions, or the like. According to this exemplary embodiment, the image forming apparatus 1 is a tandem color printer for forming color and monochrome images on recording media by electrophotography.

Referring to FIG. 1, the following describes the structure of the image forming apparatus 1.

In an upper portion of the image forming apparatus 1 is a toner bottle holder 101 that accommodates four toner bottles 102Y, 102M, 102C, and 102K containing yellow, magenta, cyan, and black toners, respectively, and detachably attached to the image forming apparatus 1 for replacement. Below the toner bottle holder 101 is an intermediate transfer unit 85 incorporating an intermediate transfer belt 78. The intermediate transfer belt 78 is disposed opposite image forming devices 4Y, 4M, 4C, and 4K that form yellow, magenta, cyan, and black toner images, respectively.

The image forming devices 4Y, 4M, 4C, and 4K include photoconductive drums 5Y, 5M, 5C, and 5K, respectively. The photoconductive drums 5Y, 5M, 5C, and 5K are surrounded by chargers 75Y, 75M, 75C, and 75K, development devices 76Y, 76M, 76C, and 76K, cleaners 77Y, 77M, 77C, and 77K, and dischargers, respectively. The image forming devices 4Y, 4M, 4C, and 4K perform a series of image forming processes including a charging process, an exposure process, a development process, a primary transfer process, a cleaning process, and a discharging process described below on the photoconductive drums 5Y, 5M, 5C, and 5K as the photoconductive drums 5Y, 5M, 5C, and 5K rotate clockwise in FIG. 1, thus forming yellow, magenta, cyan, and black toner images thereon.

For example, a driving motor drives and rotates the photoconductive drums 5Y, 5M, 5C, and 5K clockwise in FIG. 1. Initially, the chargers 75Y, 75M, 75C, and 75K uniformly charge an outer circumferential surface of the respective photoconductive drums 5Y, 5M, 5C, and 5K at a charging position where the chargers 75Y, 75M, 75C, and 75K are disposed opposite the photoconductive drums 5Y, 5M, 5C, and 5K, respectively, in the charging process. Then, as the charged outer circumferential surface of the respective photoconductive drums 5Y, 5M, 5C, and 5K rotates above an exposure device 3, the exposure device 3 emits a laser beam L onto the charged outer circumferential surface of the respective photoconductive drums 5Y, 5M, 5C, and 5K at an exposure position where the exposure device 3 is disposed opposite the photoconductive drums 5Y, 5M, 5C, and 5K, thus forming an electrostatic latent image thereon in the exposure process.

Thereafter, as the electrostatic latent images formed on the photoconductive drums 5Y, 5M, 5C, and 5K move under the development devices 76Y, 76M, 76C, and 76K, the development devices 76Y, 76M, 76C, and 76K develop the electrostatic latent images into yellow, magenta, cyan, and black toner images at a development position where the development devices 76Y, 76M, 76C, and 76K are disposed opposite the photoconductive drums 5Y, 5M, 5C, and 5K in the development process. As the yellow, magenta, cyan, and black toner images formed on the photoconductive drums 5Y, 5M, 5C, and 5K reach primary transfer nips formed between the photoconductive drums 5Y, 5M, 5C, and 5K and primary transfer rollers 79Y, 79M, 79C, and 79K via the intermediate transfer belt 78, the primary transfer rollers 79Y, 79M, 79C, and 79K primarily transfer the yellow, magenta, cyan, and black toner images from the photoconductive drums 5Y, 5M, 5C, and 5K onto the intermediate transfer belt 78 in the primary transfer process. After the primary transfer of the yellow, magenta, cyan, and black toner images, a slight amount of residual toner not transferred onto the intermediate transfer belt 78 remains on the photoconductive drums 5Y, 5M, 5C, and 5K.

To address this circumstance, as the residual toner on the photoconductive drums 5Y, 5M, 5C, and 5K moves under the cleaners 77Y, 77M, 77C, and 77K, a cleaning blade of the respective cleaners 77Y, 77M, 77C, and 77K mechanically collects the residual toner from the photoconductive drums 5Y, 5M, 5C, and 5K at a cleaning position where the cleaners 77Y, 77M, 77C, and 77K are disposed opposite the photoconductive drums 5Y, 5M, 5C, and 5K, respectively, in the cleaning process. Finally, the dischargers remove residual potential from the photoconductive drums 5Y, 5M, 5C, and 5K in the discharging process at a discharging position where the dischargers are disposed opposite the photoconductive drums 5Y, 5M, 5C, and 5K, respectively. Thus, a series of image forming processes performed on the photoconductive drums 5Y, 5M, 5C, and 5K is completed.

Thereafter, a series of transfer processes is performed on the intermediate transfer belt 78. For example, as described above, the primary transfer rollers 79Y, 79M, 79C, and 79K primarily transfer the yellow, magenta, cyan, and black toner images from the photoconductive drums 5Y, 5M, 5C, and 5K onto the intermediate transfer belt 78 in such a manner that the yellow, magenta, cyan, and black toner images are superimposed on a same position on the intermediate transfer belt 78, thus forming a color toner image thereon. The intermediate transfer unit 85 accommodates the intermediate transfer belt 78, the four primary transfer rollers 79Y, 79M, 79C, and 79K, a secondary transfer backup roller 82, a cleaner backup roller 83, a tension roller 84, and a belt cleaner 80. The intermediate transfer belt 78 is stretched over and supported by the three rollers, that is, the secondary transfer backup roller 82, the cleaner backup roller 83, and the tension roller 84. As the secondary transfer backup roller 82 is driven, it drives and rotates the intermediate transfer belt 78 counterclockwise in FIG. 1 in a rotation direction D1.

The four primary transfer rollers 79Y, 79M, 79C, and 79K nip the intermediate transfer belt 78 together with the photoconductive drums 5Y, 5M, 5C, and 5K, forming the primary transfer nips between the intermediate transfer belt 78 and the photoconductive drums 5Y, 5M, 5C, and 5K. A transfer bias having a polarity opposite a polarity of toner is exerted to the primary transfer rollers 79Y, 79M, 79C, and 79K. As the intermediate transfer belt 78 rotates in the rotation direction D1, the yellow, magenta, cyan, and black toner images formed on the photoconductive drums 5Y, 5M, 5C, and 5K, respectively, are primarily transferred onto the intermediate transfer belt 78 successively in such a manner that the yellow, magenta, cyan, and black toner images are superimposed on the same position on the intermediate transfer belt 78, thus forming the color toner image thereon.

A secondary transfer roller 89 is pressed against the secondary transfer backup roller 82 via the intermediate transfer belt 78, forming a secondary transfer nip between the secondary transfer roller 89 and the intermediate transfer belt 78. As the color toner image formed on the intermediate transfer belt 78 moves through the secondary transfer nip, the color toner image is secondarily transferred from the intermediate transfer belt 78 onto a recording medium P conveyed through the secondary transfer nip as described below. After the secondary transfer, residual toner not transferred onto the recording medium P remains on the intermediate transfer belt 78. As the intermediate transfer belt 78 moves under the belt cleaner 80, the belt cleaner 80 collects the residual toner from the intermediate transfer belt 78. Thus, a series of transfer processes performed on the intermediate transfer belt 78 is completed.

A detailed description is now given of the recording medium P conveyed to the secondary transfer nip.

For example, a paper tray 12 located in a lower portion of the image forming apparatus 1 loads a plurality of recording media P (e.g., transfer sheets). As a feed roller 97 is driven and rotated counterclockwise in FIG. 1, the feed roller 97 picks up and feeds an uppermost recording medium P toward a registration roller pair 98.

As the recording medium P reaches the registration roller pair 98, it is temporarily halted by the registration roller pair 98 that stops rotating. Then, at a time when the color toner image formed on the intermediate transfer belt 78 reaches the secondary transfer nip, the registration roller pair 98 resumes rotating, conveying the recording medium P to the secondary transfer nip. As the recording medium P is conveyed through the secondary transfer nip, the color toner image is secondarily transferred from the intermediate transfer belt 78 onto the recording medium P.

Thereafter, the recording medium P bearing the color toner image is conveyed to a fixing device 20 where a pressing roller 31 is pressed against a fixing belt 21 to form a fixing nip N therebetween. As the recording medium P is conveyed through the fixing nip N, the fixing belt 21 and the pressing roller 31 apply heat and pressure to the recording medium P, thus fixing the color toner image on the recording medium P. Then, the recording medium P bearing the fixed color toner image is conveyed to an output roller pair 99 that discharges the recording medium P onto an outside of the image forming apparatus 1, that is, an output tray 100. The output tray 100 receives and stacks the recording media P discharged by the output roller pair 99. Thus, a series of image forming processes performed by the image forming apparatus 1 is completed.

Figure 2:
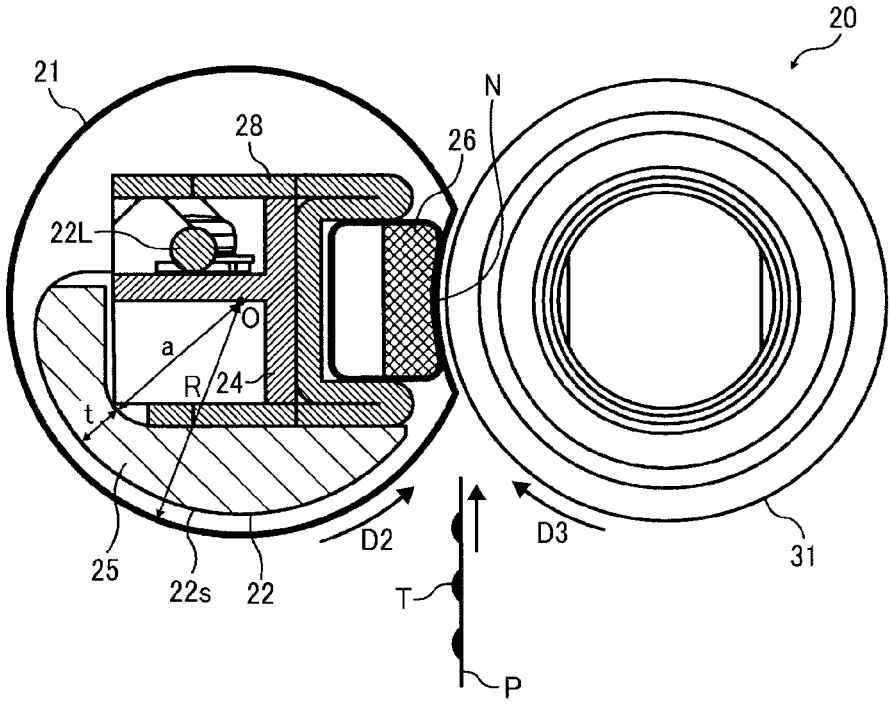
FIG. 2 is a vertical sectional view of a fixing device incorporated in the image forming apparatus shown in FIG. 1 according to a first exemplary embodiment.

Referring to FIG. 2, the following describes a configuration of the fixing device 20 incorporated in the image forming apparatus 1 described above.

FIG. 2 is a vertical sectional view of the fixing device 20 according to a first exemplary embodiment.

A detailed description is now given of a construction of the fixing device 20.

As shown in FIG. 2, the fixing device 20 (e.g., a fuser) includes the endless fixing belt 21 serving as an endless belt or a fixing rotary body rotatable in a rotation direction D2; the pressing roller 31 serving as a pressing rotary body contacting an outer circumferential surface of the fixing belt 21 to form the fixing nip N therebetween and rotatable in a rotation direction D3; a nip formation pad 26 disposed inside a loop formed by the fixing belt 21 and pressing against the pressing roller 31 via the fixing belt 21 to form the fixing nip N between the pressing roller 31 and the fixing belt 21; a laminated heater 22 disposed inside the loop formed by the fixing belt 21 in such a manner that it is in contact with or isolation from an inner circumferential surface of the fixing belt 21 with a slight gap therebetween, thus heating the fixing belt 21 directly or indirectly; a laminated heater support 25 disposed inside the loop formed by the fixing belt 21 in such a manner that it sandwiches the laminated heater 22 together with the fixing belt 21, thus supporting the laminated heater 22 at a predetermined position; a core holder 28 disposed inside the loop formed by the fixing belt 21 and supporting the nip formation pad 26; a terminal board stay 24 disposed inside the loop formed by the fixing belt 21 and supported by the core holder 28; and a feeder 22L disposed inside the loop formed by the fixing belt 21 and supported by the terminal board stay 24. The laminated heater 22 includes a heat generation sheet 22*s* constituting a heat generation face that contacts the inner circumferential surface of the fixing belt 21, thus heating the fixing belt 21 directly.

A detailed description is now given of a construction of the fixing belt 21.

Figure 3A:
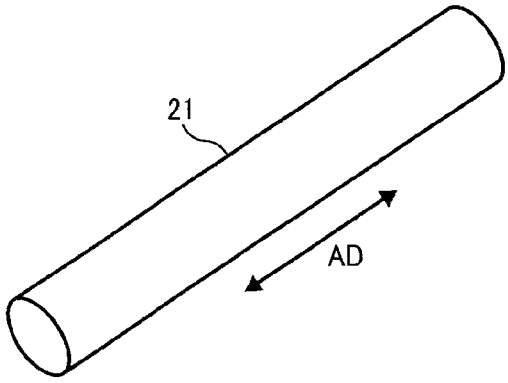
FIG. 3A is a perspective view of a fixing belt incorporated in the fixing device shown in FIG. 2.
Figure 3B:
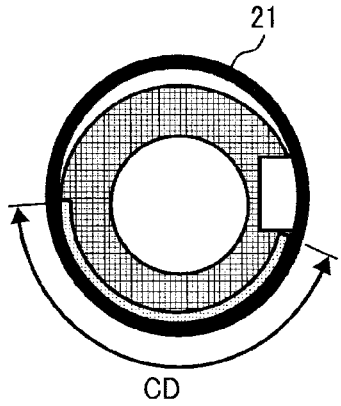
FIG. 3B is a vertical sectional view of the fixing belt shown in FIG. 3A.

The fixing belt 21 is a flexible, tubular endless belt having an outer loop diameter of about 30 mm and a width in an axial direction thereof corresponding to a width of a recording medium P conveyed through the fixing nip N. For example, the fixing belt 21 is constructed of a base layer made of a metal material or the like and having a thickness in a range of from about 30 micrometers to about 50 micrometers; and at least a release layer coating the base layer. FIG. 3A is a perspective view of the fixing belt 21. FIG. 3B is a vertical sectional view of the fixing belt 21. The fixing belt 21 has an axial direction AD shown in FIG. 3A, that is, a longitudinal direction thereof, and a circumferential direction CD shown in FIG. 3B.

The base layer of the fixing belt 21 is made of conductive metal, such as iron, cobalt, nickel, or an alloy of these, or heat-resistant resin, for example.

The release layer of the fixing belt 21 is a tube, made of a fluorine compound such as tetrafluoroethylene-perfluoroalkylvinylether copolymer (PFA) and coating the base layer, with a thickness in a range of from about 5 micrometers to about 50 micrometers. The release layer facilitates separation of toner of a toner image T on the recording medium P, which directly contacts the outer circumferential surface of the fixing belt 21, from the fixing belt 21.

Figure 4:
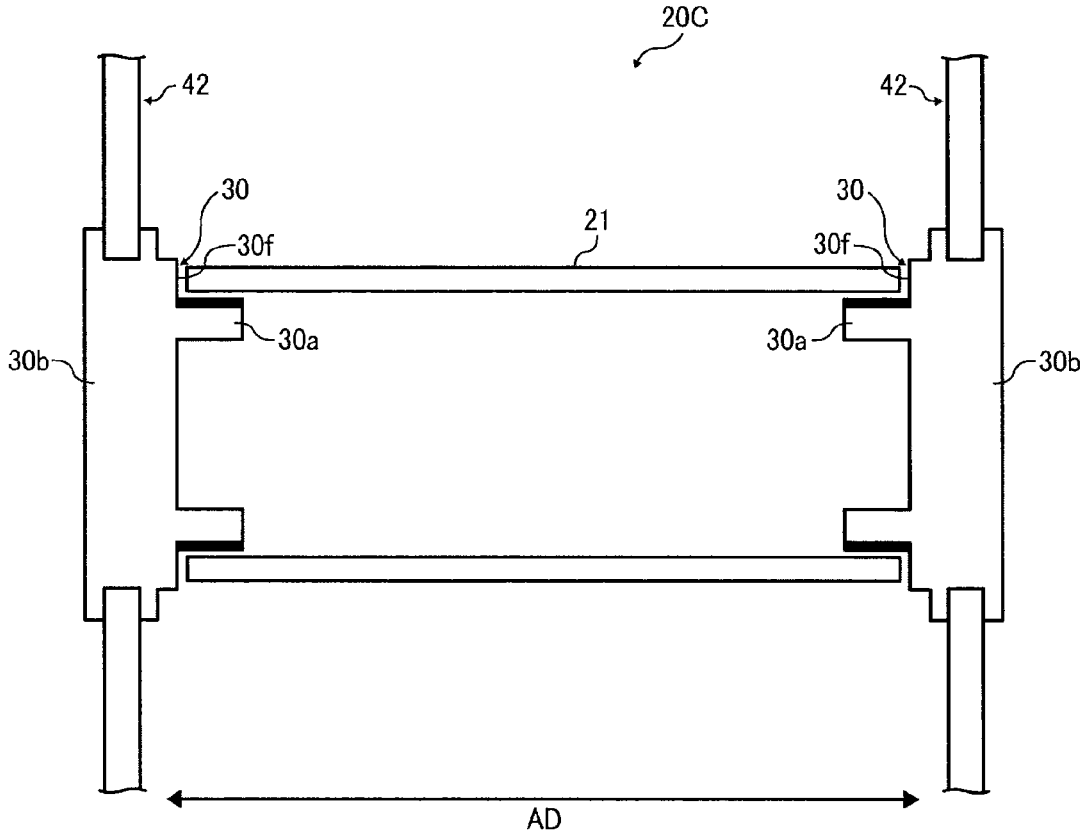
FIG. 4 is a horizontal sectional view of a comparative fixing device.

FIG. 4 is a horizontal sectional view of a comparative fixing device 20C. As shown in FIG. 4, both lateral ends of the fixing belt 21 in the axial direction AD thereof are rotatably supported by flange assemblies 30 mounted on side plates 42 of the fixing device 20C at predetermined positions, respectively. For example, each flange assembly 30 is constructed of a flange 30*b* having a flange face 30*f* that contacts a circumferential edge of the fixing belt 21 at each lateral end of the fixing belt 21 in the axial direction AD thereof; and a tube 30*a* projecting from the flange face 30*f* of the flange 30*b*. The flange 30*b* is mounted on the side plate 42. The tube 30*a* is inserted into the loop formed by the fixing belt 21 at each lateral end of the fixing belt 21 in the axial direction AD thereof. The tube 30*a* is substantially circular in cross-section at a part thereof other than a part corresponding to the nip formation pad 26 depicted in FIG. 2. An outer diameter of the tube 30*a* is equivalent to or slightly smaller than an inner diameter of the fixing belt 21. Accordingly, the tubes 30*a* disposed inside the loop formed by the fixing belt 21 at both lateral ends of the fixing belt 21 in the axial direction AD thereof support the fixing belt 21 in such a manner that the fixing belt 21 is rotatable while the tubes 30*a* retain the substantially circular shape of the fixing belt 21 in cross-section. That is, a center of a circle formed by the tube 30*a* is identical to a rotation axis O of the fixing belt 21 depicted in FIG. 2.

Referring to FIG. 2, a detailed description is now given of a construction of the pressing roller 31.

The pressing roller 31 having an outer diameter of about 30 mm is constructed of a metal core made of metal such as aluminum or copper; a heat-resistant elastic layer coating the metal core and made of silicone rubber, solid rubber, or the like; and a release layer coating the elastic layer. The elastic layer has a thickness of about 2 mm. The release layer is a PFA tube coating the elastic layer and having a thickness of about 50 micrometers. The metal core may incorporate a heat generator such as a halogen heater as needed. The pressing roller 31 is pressed against the nip formation pad 26 via the fixing belt 21 by a pressing mechanism. A part of the pressing roller 31 that presses against the nip formation pad 26 constitutes the fixing nip N that creates a recess on the fixing belt 21 through which the recording medium P is conveyed.

As a driver drives and rotates the pressing roller 31 contacting the fixing belt 21 clockwise in FIG. 2 in the rotation direction D3, the pressing roller 31 in turn rotates the fixing belt 21 counterclockwise in FIG. 2 in the rotation direction D2.

A detailed description is now given of a construction of the nip formation pad 26.

The nip formation pad 26 has a width corresponding to the width of the fixing belt 21 in the axial direction AD thereof. At least a part of the nip formation pad 26 that presses against the pressing roller 31 via the fixing belt 21 is made of heat-resistant resin such as liquid crystal polymer (LCP) or polyamide imide (PAI). The core holder 28 stationarily supports the nip formation pad 26 at a predetermined position inside the loop formed by the fixing belt 21. A contact face of the nip formation pad 26 that contacts the inner circumferential surface of the fixing belt 21 is made of a material that facilitates sliding of the fixing belt 21 over the nip formation pad 26 and improves resistance to abrasion such as Teflon® sheet.

A detailed description is now given of a construction of the core holder 28.

The core holder 28 is a rigid metal sheet H-shaped in cross-section and having a width corresponding to the width of the fixing belt 21 in the axial direction AD thereof. The core holder 28 is situated at substantially a center of the loop formed by the fixing belt 21.

The core holder 28 supports various components situated inside the loop formed by the fixing belt 21 at predetermined positions, respectively. For example, a first recess of the H-shaped core holder 28 facing the pressing roller 31 via the fixing belt 21 accommodates and supports the nip formation pad 26. That is, the core holder 28 supports the nip formation pad 26 at a face thereof opposite the contact face contacting the inner circumferential surface of the fixing belt 21, thus preventing the nip formation pad 26 from being deformed substantially by pressure from the pressing roller 31. The core holder 28 supports the nip formation pad 26 in such a manner that the nip formation pad 26 projects slightly from the core holder 28 toward the pressing roller 31. Accordingly, the core holder 28 is isolated from the fixing belt 21 at the fixing nip N.

A second recess of the H-shaped core holder 28 opposite the first recess facing the pressing roller 31 accommodates and supports the terminal board stay 24 and the feeder 22L. The terminal board stay 24 is T-shaped in cross-section and has a width corresponding to the width of the fixing belt 21 in the axial direction AD thereof. The feeder 22L extending on the terminal board stay 24 receives power from outside of the fixing device 20. An outer face of the H-shaped core holder 28 mounts and supports the laminated heater support 25. For example, the laminated heater support 25 is supported by a lower half part of the core holder 28 situated in a lower half inside the loop formed by the fixing belt 21 in FIG. 2 that corresponds to a half of the fixing belt 21 disposed upstream from the fixing nip N in the rotation direction D2 of the fixing belt 21. The laminated heater support 25 may be adhered to the core holder 28 to facilitate assembly of the fixing device 20. Alternatively, the laminated heater support 25 may not be adhered to the core holder 28 to minimize heat conduction from the laminated heater support 25 to the core holder 28.

A detailed description is now given of a construction of the laminated heater support 25. The laminated heater support 25 supports the laminated heater 22 in such a manner that the heat generation face, that is, the heat generation sheet 22*s*, of the laminated heater 22 contacts the inner circumferential surface of the fixing belt 21. To attain this objective, the laminated heater support 25 has an arcuate outer circumferential face corresponding to the inner circumferential surface of the fixing belt 21 forming the loop.

A radius of the arcuate laminated heater support 25 defined by a distance from the rotation axis O of the fixing belt 21 to the arcuate outer circumferential face of the laminated heater support 25 is equivalent to an inner radius R of the fixing belt 21. Accordingly, the entire heat generation face of the laminated heater 22 supported by the laminated heater support 25 is brought into contact with the inner circumferential surface of the fixing belt 21, thus heating the fixing belt 21 effectively. The radius of the arcuate laminated heater support 25 is the sum of a distance a from the rotation axis O of the fixing belt 21 to an inner circumferential face of the laminated heater support 25 within the second recess of the core holder 28 and a thickness t of the laminated heater support 25 in a diametrical direction of the fixing belt 21.

The laminated heater support 25 has heat resistance great enough to endure heat from the laminated heater 22; strength great enough to support the laminated heater 22 without deformation of the laminated heater 22 by contact with the fixing belt 21 sliding over the laminated heater 22 as the fixing belt 21 rotates in the rotation direction D2; and heat insulation that insulates the core holder 28 from heat from the laminated heater 22, thus conducting heat from the laminated heater 22 to the fixing belt 21. For example, the laminated heater support 25 is made of molded foam of polyimide resin. As the fixing belt 21 rotating in the rotation direction D2 slides over the laminated heater 22, the fixing belt 21 exerts drag on the laminated heater 22 that pulls the laminated heater 22 toward the fixing nip N. To address this circumstance, the laminated heater support 25 needs to have strength great enough to support the laminated heater 22 without deformation. In this case also, the laminated heater support 25 is made of molded foam of polyimide resin. Alternatively, the laminated heater support 25 may include solid resin supplementarily contained in the molded foam of polyimide resin, thus improving rigidity of the laminated heater support 25.

Figure 5:
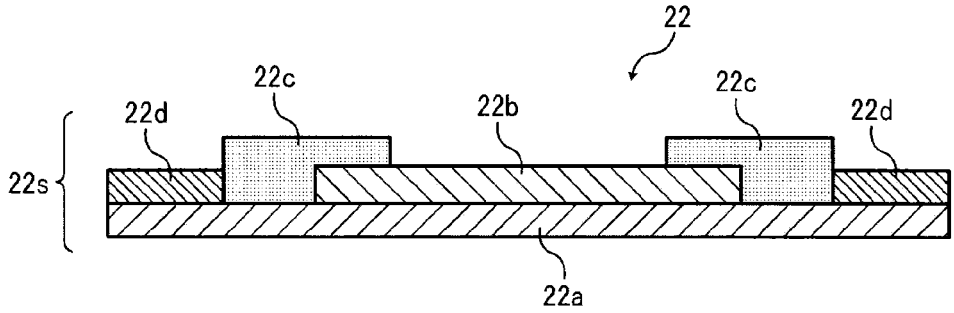
FIG. 5 is a horizontal sectional view of a heat generation sheet of a laminated heater incorporated in the fixing device shown in FIG. 2.

Referring to FIG. 5, a detailed description is now given of a construction of the laminated heater 22.

FIG. 5 is a horizontal sectional view of the heat generation sheet 22*s* of the laminated heater 22. As shown in FIG. 5, the heat generation sheet 22*s*, that is, the heat generation face, of the laminated heater 22 is constructed of an insulative base layer 22*a*; a resistance heat generation layer 22*b* coating the base layer 22*a* and dispersed with conductive particles in heat-resistant resin; and an electrode layer 22*c* coating the base layer 22*a* and the resistance heat generation layer 22*b* and supplying power to the resistance heat generation layer 22*b*. The flexible heat generation sheet 22*s* has a predetermined width in the axial direction AD of the fixing belt 21 and a predetermined length in the circumferential direction CD of the fixing belt 21 The heat generation sheet 22*s* is further constructed of an insulation layer 22*d* coating the base layer 22*a* and insulating between the resistance heat generation layer 22*b* and the adjacent electrode layer 22*c* of a different power supply system and between an edge of the heat generation sheet 22*s* and an external component. The laminated heater 22 is further constructed of electrode terminal pairs 22*e* shown in FIG. 6 connected to the electrode layer 22*c* at an end of the heat generation sheet 22*s* and supplying power from the feeder 22L depicted in FIG. 2 to the electrode layer 22*c*.

The heat generation sheet 22*s* has a thickness in a range of from about 0.1 mm to about 1.0 mm and flexibility great enough to wind at least the heat generation sheet 22*s* around the arcuate outer circumferential face of the laminated heater support 25.

The base layer 22*a* is thin elastic film made of heat-resistant resin such as polyethylene terephthalate (PET) or polyimide resin. For example, the base layer 22*a* is polyimide resin film that attains predetermined heat resistance, insulation, and flexibility.

The resistance heat generation layer 22*b* is thin conductive film uniformly dispersed with conductive particles, such as carbon particles or metal particles, in heat-resistant resin such as polyimide resin. When supplied with power, the resistance heat generation layer 22*b* generates Joule heat by internal resistance. The resistance heat generation layer 22*b* is manufactured by applying a coating dispersed with conductive particles such as carbon particles or metal particles in a precursor made of heat-resistant resin such as polyimide resin to the base layer 22*a*.

Alternatively, the resistance heat generation layer 22*b* may be manufactured by layering a thin conductive layer made of carbon particles or metal particles on the base layer 22*a* and then layering a thin insulative layer made of heat-resistant resin such as polyimide resin on the thin conductive layer. Carbon particles used in the resistance heat generation layer 22*b* may be generally used carbon black particles or carbon nanoparticles made of at least one of carbon nanofiber, carbon nanotube, and carbon microcoil. Metal particles used in the resistance heat generation layer 22*b* may be silver, aluminum, or nickel particles having a granular or filament shape.

The insulation layer 22*d* is manufactured by coating the base layer 22*a* with an insulative material containing heat-resistant resin such as polyimide resin also used in the base layer 22*a*.

The electrode layer 22*c* is manufactured by coating the base layer 22*a* and the resistance heat generation layer 22*b* with conductive ink or silver conductive paste or by adhering metallic foil or metallic mesh to the base layer 22*a* and the resistance heat generation layer 22*b*.

The heat generation sheet 22*s* of the laminated heater 22 is a thin sheet having a decreased thermal capacity that facilitates quick heating of the heat generation sheet 22*s*. An amount of heat generation of the heat generation sheet 22*s* is arbitrarily set according to the volume resistivity of the resistance heat generation layer 22*b*. That is, the amount of heat generation of the heat generation sheet 22*s* is adjusted according to the material, shape, size, and dispersion of conductive particles constituting the resistance heat generation layer 22*b*. For example, the laminated heater 22 that generates heat in an amount of about 35 W/cm$^2$ per unit area outputs a total power of about 1,200 W. In this case, the heat generation sheet 22*s* has a width of about 20 cm in an axial direction thereof parallel to the axial direction AD of the fixing belt 21 and a length of about 2 cm in a circumferential direction thereof parallel to the circumferential direction CD of the fixing belt 21.

If a metallic filament such as a stainless steel filament is used as a laminated heater, the metallic filament creates asperities on a surface of the laminated heater. Accordingly, as the fixing belt 21 slides over the laminated heater, the fixing belt 21 wears the surface of the laminated heater easily. To address this problem, the heat generation sheet 22*s* according to this exemplary embodiment has a smooth surface without asperities, improving durability of the laminated heater 22 against sliding of the fixing belt 21 over the laminated heater 22. Additionally, a surface of the resistance heat generation layer 22*b* may be coated with fluoro resin to further improve durability of the laminated heater 22.

As shown in FIG. 2, the heat generation sheet 22*s* is disposed opposite the inner circumferential surface of the fixing belt 21 from a position opposite the fixing nip N to a position in proximity to an entry to the fixing nip N in the rotation direction D2 of the fixing belt 21. However, the heat generation sheet 22*s* may be disposed opposite the fixing belt 21 in other area. For example, the heat generation sheet 22*s* may extend to the entry to the fixing nip N or face the entire inner circumferential surface of the fixing belt 21 other than the fixing nip N. According to this exemplary embodiment, the laminated heater 22 is used as a heater that heats the fixing belt 21. Alternatively, a halogen heater may be used as a heater that heats the fixing belt 21.

Referring to FIGS. 1 and 6 to 9, the following describes assembly of the components disposed inside the loop formed by the fixing belt 21 described above.

Figure 6:
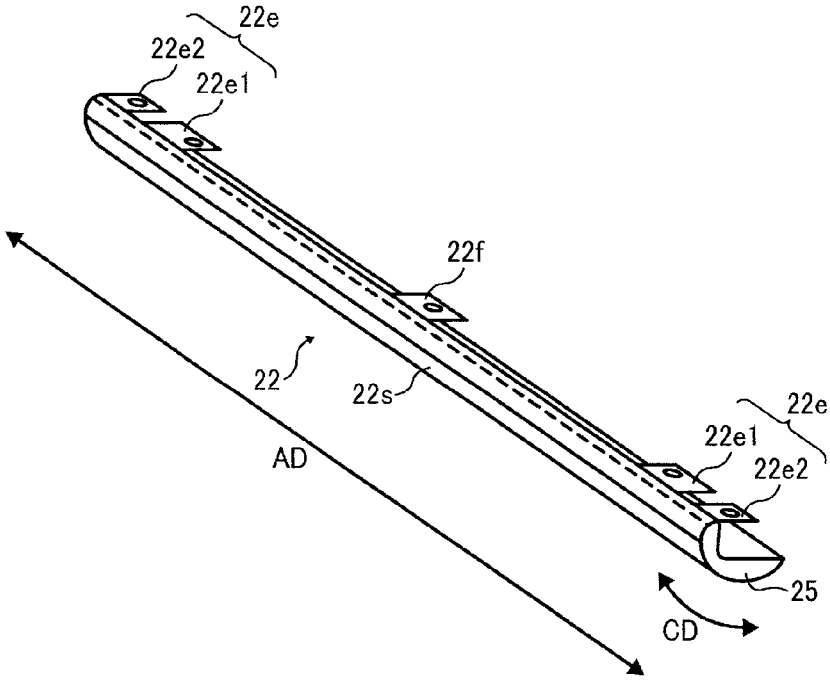
FIG. 6 is a perspective view of the laminated heater and a laminated heater support incorporated in the fixing device shown in FIG. 2.
Figure 7:
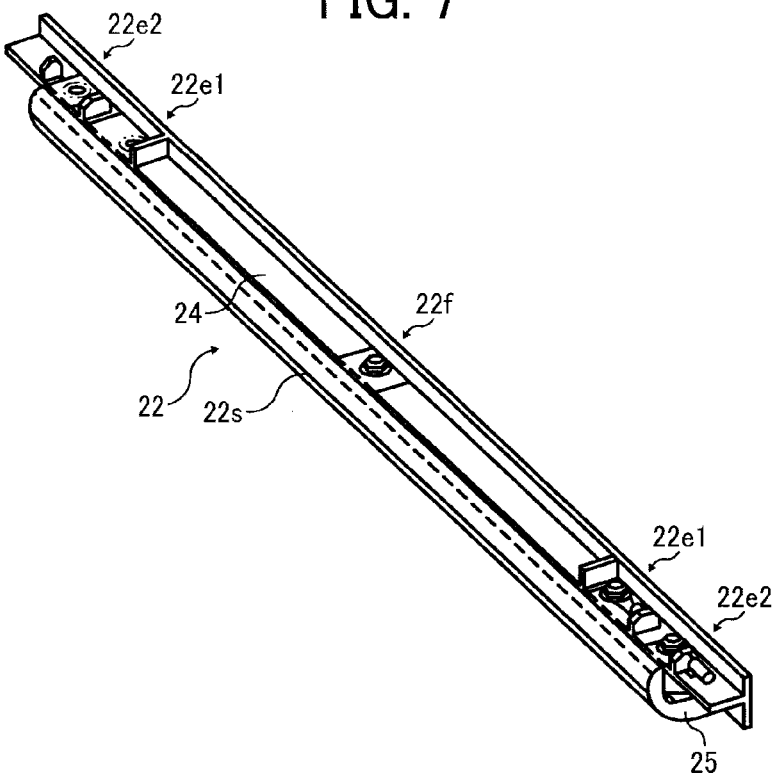
FIG. 7 is a perspective view of the laminated heater, the laminated heater support, and a terminal board stay incorporated in the fixing device shown in FIG. 2.
Figure 8:
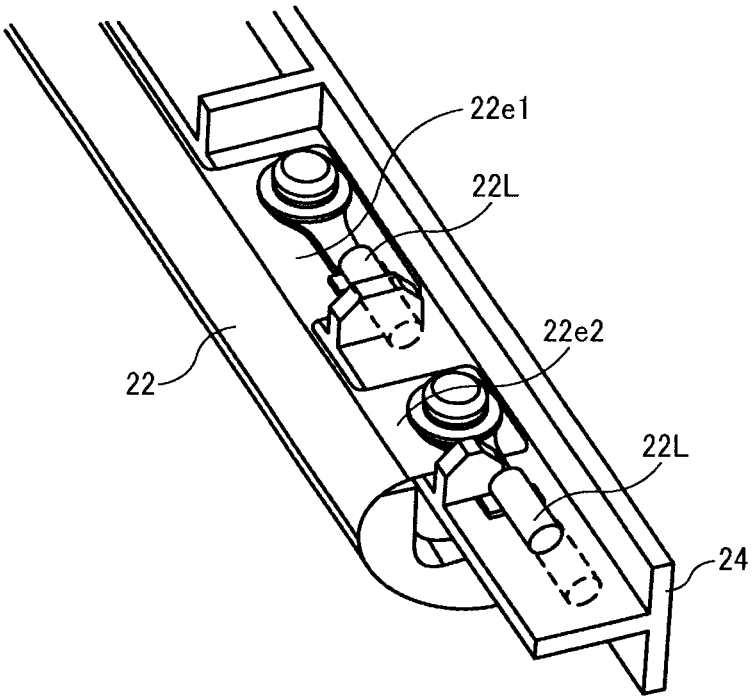
FIG. 8 is a partial perspective view of the laminated heater, the terminal board stay, and a feeder incorporated in the fixing device shown in FIG. 2.
Figure 9:
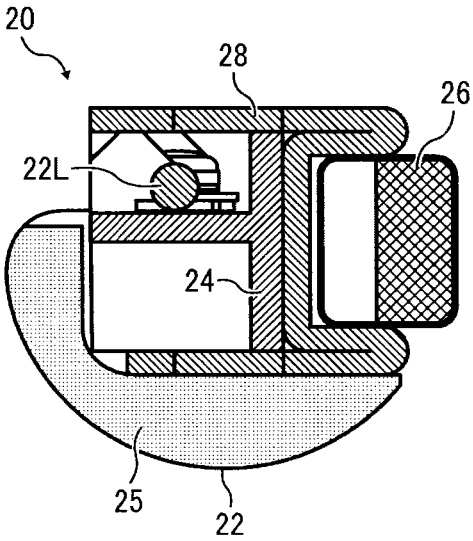
FIG. 9 is a partial vertical sectional view of components disposed inside a loop formed by the fixing belt shown in FIG. 2.

FIG. 6 is a perspective view of the laminated heater 22 and the laminated heater support 25. FIG. 7 is a perspective view of the laminated heater 22, the laminated heater support 25, and the terminal board stay 24. FIG. 8 is a partial perspective view of the laminated heater 22, the terminal board stay 24, and the feeder 22L. FIG. 9 is a partial vertical sectional view of the components disposed inside the loop formed by the fixing belt 21.

In a first step, as shown in FIG. 6, the heat generation sheet 22*s* of the laminated heater 22 is adhered to an outer circumferential surface of the laminated heater support 25 with an adhesive. For example, the adhesive may have a decreased thermal conductivity that minimizes heat conduction from the heat generation sheet 22*s* to the laminated heater support 25.

All of the plurality of electrode terminal pairs 22*e* connected to the electrode layer 22*c* depicted in FIG. 5, that is, inboard electrode terminals 22*e*1 and outboard electrode terminals 22*e*2, are situated at one edge of the heat generation sheet 22*s* in the circumferential direction CD of the fixing belt 21. For example, the inboard electrode terminals 22*e*1 and the outboard electrode terminals 22*e*2 are mounted on one edge of the heat generation sheet 22*s* disposed opposite another edge disposed in proximity to the fixing nip N and opposite the pressing roller 31 in the circumferential direction CD of the fixing belt 21. Further, one pair of the inboard electrode terminal 22*e*1 and the outboard electrode terminal 22*e*2 is mounted on one end of the heat generation sheet 22*s* and another pair of the inboard electrode terminal 22*e*1 and the outboard electrode terminal 22*e*2 is mounted on another end of the heat generation sheet 22*s* in the axial direction AD of the fixing belt 21.

In a second step, a part of the heat generation sheet 22*s* in proximity to the electrode terminal pairs 22*e* is folded along a longitudinal edge of the laminated heater support 25, directing the electrode terminal pairs 22*e* toward the rotation axis O depicted in FIG. 2 of the fixing belt 21. Then, as shown in FIGS. 7 and 8, the inboard electrode terminal 22*e*1 and the outboard electrode terminal 22*e*2 are mounted on the terminal board stay 24 and connected to the feeder 22L. As shown in FIG. 8, the inboard electrode terminal 22*e*1 and the outboard electrode terminal 22*e*2 are secured to the terminal board stay 24 with screws, respectively. As shown in FIG. 6, a securing terminal 22*f* is mounted on a center of the edge of the heat generation sheet 22*s* in the axial direction AD of the fixing belt 21 mounting the electrode terminal pairs 22*e*. The securing terminal 22*f* is secured to the terminal board stay 24 with a screw as shown in FIG. 7, thus securing the heat generation sheet 22*s* to the terminal board stay 24.

In a third step, as shown in FIG. 9, the core holder 28 is placed inside the loop formed by the fixing belt 21 in such a manner that the second recess of the H-shaped core holder 28 houses the terminal board stay 24. Further, the first recess of the H-shaped core holder 28 facing the fixing nip N houses the nip formation pad 26, thus completing assembly of the components to be placed inside the loop formed by the fixing belt 21. Finally, the assembled components are placed inside the loop formed by the fixing belt 21 as shown in FIG. 2, completing installation of the components inside the loop formed by the fixing belt 21.

Referring to FIGS. 1 and 2, the following describes a fixing operation performed by the fixing device 20 having the construction described above.

As the image forming apparatus 1 receives an output signal output from a control panel disposed atop the image forming apparatus 1 or an external device such as a client computer, that is, as the image forming apparatus 1 receives a print job requested by a user, the pressing roller 31 is pressed against the nip formation pad 26 via the fixing belt 21, thus forming the fixing nip N between the pressing roller 31 and the fixing belt 21. As a driver drives and rotates the pressing roller 31 clockwise in FIG. 2 in the rotation direction D3, the fixing belt 21 also rotates counterclockwise in the rotation direction D2 in accordance with rotation of the pressing roller 31. Accordingly, the fixing belt 21 slides over the laminated heater 22 supported by the laminated heater support 25. Simultaneously, as an external power supply or an internal capacitor supplies power to the laminated heater 22 through the feeder 22L, the heat generation sheet 22*s* connected to the feeder 22L generates heat that is conducted to the fixing belt 21 contacting the heat generation sheet 22*s*, thus heating the fixing belt 21 quickly and effectively.

It is to be noted that the heat generation sheet 22*s* may not start heating the fixing belt 21 simultaneously with the start of driving of the pressing roller 31 by the driver. That is, there may be time difference between the start of heating of the fixing belt 21 by the heat generation sheet 22*s* and the start of driving of the pressing roller 31 by the driver.

A temperature detector disposed upstream from the fixing nip N in the rotation direction D2 of the fixing belt 21 detects the temperature of the fixing belt 21. The temperature detector is disposed opposite the outer circumferential surface of the fixing belt 21 or an inner circumferential surface of the laminated heater support 25 in a state in which the temperature detector is in contact with or isolation from the fixing belt 21 and the laminated heater support 25. The temperature detector is operatively connected to a controller, that is, a central processing unit (CPU), provided with a random-access memory (RAM) and a read-only memory (ROM), for example, which controls output of the laminated heater 22 to heat the fixing belt 21 to a predetermined fixing temperature based on the temperature of the fixing belt 21 detected by the temperature detector. When the fixing belt 21 is heated to the predetermined fixing temperature, a recording medium P bearing a toner image T is conveyed to the fixing nip N.

As described above, the fixing device 20 incorporating the fixing belt 21 and the laminated heater 22 having a decreased heat capacity shortens warm-up time required to warm up the fixing belt 21 and first print time required to discharge a recording medium P bearing a fixed toner image T onto the output tray 100 after the image forming apparatus 1 receives a print job while saving energy. Since the heat generation sheet 22*s* is a resin sheet, even if the heat generation sheet 22*s* repeatedly receives a mechanical stress due to rotation and vibration of the pressing roller 31 and therefore is bent repeatedly, the heat generation sheet 22*s* is not worn and broken, resulting in an extended life of the heat generation sheet 22*s*.

Before the image forming apparatus 1 receives an output signal to start a print job from the control panel or the external device, the pressing roller 31 and the fixing belt 21 do not rotate and the laminated heater 22 is not supplied with power. However, if there is a need to start a print job immediately after the image forming apparatus 1 receives the print job, it is possible to supply power to the laminated heater 22 while the pressing roller 31 and the fixing belt 21 do not rotate. For example, the laminated heater 22 is supplied with power in an amount great enough to keep the entire fixing belt 21 warmed up.

The fixing belt 21 is configured to rotate in accordance with rotation of the pressing roller 31. However, the fixing belt 21 may be skewed in the axial direction AD thereof due to variation in dimension of parts constituting the fixing belt 21. For example, if a circumferential edge of the fixing belt 21 in the axial direction AD thereof comes into contact with the flange face 30*f* of the flange assembly 30 depicted in FIG. 4 directly, the circumferential edge of the fixing belt 21 may slide over and scratch the flange face 30*f* of the flange assembly 30, increasing the frequency of replacing the flange assembly 30. Further, if the fixing belt 21 scrapes particles off the flange face 30*f* of the flange assembly 30 by frictional contact with the flange face 30*f*, particles scraped off the flange face 30*f* may enter a gap between the inner circumferential surface of the fixing belt 21 and an outer circumferential surface of the tube 30*a*, increasing frictional resistance between the tube 30*a* and the fixing belt 21 sliding over the tube 30*a*. Accordingly, the rotation torque of the fixing belt 21 may increase, degrading movement and rotation of the fixing belt 21.

Figure 10A:
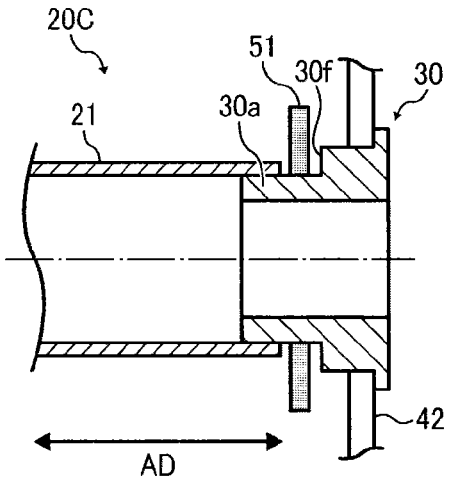
FIG. 10A is a partial horizontal sectional view of the comparative fixing device shown in FIG. 4.

To address these problems, a slip ring 51 rotatably contacts the tube 30*a* of the flange assembly 30 as shown in FIG. 10A. FIG. 10A is a partial horizontal sectional view of the comparative fixing device 20C. As shown in FIG. 10A, the slip ring 51 is interposed between the flange face 30*f* and the circumferential edge of the fixing belt 21 in the axial direction AD of the fixing belt 21. The slip ring 51 is a doughnut, that is, a disk with a through-hole into which the tube 30*a* is inserted. As the fixing belt 21 rotates, the slip ring 51 comes into contact with the circumferential edge of the fixing belt 21, preventing the circumferential edge of the fixing belt 21 from sliding over and wearing the flange face 30*f* of the flange assembly 30. For example, the slip ring 51 rotates in accordance with rotation of the fixing belt 21. Accordingly, a disk face of the slip ring 51 disposed opposite the flange face 30*f* of the flange assembly 30 slides over the flange face 30*f*, thus wearing itself instead of the flange face 30*f*.

Figure 10B:
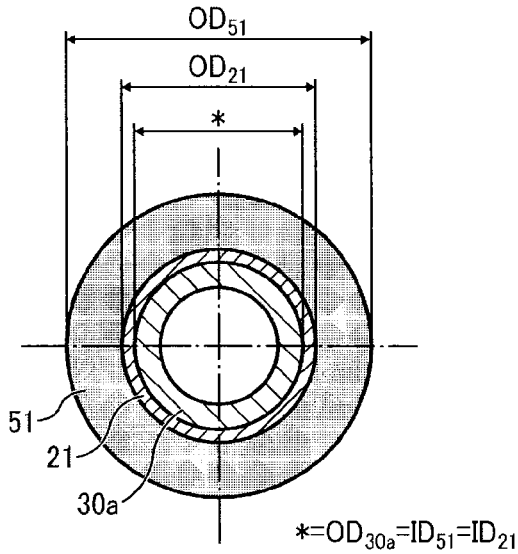
FIG. 10B is a vertical sectional view of a tube, the fixing belt, and a slip ring incorporated in the comparative fixing device shown in FIG. 10A.

FIG. 10B is a vertical sectional view of the tube 30*a* and the slip ring 51 of the flange assembly 30 and the fixing belt 21 illustrating diameters through a rotation axis of the slip ring 51. As shown in FIG. 10B, an outer diameter OD30*a* defines an outer diameter of the tube 30*a*; an inner diameter ID51 defines an inner diameter of the slip ring 51; an inner diameter ID21 defines an inner diameter of the fixing belt 21; an outer diameter OD21 defines an outer diameter of the fixing belt 21; and an outer diameter OD51 defines an outer diameter of the slip ring 51. The size of the diameters defined above has a relation shown by a formula (1) below.

$$OD30a \leq ID51 \leq ID21 < OD21 < OD51 \quad (1)$$

However, the configuration shown in FIGS. 10A and 10B also increases the rotation torque of the fixing belt 21, degrading movement and rotation of the fixing belt 21. Specifically, particles scraped off the slip ring 51 sliding over the flange face 30*f* of the flange assembly 30 move through the through-hole of the slip ring 51 and enter a gap between the inner circumferential surface of the fixing belt 21 and the outer circumferential surface of the tube 30*a*, increasing the frictional resistance between the tube 30*a* and the fixing belt 21 sliding over the tube 30*a*. If the diameters of the tube 30*a*, the fixing belt 21, and the slip ring 51 have the relation shown by the formula (1) above, particles scraped off the slip ring 51 move to the gap between the inner circumferential surface of the fixing belt 21 and the outer circumferential surface of the tube 30*a* easily.

Figure 11A:
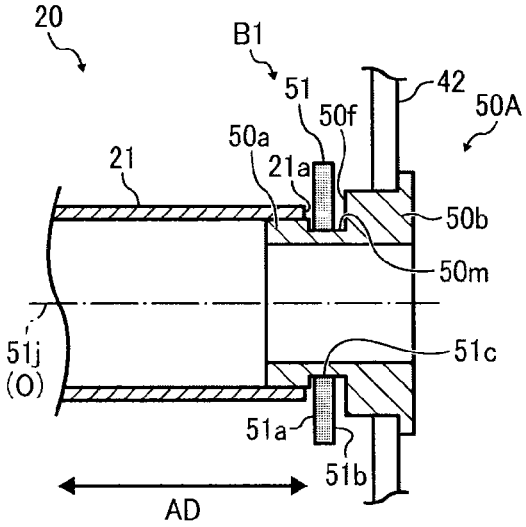
FIG. 11A is a partial horizontal sectional view of the fixing device shown in FIG. 2 illustrating a flange assembly incorporated therein.

To address this problem, that is, to minimize increase of the rotation torque of the fixing belt 21, the fixing device 20 incorporates a flange assembly 50A shown in FIG. 11A instead of the flange assembly 30 shown in FIG. 10A.

Figure 11B:
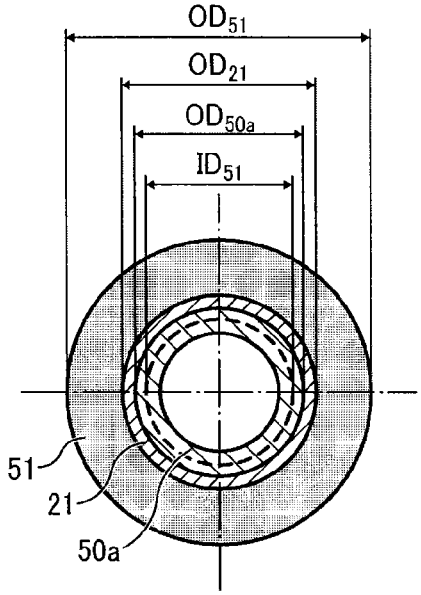
FIG. 11B is a vertical sectional view of a tube, the fixing belt, and the slip ring incorporated in the fixing device shown in FIG. 11A.

Referring to FIGS. 11A and 11B, the following describes a configuration of the flange assembly 50A.

FIG. 11A is a partial horizontal sectional view of the fixing device 20 incorporating a belt device B1 including the fixing belt 21 and the flange assembly 50A. FIG. 11B is a vertical sectional view of the tube 50*a*, the fixing belt 21, and the slip ring 51. The belt device B1 is installable in the fixing device 20 shown in FIG. 2. As shown in FIG. 11A, the flange assembly 50A is situated at one lateral end of the fixing belt 21 in the axial direction AD thereof. Although not shown, another flange assembly 50A is situated at another lateral end of the fixing belt 21 in the axial direction AD thereof. The flange assembly 50A includes a flange 50*b* mounted on the side plate 42 (e.g., a frame) of the fixing device 20 and having a flange face 50*f* disposed opposite the slip ring 51; and a tube 50*a* projecting from the flange face 50*f* of the flange 50*b* and contacting the inner circumferential surface of one lateral end of the fixing belt 21 in the axial direction AD thereof to rotatably support the fixing belt 21 directly. Alternatively, the tube 50*a* may support the fixing belt 21 indirectly. The tube 50*a* mounts a groove 50*m* created on an outer circumferential surface of the tube 50*a* along a circumferential direction thereof. The tube 50*a* is inserted into a through-hole 51*c* of the doughnut-shaped slip ring 51 in such a manner that the slip ring 51 is rotatable and slidable over the groove 50*m* of the tube 50*a*. A circumferential edge 21*a* of the fixing belt 21 disposed opposite the slip ring 51 separatably contacts an inner disk face 51*a* of the slip ring 51 disposed opposite the circumferential edge 21*a* of the fixing belt 21. A rotation axis 51*j* of the slip ring 51 is identical to a center axis of the circular tube 50*a* and the rotation axis O of the fixing belt 21.

FIG. 11B is a vertical sectional view of the tube 50*a*, the fixing belt 21, and the slip ring 51 illustrating the diameters through the rotation axis 51*j* of the slip ring 51. As shown in FIG. 11B, the inner diameter ID51 defines the inner diameter of the slip ring 51; an outer diameter OD50*a* defines an outer diameter of the tube 50*a*, that is, a smallest outer dimension of the tube 50*a*; the outer diameter OD21 defines the outer diameter of the fixing belt 21, that is, a greatest outer dimension of a circular track of the rotating fixing belt 21; and the outer diameter OD51 defines the outer diameter of the slip ring 51. The size of the diameters defined above has a relation shown by a formula (2) below.

$$ID51<OD50a<OD21<OD51 \quad (2)$$

The flange face 50*f* of the flange 50*b* separatably contacts an outer disk face 51*b* of the slip ring 51 disposed opposite the flange face 50*f*. The tube 50*a* projects from the flange face 50*f*. The flange 50*b* is mounted on the side plate 42 of the fixing device 20. The tube 50*a* is inserted into the loop formed by the fixing belt 21 at one lateral end of the fixing belt 21 in the axial direction AD thereof. The tube 50*a* is substantially circular in cross-section at a part other than a part overlapping the nip formation pad 26 depicted in FIG. 2. The outer diameter OD50*a* of the tube 50*a* is identical to or slightly smaller than the inner diameter ID21 of the fixing belt 21. Accordingly, when the tube 50*a* is inserted into the loop formed by the fixing belt 21 at each lateral end of the fixing belt 21 in the axial direction AD thereof, the tube 50*a* supports the fixing belt 21 in such a manner that the fixing belt 21 is rotatable while retaining its substantially circular loop.

The tube 50*a* mounts the groove 50*m* created on the outer circumferential surface of the tube 50*a* along the circumferential direction thereof and contiguous to the flange face 50*f* of the flange 50*b*. Specifically, an outer diameter of the groove 50*m*, that is, an outer diameter of a bottom of the groove 50*m*, is smaller than the outer diameter OD50*a* of the tube 50*a* throughout the entire outer circumferential surface of a part of the tube 50*a* other than a part overlapping the nip formation pad 26 depicted in FIG. 2.

A width of the groove 50*m* in the axial direction AD of the fixing belt 21 is slightly greater than a thickness of the through-hole 51*c* of the slip ring 51. Accordingly, the through-hole 51*c* of the slip ring 51 slides over the groove 50*m* mounted on the tube 50*a*. Consequently, even if the circumferential edge 21*a* of the rotating fixing belt 21 comes into contact with the slip ring 51, the slip ring 51 rotates smoothly without rattling.

A depth of the groove 50*m* is in a range of from about 0.7 mm to about 1.5 mm, for example. Accordingly, the groove 50*m* prohibits particles scraped off the slip ring 51 as the slip ring 51 slides over the flange face 50*f* of the flange 50*b* from moving across the groove 50*m* and entering the gap between the inner circumferential surface of the fixing belt 21 and the outer circumferential surface of the tube 50*a*.

The slip ring 51 is a doughnut, a disk with a through-hole, or a ring. The through-hole 51*c* of the slip ring 51 is rotatably placed onto the groove 50*m* mounted on the tube 50*a* and interposed between the circumferential edge 21*a* of the fixing belt 21 and the flange face 50*f* of the flange 50*b* in the axial direction AD of the fixing belt 21.

The outer disk face 51*b* of the slip ring 51 is made of a material worn more easily than the flange face 50*f* of the flange 50*b* as the slip ring 51 slides over the flange face 50*f*. That is, the slip ring 51 is subjected to abrasion relative to the flange 50*b*, minimizing abrasion of the flange 50*b*.

With the above-described configuration of the flange assembly 50A shown in FIGS. 11A and 11B, as the fixing belt 21 rotates in accordance with rotation of the pressing roller 31 depicted in FIG. 2, the fixing belt 21 may be skewed toward one of both lateral ends in the axial direction AD thereof. However, the diameters of the tube 50*a*, the fixing belt 21, and the slip ring 51 through the rotation axis 51*j* of the slip ring 51 and the rotation axis O of the fixing belt 21 have the relation defined by the formula (2) above, bringing the circumferential edge 21*a* of the fixing belt 21 into contact with the inner disk face 51*a* of the slip ring 51 and thus preventing the circumferential edge 21*a* of the fixing belt 21 from wearing the flange face 50*f* of the flange 50*b* of the flange assembly 50A. Specifically, the inner diameter ID51 of the slip ring 51 is smaller than the outer diameter OD50*a* of the tube 50*a* that is equivalent to the inner diameter of the track of the rotating fixing belt 21; the outer diameter OD50*a* of the tube 50*a* is smaller than the outer diameter OD21 of the track of the rotating fixing belt 21; the outer diameter OD21 of the track of the rotating fixing belt 21 is smaller than the outer diameter OD51 of the slip ring 51.

As the circumferential edge 21*a* of the fixing belt 21 comes into contact with the slip ring 51, the fixing belt 21 and the slip ring 51 rotate in a state in which the fixing belt 21 presses the slip ring 51 against the flange face 50*f* of the flange 50*b*. Accordingly, the slip ring 51 slides over the flange face 50*f* of the flange 50*b*, scraping particles off the slip ring 51. To address this circumstance, the groove 50*m* is created on the tube 50*a* and the inner diameter ID51 of the slip ring 51 that is equivalent to the diameter of the bottom of the groove 50*m* is smaller than the outer diameter OD50*a* of the tube 50*a* of the flange assembly 50A. Hence, even if particles scraped off the slip ring 51 enter the through-hole 51*c* of the slip ring 51, the outer circumferential surface of the tube 50*a* constitutes a step from the bottom of the groove 50*m* that prohibits the scraped particles from moving to the gap between the inner circumferential surface of the fixing belt 21 and the outer circumferential surface of the tube 50*a*. That is, the step from the bottom of the groove 50*m* drops the particles scraped off the slip ring 51 onto a place isolated from the fixing belt 21, thus minimizing increase of the rotation torque of the fixing belt 21.

The greatest outer diameter of the flange face 50*f* of the flange 50*b* is smaller than the outer diameter OD51 of the slip ring 51. The outer diameter OD51 of the slip ring 51 greater than the outer diameter of the flange face 50*f* of the flange 50*b* blocks entry of particles scraped off the outer disk face 51*b* of the slip ring 51 sliding over the flange face 50*f* of the flange 50*b* to the fixing belt 21, preventing the scraped particles from moving beyond a circumferential edge of the slip ring 51 and reaching the fixing belt 21. Instead, the slip ring 51 having the greater outer diameter OD51, as it rotates, moves the scraped particles to an outboard from the slip ring 51 in the axial direction AD of the fixing belt 21.

Figure 12:
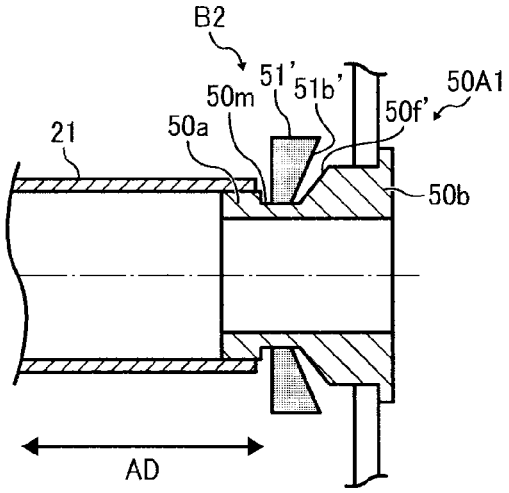
FIG. 12 is a partial horizontal sectional view of the fixing belt and a flange assembly as a first variation of the flange assembly shown in FIG. 11A.

Referring to FIG. 12, the following describes a belt device B2 incorporating a flange assembly 50A1 as a first variation of the flange assembly 50A depicted in FIG. 11A.

The flange assembly 50A1 incorporates a slip ring 51' and a flange face 50*f'* instead of the slip ring 51 and the flange face 50*f* depicted in FIG. 11A. FIG. 12 is a partial horizontal sectional view of the belt device B2. As shown in FIG. 12, the flange assembly 50A1 is situated at one lateral end of the fixing belt 21 in the axial direction AD thereof. Although not shown, another flange assembly 50A1 is situated at another lateral end of the fixing belt 21 in the axial direction AD thereof. As shown in FIG. 12, the slip ring 51' has a shape different from that of the slip ring 51 depicted in FIG. 11A; the flange face 50*f'* has a shape different from that of the flange face 50*f* depicted in FIG. 11A.

For example, the slip ring 51' has a thickness that gradually increases from an inner circumference to an outer circumference thereof. That is, an outer disk face 51*b'* of the slip ring 51' constitutes a slope from the inner circumference to the outer circumference of the slip ring 51' that gradually separates from the fixing belt 21 in the axial direction AD thereof. To correspond to the sloped outer disk face 51*b'* of the slip ring 51', the flange face 50*f'* also constitutes a slope from the groove 50*m* to an outer circumference of the flange 50*b* that gradually separates from the fixing belt 21 in the axial direction AD thereof. Thus, the slip ring 51' and the flange face 50*f'* of the flange assembly 50A1 move particles scraped off the slip ring 51' sliding over the flange face 50*f'* to an outboard from the slip ring 51' in the axial direction AD of the fixing belt 21 more effectively.

Figure 13:
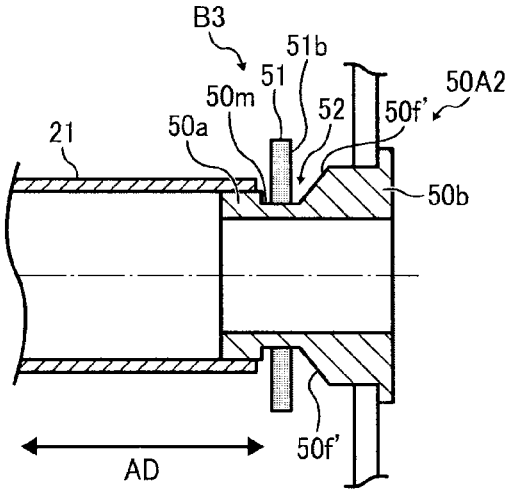
FIG. 13 is a partial horizontal sectional view of the fixing belt and a flange assembly as a second variation of the flange assembly shown in FIG. 11A.

Referring to FIG. 13, the following describes a belt device B3 incorporating a flange assembly 50A2 including a storage 52 as a second variation of the flange assembly 50A depicted in FIG. 11A.

FIG. 13 is a partial horizontal sectional view of the belt device B3. As shown in FIG. 13, the flange assembly 50A2 is situated at one lateral end of the fixing belt 21 in the axial direction AD thereof. Although not shown, another flange assembly 50A2 is situated at another lateral end of the fixing belt 21 in the axial direction AD thereof.

As shown in FIG. 13, the storage 52, that is, space, is interposed between the outer disk face 51*b* of the slip ring 51 and the flange face 50*f'* of the flange 50*b* in the axial direction AD of the fixing belt 21. The storage 52 stores particles scraped off the slip ring 51. For example, like the flange assembly 50A1 depicted in FIG. 12, the flange assembly 50A2 includes the flange face 50*f'* constituting the slope from the groove 50*m* to the outer circumference of the flange 50*b* that gradually separates from the fixing belt 21 in the axial direction AD thereof. Hence, the flange face 50*f'* is spaced apart from the outer disk face 51*b* of the slip ring 51, creating the storage 52 between the outer disk face 51*b* of the slip ring 51 and the flange face 50*f'*. Accordingly, as the storage 52 temporarily stores particles scraped off the slip ring 51, the rotating slip ring 51 moves the scraped particles little by little from the storage 52 to the outboard from the slip ring 51 in the axial direction AD of the fixing belt 21.

Figure 14:
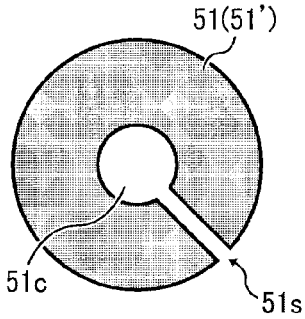
FIG. 14 is a front view of the slip ring incorporated in the flange assembly shown in FIG. 11A.
Figure 15A:
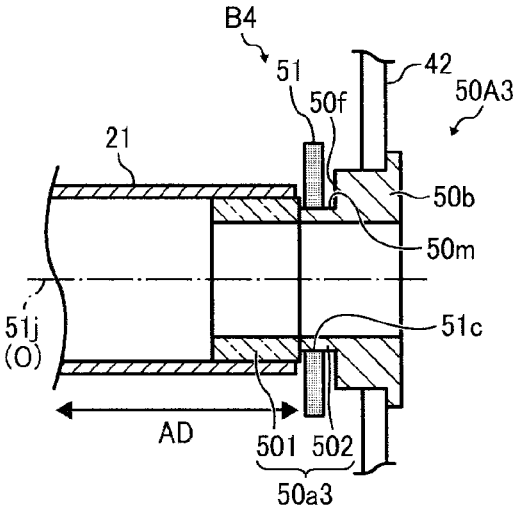
FIG. 15A is a partial horizontal sectional view of the fixing belt and a flange assembly as a third variation of the flange assembly shown in FIG. 11A.

Referring to FIGS. 14 and 15A, the following describes first and second methods for rotatably attaching the slip rings 51 and 51' to the groove 50*m*.

Referring to FIG. 14, a detailed description is now given of the first method for rotatably attaching the slip rings 51 and 51' to the groove 50*m*.

FIG. 14 is a front view of the slip rings 51 and 51'. As shown in FIG. 14, a slit 51*s* is produced in the slip ring 51 in such a manner that the slit 51*s* extends from an outer circumference of the slip ring 51 to the through-hole 51*c* on the inner disk face 51*a* and the outer disk face 51*b* depicted in FIG. 11A. The slit 51*s* is pressed against the groove 50*m* to warp the inner disk face 51*a* and the outer disk face 51*b* of the slip ring 51. Accordingly, the slit 51*s* is widely opened to sandwich an outer circumference of the groove 50*m*. The slit 51*s* slides over the groove 50*m* until the through-hole 51*c* of the slip ring 51 surrounds the groove 50*m*. Thus, the slip ring 51 is attached to the groove 50*m*. Similarly, the slip ring 51' depicted in FIG. 12 is attached to the groove 50*m*.

Referring to FIG. 15A, a detailed description is now given of the second method for rotatably attaching the slip ring 51 to the groove 50*m*.

FIG. 15A is a partial horizontal sectional view of a belt device B4 incorporating a flange assembly 50A3 as a third variation of the flange assembly 50A depicted in FIG. 11A. As shown in FIG. 15A, the flange assembly 50A3 is situated at one lateral end of the fixing belt 21 in the axial direction AD thereof. Although not shown, another flange assembly 50A3 is situated at another lateral end of the fixing belt 21 in the axial direction AD thereof. As shown in FIG. 15A, the flange assembly 50A3 incorporates a tube 50*a*3 including a first tubular portion 501 and a second tubular portion 502 having a diameter smaller than that of the first tubular portion 501. The first tubular portion 501 is detachably attached to the second tubular portion 502 and inserted into the loop formed by the fixing belt 21 at each lateral end of the fixing belt 21 in the axial direction AD thereof. The first tubular portion 501 is attached to the second tubular portion 502 projecting from the flange face 50*f* of the flange 50*b*, thus creating the groove 50*m* between the first tubular portion 501 and the flange face 50*f* across the second tubular portion 502.

With the above-described configuration of the flange assembly 50A3 incorporating the tube 50*a*3, the slip ring 51 is attached to the groove 50*m* as described below. The second tubular portion 502 of the tube 50*a*3 is inserted into the through-hole 51*c* of the slip ring 51, and then the first tubular portion 501 is attached to the second tubular portion 502. Thus, the slip ring 51 slidably contacts the groove 50*m*. Similarly, the slip ring 51' depicted in FIG. 12 is attached to the groove 50*m*.

Figure 15B:
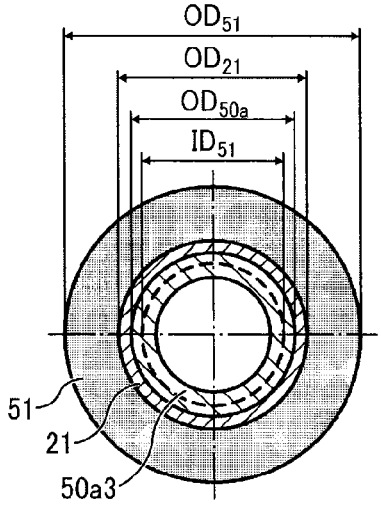
FIG. 15B is a vertical sectional view of a tube and the slip ring incorporated in the flange assembly shown in FIG. 15A and the fixing belt.

The first tubular portion 501 may be attached to the second tubular portion 502 by the first and second methods below. The first method is that an inner face of the first tubular portion 501 is attached to a front outer face of the second tubular portion 502. The second method is that the first tubular portion 501 is fastened to the second tubular portion 502 with a fastener. FIG. 15B is a vertical sectional view of the tube 50*a*3, the fixing belt 21, and the slip ring 51. Similar to the tube 50*a* depicted in FIG. 11B, the inner diameter ID51 of the slip ring 51, the outer diameter OD50*a* of the tube 50*a*3, the outer diameter OD21 of the fixing belt 21, and the outer diameter OD51 of the slip ring 51 have the relation defined by the formula (2) described above.

As shown in FIG. 2, since the fixing belt 21 rotates in accordance with rotation of the pressing roller 31, the pressing roller 31 exerts tension to the fixing belt 21 at the fixing nip N. Accordingly, an upstream portion of the fixing belt 21 from the fixing nip N in the rotation direction D2 of the fixing belt 21 is stretched toward the fixing nip N. Consequently, the inner circumferential surface of the fixing belt 21 slides over the laminated heater 22 in a state in which the fixing belt 21 is pressed against the laminated heater support 25. Conversely, a downstream portion of the fixing belt 21 from the fixing nip N in the rotation direction D2 of the fixing belt 21 does not receive tension from the pressing roller 31 and therefore is slackened. If the fixing belt 21 is rotated at increased speed, the downstream portion of the fixing belt 21 goes slack further, degrading stability of movement and rotation of the fixing belt 21.

To address this problem, a fixing belt support contacting at least the downstream portion of the fixing belt 21 to stabilize movement and rotation of the fixing belt 21 may be disposed inside the loop formed by the fixing belt 21 as described below.

Figure 16:
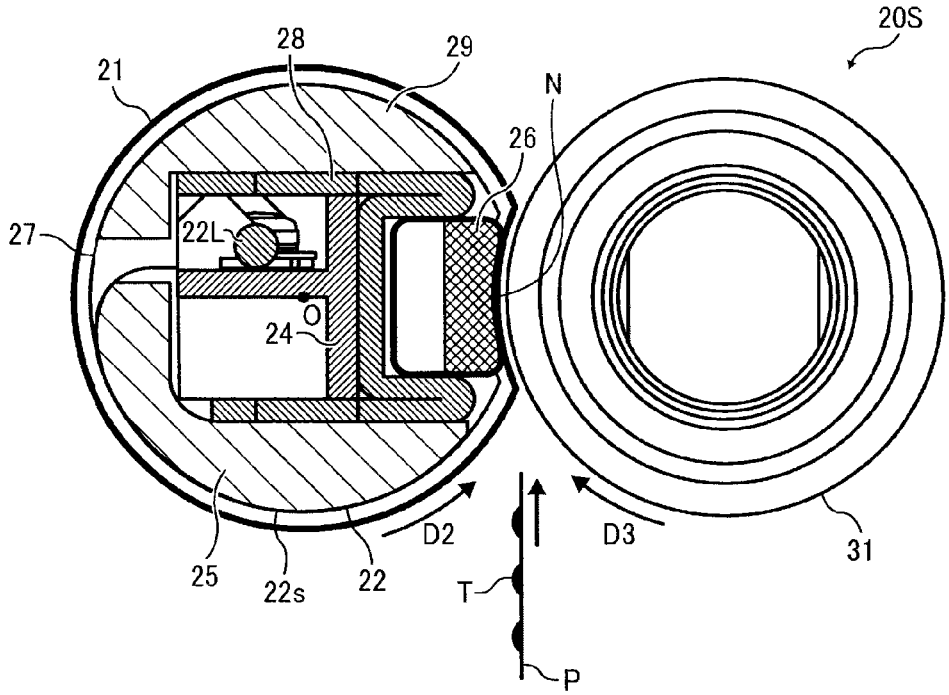
FIG. 16 is a vertical sectional view of a fixing device according to a second exemplary embodiment.

Referring to FIG. 16, the following describes a configuration of a fixing device 20S incorporating a fixing belt support 27 that supports the fixing belt 21.

FIG. 16 is a vertical sectional view of the fixing device 20S according to a second exemplary embodiment. As shown in FIG. 16, the fixing device 20S includes the substantially tubular fixing belt support 27 disposed inside the loop formed by the fixing belt 21 and an insulative support 29 disposed inside the substantially tubular fixing belt support 27 and opposite the downstream portion of the fixing belt 21 disposed downstream from the fixing nip N in the rotation direction D2 of the fixing belt 21. Specifically, the insulative support 29 is mounted on an outer surface of the H-shaped core holder 28. The core holder 28 supports the nip formation pad 26 in such a manner that the nip formation pad 26 projects slightly from the core holder 28 toward the pressing roller 31. Accordingly, the core holder 28 isolates the fixing belt support 27 from the fixing belt 21 at the fixing nip N. The other components of the fixing device 20S are equivalent to those of the fixing device 20 depicted in FIG. 2.

The fixing belt support 27 is a thin tube having a thickness in a range of from about 0.1 mm to about 1.0 mm and made of metal such as iron or stainless steel. An outer diameter of the fixing belt support 27 is smaller than the inner diameter of the fixing belt 21 by a range of from about 0.5 mm to about 1.0 mm. The fixing belt support 27 is cut in a longitudinal direction thereof parallel to the axial direction AD of the fixing belt 21, producing an opening extending throughout the longitudinal direction of the fixing belt support 27 and facing the fixing nip N. Both cut edges of the fixing belt support 27 are folded toward the core holder 28 so that the cut edges are isolated from the inner circumferential surface of the fixing belt 21 at the fixing nip N. The tube 50*a* of the flange assembly 50A depicted in FIG. 11A is inserted into a loop formed by the fixing belt support 27 at each lateral end of the fixing belt support 27 in the longitudinal direction thereof. Thus, the circular tube 50*a* retains a substantially circular shape in cross-section of the fixing belt support 27. In this case also, the center axis of the tube 50*a* is identical to the rotation axis O of the fixing belt 21.

The insulative support 29 situated downstream from the fixing nip N in the rotation direction D2 of the fixing belt 21 has heat resistance great enough to endure heat conducted from the fixing belt 21 via the fixing belt support 27; heat insulation that prevents heat radiation from the fixing belt support 27 contacting the fixing belt 21; and strength great enough to support the fixing belt support 27 without deformation of the fixing belt support 27 by contact with the fixing belt 21 sliding over the fixing belt support 27 as the fixing belt 21 rotates in the rotation direction D2. For example, like the laminated heater support 25, the insulative support 29 is made of molded foam of polyimide resin.

Figure 17:
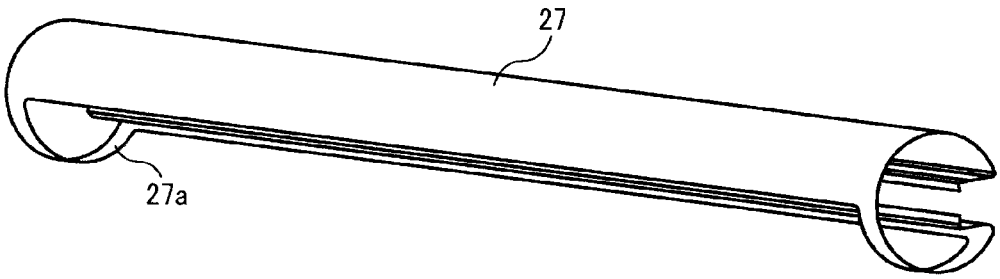
FIG. 17 is a perspective view of a fixing belt support incorporated in the fixing device shown in FIG. 16.
Figure 18A:
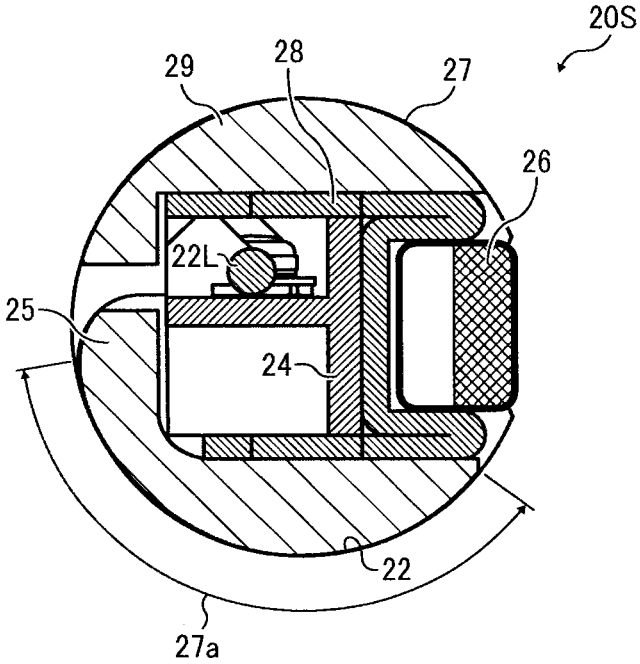
FIG. 18A is a vertical sectional view of components located inside the loop formed by the fixing belt incorporated in the fixing device shown in FIG. 16.
Figure 18B:
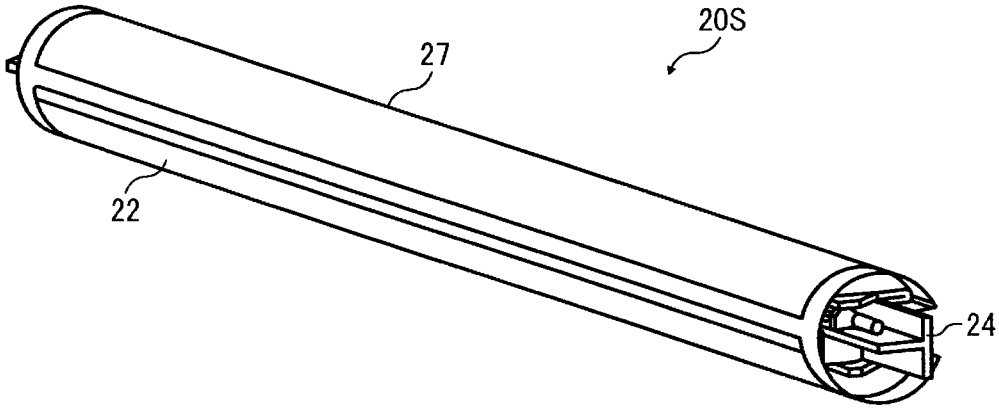
FIG. 18B is a perspective view of the components shown in FIG. 18A.

FIG. 17 is a perspective view of the fixing belt support 27. As shown in FIG. 17, the fixing belt support 27 includes a slot 27*a* produced by cutting away a part of the fixing belt support 27 disposed upstream from the fixing nip N in the rotation direction D2 of the fixing belt 21. FIG. 18A is a vertical sectional view of the components located inside the loop formed by the fixing belt 21 depicted in FIG. 16. FIG. 18B is a perspective view of the components located inside the loop formed by the fixing belt 21. As shown in FIGS. 18A and 18B, as the fixing belt support 27 is installed inside the loop formed by the fixing belt 21, the entire outer circumferential surface of the laminated heater 22 indicated by the arrow in FIG. 18A is exposed to the fixing belt 21 through the slot 27*a*, thus coming into contact with the inner circumferential surface of the fixing belt 21.

With the configuration of the fixing device 20S described above, like the fixing device 20 depicted in FIG. 2, the fixing device 20S shortens the warm-up time and the first print time while saving energy. Since the heat generation sheet 22*s* of the laminated heater 22 depicted in FIG. 16 is a resin sheet, even if the heat generation sheet 22*s* repeatedly receives a mechanical stress due to rotation and vibration of the pressing roller 31 and therefore is bent repeatedly, the heat generation sheet 22*s* is not worn and broken, resulting in an extended life of the heat generation sheet 22*s*. The laminated heater 22 heats various parts of the fixing belt 21 in the axial direction AD thereof, heating the recording medium P effectively according to the size of the recording medium P. The fixing belt support 27, together with the insulative support 29 that may be installed optionally, improves stability of movement and rotation of the fixing belt 21 even if the fixing belt 21 rotates at increased speed. The fixing belt support 27 facilitates heat conduction in the axial direction AD of the fixing belt 21, thus supplementarily heating the fixing belt 21 uniformly in the axial direction AD thereof as the fixing belt 21 rotates at increased speed.

Figure 19A:
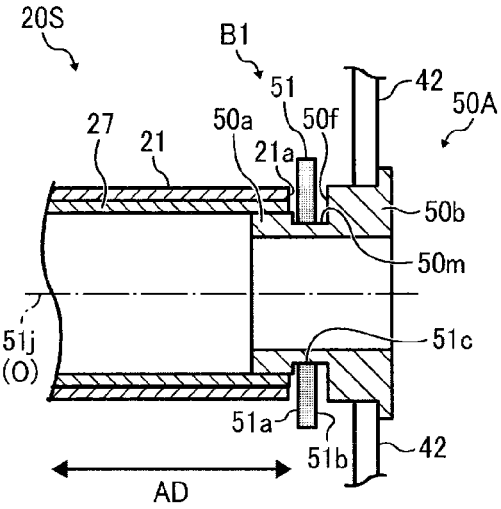
FIG. 19A is a partial horizontal sectional view of the fixing belt, the fixing belt support, and the flange assembly incorporated in the fixing device shown in FIG. 16.
Figure 19B:
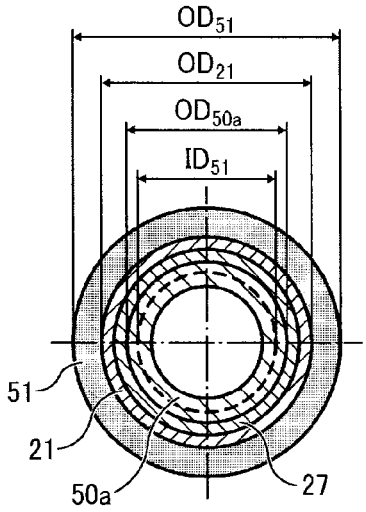
FIG. 19B is a vertical sectional view of the tube and the slip ring incorporated in the flange assembly shown in FIG. 19A and the fixing belt.

Referring to FIGS. 19A and 19B, a detailed description is now given of the flange assembly 50A installed in the fixing device 20S.

FIG. 19A is a partial horizontal sectional view of the fixing device 20S incorporating the belt device B1 including the fixing belt 21 and the flange assembly 50A. FIG. 19B is a vertical sectional view of the tube 50*a*, the fixing belt support 27, the fixing belt 21, and the slip ring 51. FIG. 19A illustrates one lateral end of the fixing device 20S in the axial direction AD of the fixing belt 21. Although not shown, another lateral end of the fixing device 20S has a configuration equivalent to that shown in FIG. 19A.

As shown in FIG. 19A, unlike the configuration of the fixing device 20 depicted in FIG. 11A, the tube 50*a* of the flange assembly 50A contacts and supports each lateral end of the fixing belt support 27 in the axial direction AD of the fixing belt 21. The fixing belt support 27 contacts and supports the inner circumferential surface of the fixing belt 21. The other configuration of the fixing device 20S is equivalent to that of the fixing device 20.

As shown in FIG. 19A, the substantially tubular fixing belt support 27 is disposed inside the loop formed by the fixing belt 21 in such a manner that an outer circumferential surface of the fixing belt support 27 contacts and supports the inner circumferential surface of the fixing belt 21, thus stabilizing rotation of the fixing belt 21. The flange 50*b* is mounted on the side plate 42 (e.g., a frame) of the fixing device 20S. The tube 50*a* projecting from the flange face 50*f* of the flange 50*b* is inserted into the loop formed by the fixing belt support 27 at each lateral end thereof in the axial direction AD of the fixing belt 21, thus rotatably supporting the fixing belt 21 indirectly via the fixing belt support 27. The groove 50*m* is created on the outer circumferential surface of the tube 50*a* along the circumferential direction thereof. The doughnut-shaped slip ring 51 slidably contacts the groove 50*m* in such a manner that an inner circumferential surface of the slip ring 51 contacts the groove 50*m*. The circumferential edge 21*a* of the fixing belt 21 contacts the inner disk face 51*a* of the slip ring 51. The diameters of the slip ring 51, the tube 50*a*, and the fixing belt 21 depicted in FIG. 19B through the rotation axis 51*j* of the slip ring 51 identical to the rotation axis O of the fixing belt 21 and the center axis of the circular tube 50*a* satisfy the formula (2) above.

With the above-described configuration of the flange assembly 50A shown in FIGS. 19A and 19B, as the fixing belt 21 rotates in accordance with rotation of the pressing roller 31 depicted in FIG. 16, the fixing belt 21 may be skewed toward one of both lateral ends in the axial direction AD thereof. However, the diameters of the tube 50*a*, the fixing belt 21, and the slip ring 51 through the rotation axis 51*j* of the slip ring 51 and the rotation axis O of the fixing belt 21 have the relation defined by the formula (2) above, bringing the circumferential edge 21*a* of the fixing belt 21 into contact with the inner disk face 51*a* of the slip ring 51 and thus preventing the circumferential edge 21*a* of the fixing belt 21 from wearing the flange face 50*f* of the flange 50*b* of the flange assembly 50A. Specifically, the inner diameter ID51 of the slip ring 51 is smaller than the outer diameter OD50*a* of the tube 50*a* that is equivalent to the inner diameter of the track of the rotating fixing belt 21; the outer diameter OD50*a* of the tube 50*a* is smaller than the outer diameter OD21 of the track of the rotating fixing belt 21; the outer diameter OD21 of the track of the rotating fixing belt 21 is smaller than the outer diameter OD51 of the slip ring 51.

As the circumferential edge 21*a* of the fixing belt 21 comes into contact with the slip ring 51, the fixing belt 21 and the slip ring 51 rotate in a state in which the fixing belt 21 presses the slip ring 51 against the flange face 50*f* of the flange 50*b*. Accordingly, the slip ring 51 slides over the flange face 50*f* of the flange 50*b*, scraping particles off the slip ring 51. To address this circumstance, the groove 50*m* is created on the tube 50*a* of the flange assembly 50A and the inner diameter ID51 of the slip ring 51 that is equivalent to the diameter of the bottom of the groove 50*m* is smaller than the outer diameter OD50*a* of the tube 50*a*. Hence, even if particles scraped off the slip ring 51 enter the through-hole 51*c* of the slip ring 51, the outer circumferential surface of each of the tube 50*a* and the fixing belt support 27 constitutes a step from the bottom of the groove 50*m*, which prohibits the scraped particles from moving to the gap between the inner circumferential surface of the fixing belt 21 and the outer circumferential surface of the tube 50*a*. That is, the step from the bottom of the groove 50*m* drops the particles scraped off the slip ring 51 onto a place isolated from the fixing belt 21, thus minimizing increase of the rotation torque of the fixing belt 21. The configurations shown in FIGS. 12 to 15B are also applicable to the fixing device 20S.

Referring to FIGS. 20 to 31D, the following describes a configuration of a fixing device 20T according to a third exemplary embodiment.

Figure 20:
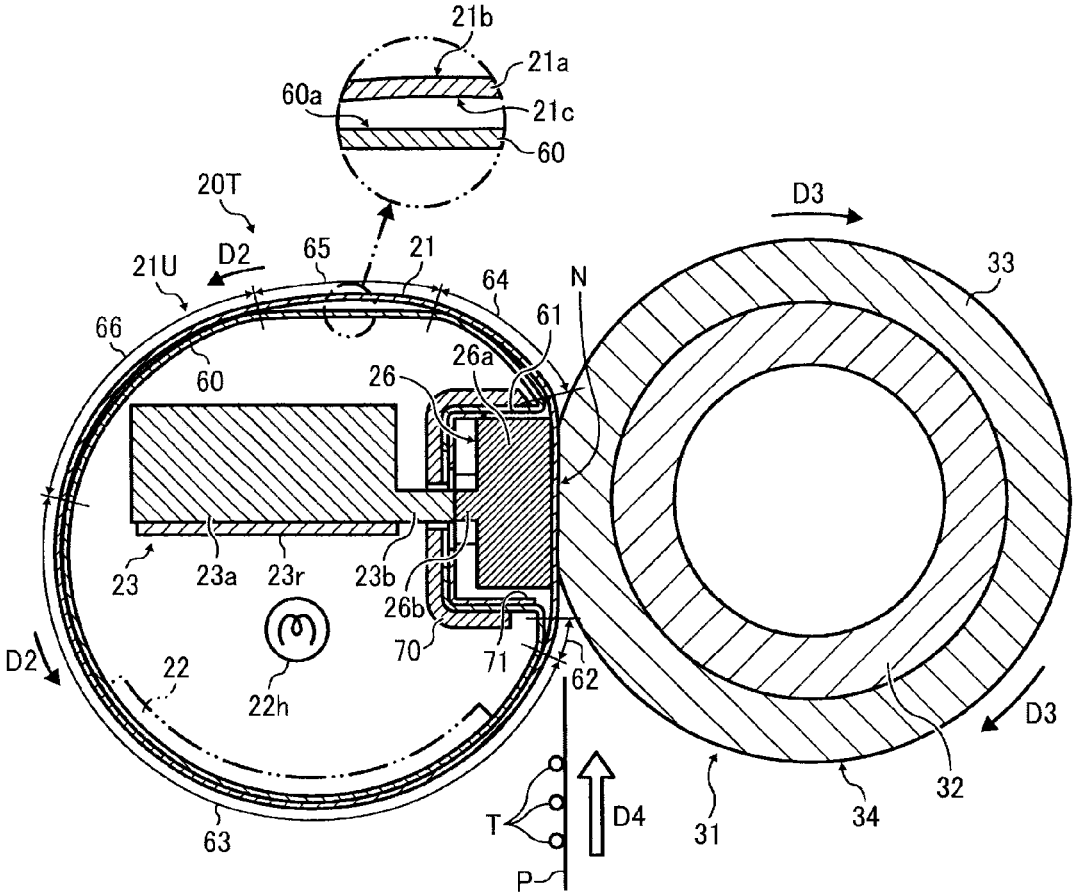
FIG. 20 is a vertical sectional view of a fixing device according to a third exemplary embodiment.
Figure 25:
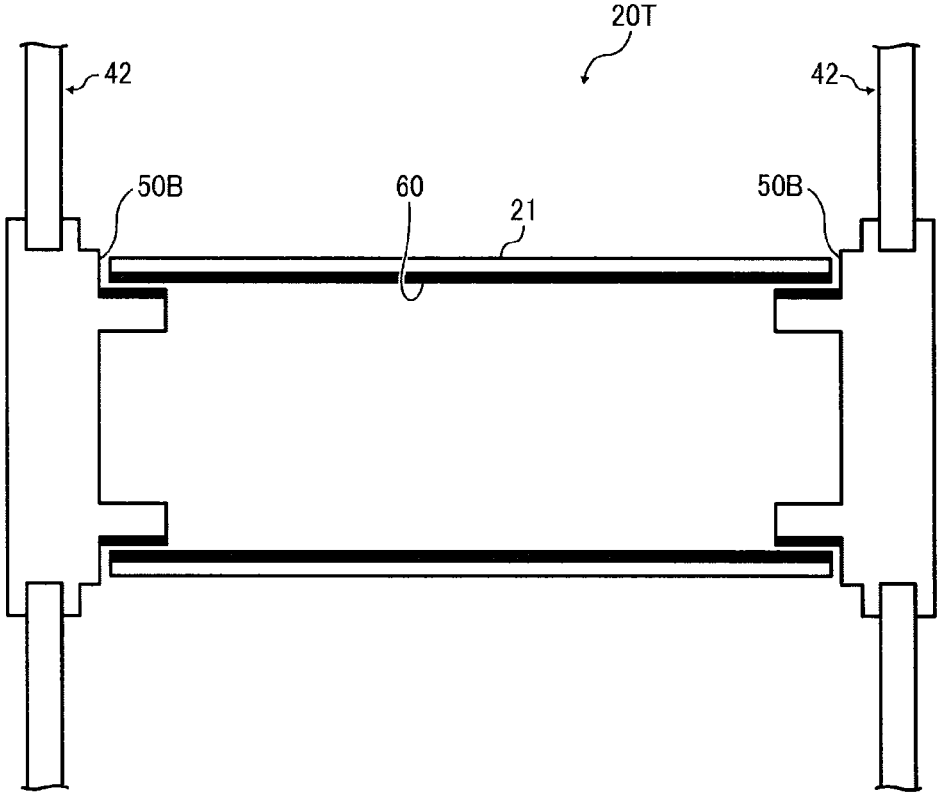
FIG. 25 is a horizontal sectional view of the fixing device shown in FIG. 20.
Figure 26:
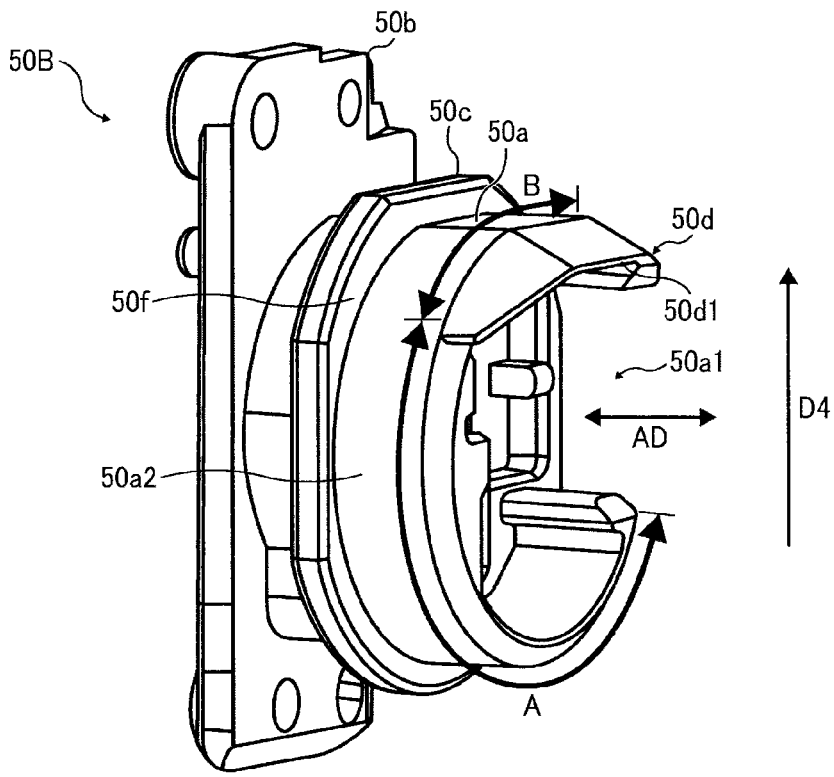
FIG. 26 is a vertical perspective view of the flange assembly shown in FIG. 24.

FIG. 20 is a vertical sectional view of the fixing device 20T incorporating the fixing belt 21 that does not retain a circular track during rotation. As illustrated in FIG. 20, the fixing device 20T includes the flexible, endless fixing belt 21 rotatable in the rotation direction D2; the pressing roller 31 disposed outside a loop formed by the fixing belt 21 and pressed against the fixing belt 21; the nip formation pad 26 disposed inside the loop formed by the fixing belt 21 and pressed by the pressing roller 31 to form the fixing nip N between the pressing roller 31 and the fixing belt 21 through which a recording medium P bearing a toner image T is conveyed; a fixing belt support 60, having a substantially tubular or pipe shape, disposed inside the loop formed by the fixing belt 21 and rotatably supporting the fixing belt 21; a heater 22*h* disposed inside a loop formed by the fixing belt support 60 to heat the fixing belt 21 via the fixing belt support 60; and a reinforcement 23 disposed inside the loop formed by the fixing belt support 60 and mounted on a frame of the image forming apparatus 1 depicted in FIG. 1, thus supporting the fixing belt support 60. As shown in FIG. 26, the fixing device 20T further includes a flange assembly 50B disposed at each lateral end of the fixing device 20T in a longitudinal direction thereof. As shown in FIG. 25, the fixing device 20T further includes the side plates 42 (e.g., frames), each of which supports the flange assembly 50B.

Referring to FIG. 20, a detailed description is now given of a construction of the fixing belt 21.

The substantially tubular fixing belt 21 having an inner loop diameter of about 30 mm is constructed of a base layer 21*a* made of iron and having a thickness in a range of from about 30 micrometers to about 50 micrometers; a release layer 21*b* coating the base layer 21*a* and constituting an outer surface of the fixing belt 21; and a coating film 21*c* coating the base layer 21*a* and constituting an inner surface of the fixing belt 21. An elastic layer, made of silicone rubber and having a thickness in a range of from about 100 micrometers to about 300 micrometers, is interposed between the base layer 21*a* and the release layer 21*b*. Alternatively, the fixing belt 21 may have a loop diameter in a range of from about 15 mm to about 120 mm, preferably, about 25 mm.

The base layer 21*a* may be made of a material other than iron, for example, cobalt, nickel, stainless steel, conductive metal such as an alloy of these, synthetic resin such as polyimide, or the like.

The release layer 21*b* facilitates separation of toner of the toner image T on the recording medium P from the fixing belt 21. The release layer 21*b* has a thickness in a range of from about 5 micrometers to about 50 micrometers and is made of PFA. Alternatively, the release layer 21*b* may be made of polytetrafluoroethylene (PTFE), polyimide, polyetherimide, polyethersulfone (PES), or the like.

The coating film 21*c* decreases frictional resistance between the fixing belt 21 and the fixing belt support 60. For example, the coating film 21*c* is made of Teflon®. Alternatively, the coating film 21*c* may be manufactured by surface coating such as plating, diamond like carbon (DLC) coating, and glass coating.

Referring to FIGS. 20 to 23, a detailed description is now given of a construction of the fixing belt support 60.

Figure 21:
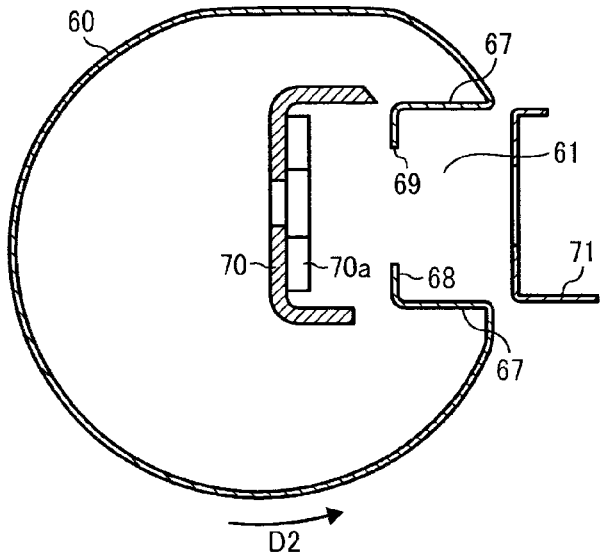
FIG. 21 is a vertical sectional view of a fixing belt support incorporated in the fixing device shown in FIG. 20.
Figure 22:
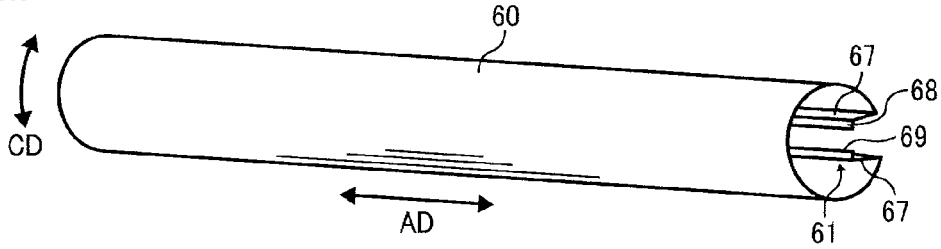
FIG. 22 is a perspective view of the fixing belt support shown in FIG. 21.
Figure 23:
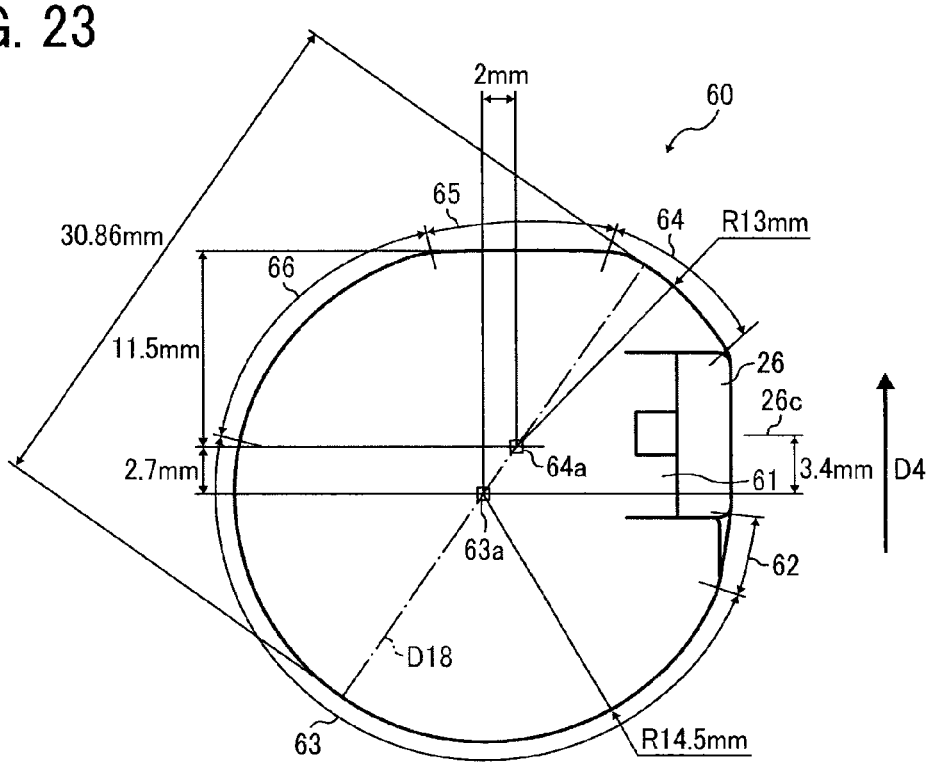
FIG. 23 is a schematic diagram of the fixing belt support shown in FIG. 22 illustrating dimension thereof.

FIG. 21 is a vertical sectional view of the fixing belt support 60. FIG. 22 is a perspective view of the fixing belt support 60. FIG. 23 is a schematic diagram of the fixing belt support 60 illustrating dimension thereof. As shown in FIG. 20, the fixing belt support 60 is a pipe having a substantially C-like shape in cross-section and a thickness in a range of from about 0.1 mm to about 1.0 mm and made of metal such as iron. As shown in FIG. 21, the fixing belt support 60 includes a recess 61 housing the nip formation pad 26 depicted in FIG. 20 that forms the fixing nip N. As shown in FIG. 20, the fixing belt support 60 further includes a nip entrance portion 62 contiguous to and situated upstream from the recess 61 in the rotation direction D2 of the fixing belt 21; a heating portion 63 contiguous to the nip entrance portion 62; a separation portion 64 contiguous to and situated downstream from the recess 61 in the rotation direction D2 of the fixing belt 21; a planar isolation portion 65 contiguous to the separation portion 64; and an intermediate portion 66 situated downstream from the isolation portion 65 in the rotation direction D2 of the fixing belt 21 and contiguous to the isolation portion 65 and the heating portion 63. The fixing belt support 60 is manufactured by stamping.

The heating portion 63 is situated contiguous to and upstream from the nip entrance portion 62 in the rotation direction D2 of the fixing belt 21. The heating portion 63 is an arch having a radius of about 14.5 mm and heated by the heater 22*h*. As shown in FIG. 23, an arc axis 63*a* of the heating portion 63 is situated at a distance of about 3.4 mm upstream from a center line 26*c* defining a center of the nip formation pad 26 in a recording medium conveyance direction D4. Hence, as the pressing roller 31 pulls the fixing belt 21 downstream in the recording medium conveyance direction D4, the fixing belt 21 sliding over the fixing belt support 60 adheres to the heating portion 63 of the fixing belt support 60 readily. An inner circumferential surface of the fixing belt support 60, especially an inner circumferential surface of the heating portion 63 thereof, is treated with black coating, improving radiation of heat from the heater 22*h*.

As shown in FIG. 23, the nip entrance portion 62 is situated at a distance from the arc axis 63*a* of the heating portion 63 that is smaller than a radius R of the heating portion 63 of about 14.5 mm. For example, the planar nip entrance portion 62 having a decreased curvature is contiguous to the recess 61 and the heating portion 63. Thus, the nip entrance portion 62 prevents isolation of the fixing belt 21 depicted in FIG. 20 from the fixing belt support 60 at a position in proximity to the fixing nip N.

The separation portion 64 is an arch having a radius R of about 13.0 mm that is smaller than the radius R of the heating portion 63 of about 14.5 mm. The separation portion 64 isolates the fixing belt 21 sliding thereover from the recording medium P discharged from the fixing nip N quickly, thus facilitating separation of the recording medium P from the fixing belt 21. An arc axis 64*a* of the separation portion 64 is situated at a distance of about 2.7 mm downstream from the arc axis 63*a* of the heating portion 63 in the recording medium conveyance direction D4 and at a distance of about 2.0 mm from the arc axis 63*a* of the heating portion 63 toward the fixing nip N in a direction orthogonal to the recording medium conveyance direction D4. Accordingly, a maximum outer diameter D18 through the arc axis 63*a* of the heating portion 63 and the arc axis 64*a* of the separation portion 64 defines a maximum outer diameter of the fixing belt support 60. For example, the maximum outer diameter D18 of about 30.86 mm is greater than the inner diameter of the fixing belt 21 of about 30.00 mm. Consequently, the fixing belt 21 is stretched between the heating portion 63 and the separation portion 64 and therefore adheres to the heating portion 63. In a state in which the nip formation pad 26 is assembled into the recess 61 of the fixing belt support 60, an outer circumferential length L1 of the fixing belt support 60 is smaller than an inner circumferential length L2 of the fixing belt 21 by about 0.7 mm.

The intermediate portion 66 is an arch having an arc axis identical to the arc axis 63*a* of the heating portion 63 and a radius identical to that of the heating portion 63. Hence, the heating portion 63 and the intermediate portion 66 have an identical curvature, facilitating manufacturing of the fixing belt support 60.

The isolation portion 65 is a plane situated at a distance of about 11.5 mm downstream from the arc axis 64*a* of the separation portion 64 in the recording medium conveyance direction D4 and interposed between the separation portion 64 and the intermediate portion 66 in the rotation direction D2 of the fixing belt 21. Hence, the isolation portion 65 of the fixing belt support 60 is isolated from the fixing belt 21 as shown in FIG. 20, decreasing frictional resistance therebetween.

As shown in FIG. 20, an outer circumferential surface of the fixing belt support 60 is coated with a coating film 60*a* that decreases frictional resistance between the fixing belt support 60 and the fixing belt 21 sliding over the fixing belt support 60. For example, the coating film 60*a* is made of Teflon®. Alternatively, the coating film 60*a* may be manufactured by surface coating such as plating, DLC coating, and glass coating. Further, grease is applied between the fixing belt support 60 and the fixing belt 21, thus decreasing frictional resistance between the fixing belt support 60 and the fixing belt 21 sliding over the fixing belt support 60.

As shown in FIG. 21, the recess 61 is constructed of a pair of side walls 67 disposed parallel to each other and extending inboard of the fixing belt support 60; a bottom wall 68 contiguous to an edge of the pair of side walls 67; and a slit 69 produced through the bottom wall 68. As shown in FIG. 20, the recess 61 is attached with a square bracket-shaped outer bracket 70 situated outside the recess 61, that is, inside the fixing belt support 60; and a square bracket-shaped inner bracket 71 situated inside the recess 61, that is, outside the fixing belt support 60. The outer bracket 70 and the inner bracket 71 sandwich the pair of side walls 67 and the bottom wall 68 of the recess 61 of the fixing belt support 60 and fastened with screws. Hence, the outer bracket 70 and the inner bracket 71 retain the shape of the recess 61. As shown in FIG. 21, a fastener 70*a* is mounted on each lateral end of the outer bracket 70 in a longitudinal direction thereof. The fastener 70*a* is secured to the fixing belt support 60 by the flange assembly 50B depicted in FIG. 24.

Figure 24:
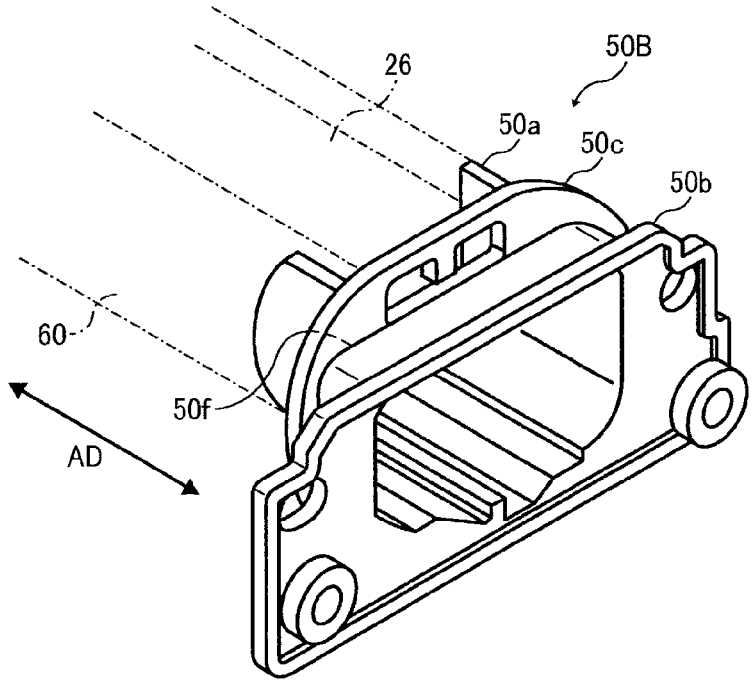
FIG. 24 is a horizontal perspective view of a flange assembly incorporated in the fixing device shown in FIG. 20.

Referring to FIGS. 20 and 24, a detailed description is now given of a construction of the nip formation pad 26.

FIG. 24 is a perspective view of the flange assembly 50B. As shown in FIG. 20, the nip formation pad 26 is housed by the inner bracket 71 and secured to the fixing belt support 60 by the flange assembly 50B depicted in FIG. 24. The nip formation pad 26 is made of heat-resistant resin such as liquid crystal polymer (LCP), polyimide resin, and polyamide imide resin (PAI). The nip formation pad 26 is a substantially square rod extending in a longitudinal direction of the fixing belt support 60 parallel to the axial direction AD of the fixing belt 21. As shown in FIG. 20, the nip formation pad 26 includes a body 26*a* disposed opposite the pressing roller 31 via the fixing belt 21; a projection 26*b* projecting from a back face of the body 26*a* opposite a front face thereof facing the fixing nip N and contacting the reinforcement 23, thereby supported by the reinforcement 23; and a film surrounding the body 26*a* to decrease frictional resistance between the nip formation pad 26 and the fixing belt 21 sliding over the nip formation pad 26.

As the pressing roller 31 presses against the body 26*a* of the nip formation pad 26, the projection 26*b* of the nip formation pad 26 comes into contact with the reinforcement 23. Accordingly, the nip formation pad 26 is supported by the reinforcement 23 and therefore is not displaced by pressure from the pressing roller 31. The front face of the body 26*a* of the nip formation pad 26 that faces the pressing roller 31 is planar. Alternatively, the front face of the body 26*a* of the nip formation pad 26 may be a concave face that corresponds to an outer circumferential surface of the pressing roller 31.

Referring to FIG. 20, a detailed description is now given of a construction of the reinforcement 23. As shown in FIG. 20, the reinforcement 23 is a substantially square metal rod extending in the longitudinal direction of the fixing belt support 60. The reinforcement 23 includes a rigid body 23*a*; a projection 23*b* contacting the projection 26*b* of the nip formation pad 26; and a reflection plate 23*r* disposed opposite the heater 22*h*. The projection 23*b* of the reinforcement 23 contacts the projection 26*b* of the nip formation pad 26 and supports the nip formation pad 26 pressed by the pressing roller 31 from the back face of the body 26*a* of the nip formation pad 26. The reflection plate 23*r* reflects radiation heat from the heater 22*h* to decrease heat absorbed by the body 23*a*. The reinforcement 23 is secured to the fixing belt support 60 by the flange assembly 50B depicted in FIG. 24.

Referring to FIG. 20, a detailed description is now given of a construction of the heater 22*h*.

As shown in FIG. 20, the heater 22*h* is a linear heater disposed inside the fixing belt support 60 and extending in the longitudinal direction of the fixing belt support 60. According to this exemplary embodiment, the heater 22*h* is a halogen heater. The heater 22*h* is disposed opposite the heating portion 63 of the fixing belt support 60. Hence, the heating portion 63 serves as a radiation region where heat from the heater 22*h* is radiated without being blocked by the reinforcement 23. A temperature sensor detecting the temperature of the fixing belt 21 is disposed opposite a proper position on the heating portion 63 of the fixing belt support 60.

Referring to FIGS. 24 and 25, a detailed description is now given of a construction of the flange assembly 50B.

FIG. 25 is a horizontal sectional view of the fixing device 20T. As shown in FIG. 24, the flange assembly 50B is inserted into the fixing belt support 60 at each lateral end of the fixing belt support 60 in the longitudinal direction thereof parallel to the axial direction AD of the fixing belt 21. The flange assembly 50B includes the tube 50*a* that retains the shape of the lateral end of the fixing belt support 60 in the longitudinal direction thereof; a collar 50*c* mounting the flange face 50*f* that regulates movement of the fixing belt 21 in the axial direction AD thereof; and the flange 50*b* mounted on the side plate 42 of the fixing device 20T depicted in FIG. 25. The nip formation pad 26, the outer bracket 70, the inner bracket 71, the reinforcement 23, and the heater 22*h* depicted in FIG. 20 are secured to and supported by the flange assembly 50B.

As shown in FIG. 20, the heating portion 63 of the fixing belt support 60 adheres to the fixing belt 21, heating the fixing belt 21 efficiently. The separation portion 64 of the fixing belt support 60 facilitates separation of the recording medium P from the fixing belt 21. To attain these different objectives, the heating portion 63 and the separation portion 64 have different shapes, respectively. However, since the fixing belt support 60 is a thin metal pipe, it is subject to manufacturing error and deformation due to sliding of the fixing belt 21 over the fixing belt support 60, resulting in failure in attaining these objectives. To address this problem, the outer circumferential surface of the tube 50*a* of the flange assembly 50B retains the shape of each lateral end of the fixing belt support 60 in the longitudinal direction thereof, attaining the objectives of the fixing belt support 60, a detailed description of which is deferred. Hence, a clearance not greater than about 0.15 mm is provided between the outer circumferential surface of the tube 50*a* and the inner circumferential surface of each lateral end of the fixing belt support 60 in the longitudinal direction thereof.

Referring to FIG. 20, a detailed description is now given of a construction of the pressing roller 31.

As shown in FIG. 20, the pressing roller 31, having an outer diameter of about 30 mm, is constructed of a metal pipe 32; an elastic layer 33 coating the metal pipe 32 and made of heat-resistant silicone rubber; and a surface release layer 34 made of PFA. For example, the elastic layer 33 has a thickness in a range of from about 2 mm to about 4 mm. The release layer 34 is a PFA tube coating the elastic layer 33 and having a thickness of about 50 micrometers. A heater such as a halogen heater may be situated inside the metal pipe 32.

A pressing mechanism presses the pressing roller 31 against the nip formation pad 26 via the fixing belt 21. As the pressing roller 31 is pressed against the nip formation pad 26 via the fixing belt 21, the fixing nip N is formed between the pressing roller 31 and the fixing belt 21. A driver drives and rotates the pressing roller 31 in the rotation direction D3 while the pressing roller 31 is pressed against the fixing belt 21. The fixing belt 21 rotates in the rotation direction D2 counter to the rotation direction D3 of the pressing roller 31 in accordance with rotation of the pressing roller 31, conveying the recording medium P bearing the toner image T through the fixing nip N while the fixing belt 21 and the pressing roller 31 apply heat and pressure to the recording medium P.

Referring to FIG. 20, the following describes an operation of the fixing device 20T having the configuration described above to fix a toner image T on a recording medium P.

Initially, the user enters a print job by using the control panel disposed atop the image forming apparatus 1 depicted in FIG. 1 or a client computer screen. As the image forming apparatus 1 receives the print job from the control panel or the client computer, the driver drives and rotates the pressing roller 31 which in turn rotates the fixing belt 21.

As shown in FIG. 23, since the arc axis 63*a* of the heating portion 63 of the fixing belt support 60 is situated upstream from the center line 26*c* of the nip formation pad 26 in the recording medium conveyance direction D4, the rotating pressing roller 31 pulls the fixing belt 21 downstream from the center line 26*c* in the recording medium conveyance direction D4, that is, toward the separation portion 64 and the isolation portion 65 of the fixing belt support 60 disposed opposite the heating portion 63 thereof. Accordingly, the fixing belt 21 adheres to the heating portion 63 of the fixing belt support 60 in such a manner that the fixing belt 21 does not separate from the heating portion 63 of the fixing belt support 60 easily. The heating portion 63 is an arch having the radius R of about 14.5 mm that is substantially identical to the radius of about 15.0 mm of the fixing belt 21. Hence, the fixing belt 21 adheres to the heating portion 63 of the fixing belt support 60 without deformation, improving adhesion between the fixing belt 21 and the heating portion 63 of the fixing belt support 60. The maximum outer diameter D18 of about 30.86 mm created between the heating portion 63 and the separation portion 64 of the fixing belt support 60 is greater than the inner diameter of about 30 mm of the fixing belt 21, stretching the fixing belt 21 between the heating portion 63 and the separation portion 64. Accordingly, the fixing belt 21 adheres to the heating portion 63 of the fixing belt support 60 and does not separate from the heating portion 63 easily. Consequently, the fixing belt 21 slides over the heating portion 63 of the fixing belt support 60 in a state in which the fixing belt 21 adheres to the heating portion 63.

As shown in FIG. 20, in synchronism with rotation of the pressing roller 31, the heater 22*h* is supplied with power, generating heat. The heating portion 63 of the fixing belt support 60 is radiated with the heat from the heater 22*h* and heated quickly. Alternatively, the heater 22*h* may start heating the fixing belt support 60 at a time different from a time when the pressing roller 31 starts rotating. The heating portion 63 of the fixing belt support 60 heats the fixing belt 21 based on the temperature of the fixing belt 21 detected by the temperature sensor until the fixing belt 21 at the fixing nip N is heated to a predetermined fixing temperature. Then, the recording medium P bearing the toner image T is conveyed to the fixing nip N maintained at the predetermined fixing temperature. As the recording medium P is conveyed through the fixing nip N, the fixing belt 21 and the pressing roller 31 apply heat and pressure to the recording medium P, thus fixing the toner image T on the recording medium P.

Referring to FIG. 20, the following describes advantages of the fixing device 20T described above.

As shown in FIG. 20, the fixing belt 21 adheres to the heating portion 63 of the fixing belt support 60 in such a manner that the fixing belt 21 does not separate from the heating portion 63 easily, improving thermal conductivity from the fixing belt support 60 to the fixing belt 21 and minimizing overheating of the fixing belt support 60 and wear of the coating film 60*a* of the fixing belt support 60 and the coating film 21*c* of the fixing belt 21. Enhanced adhesion between the fixing belt 21 and the fixing belt support 60 shortens the warm-up time and the first print time, saving energy.

As shown in FIG. 23, the separation portion 64 of the fixing belt support 60 is an arch having the radius R of about 13.0 mm smaller than the radius R of about 14.5 mm of the heating portion 63 of the fixing belt support 60, quickly isolating the fixing belt 21 sliding over the separation portion 64 from the recording medium P. Hence, the recording medium P discharged from the fixing nip N separates from the fixing belt 21 readily.

The outer circumferential length L1 of the fixing belt support 60 housing the nip formation pad 26 is smaller than the inner circumferential length L2 of the fixing belt 21 by a circumferential difference in range of from about 0.5 mm to about 0.9 mm. If the circumferential difference is greater than about 0.9 mm, the fixing belt 21 is wound around the fixing belt support 60 loosely, lifting a part of the fixing belt 21 from the fixing belt support 60 and thereby overheating a part of the fixing belt support 60 that corresponds to the lifted part of the fixing belt 21. As a result, durability of the coating film 60*a* of the fixing belt support 60 degrades. Conversely, if the circumferential difference is smaller than about 0.5 mm, the fixing belt 21 is wound around the fixing belt support 60 tightly, increasing friction between the fixing belt support 60 and the fixing belt 21 that hinders smooth rotation of the fixing belt 21. As a result, the pressing roller 31 and the recording medium P slip over the fixing belt 21. To address this circumstance, according to this exemplary embodiment, the circumferential difference is set in a range of from about 0.5 mm to about 0.9 mm, prohibiting the fixing belt 21 from lifting from the fixing belt support 60 and thereby preventing overheating of the fixing belt support 60. Additionally, the fixing belt 21 is not wound around the fixing belt support 60 tightly, minimizing slippage of the recording medium P over the fixing belt 21.

Since the pressing roller 31 pulls the fixing belt 21 at a region between the heating portion 63 and the separation portion 64 of the fixing belt support 60 in the rotation direction D2 of the fixing belt 21, even when the fixing belt 21 is halted, the fixing belt 21 adheres to the heating portion 63 of the fixing belt support 60. Accordingly, even when the fixing device 20T is powered on and the heater 22*h* heats the fixing belt 21 that does not yet start rotating, the heater 22*h* heats the fixing belt 21 effectively without overheating the fixing belt support 60.

As shown in FIG. 23, the nip entrance portion 62 situated between the heating portion 63 and the nip formation pad 26 in the rotation direction D2 of the fixing belt 21 is spaced apart from the arc axis 63*a* of the heating portion 63 in cross-section at a distance smaller than the radius R of about 14.5 mm of the heating portion 63, thus prohibiting the fixing belt 21 from lifting from the outer circumferential surface of the fixing belt support 60 at the nip entrance portion 62 and thereby preventing overheating of the fixing belt support 60.

The intermediate portion 66 is an arch having the arc axis identical to the arc axis 63*a* of the heating portion 63 and the radius identical to the radius R of about 14.5 mm of the heating portion 63. Hence, the heating portion 63 and the intermediate portion 66 have an identical curvature, facilitating manufacturing of the fixing belt support 60 at reduced manufacturing costs.

As shown in FIG. 20, the planar isolation portion 65 is situated between the separation portion 64 and the intermediate portion 66 in the rotation direction D2 of the fixing belt 21. Hence, the isolation portion 65 of the fixing belt support 60 is isolated from the fixing belt 21, decreasing frictional resistance therebetween to a level smaller than a frictional resistance between the fixing belt 21 and the recording medium P, minimizing slippage of the recording medium P over the fixing belt 21. Further, the fixing belt support 60 is made of a material having a minimized circumferential length, resulting in reduced manufacturing costs.

As shown in FIG. 20, the inner circumferential surface of the fixing belt 21 is coated with the coating film 21*c*; the outer circumferential surface of the fixing belt support 60 is coated with the coating film 60*a*; grease is applied between the inner circumferential surface of the fixing belt 21 and the outer circumferential surface of the fixing belt support 60. Accordingly, frictional resistance between the fixing belt support 60 and the fixing belt 21 sliding over the fixing belt support 60 is decreased to a level smaller than a frictional resistance between the fixing belt 21 and the recording medium P, minimizing slippage of the recording medium P over the fixing belt 21.

The heater 22*h* is a linear heater such as a halogen heater. Alternatively, the laminated heater 22 shown in the broken line in FIG. 20 that contacts the inner circumferential surface of the fixing belt support 60 and extends in the longitudinal direction of the fixing belt support 60 may be provided instead of the heater 22*h*.

In this case, the laminated heater 22, instead of the linear heater, that is, the heater 22*h*, contacts and heats the heating portion 63 of the fixing belt support 60 effectively, shortening the warm-up time and the first print time and thereby saving energy.

Yet alternatively, the heater 22*h* may be an induction coil disposed inside or outside the fixing belt support 60 to heat the fixing belt support 60 by electromagnetic induction. For example, the induction coil is disposed opposite the heating portion 63 of the fixing belt support 60. Since the induction coil heats only the fixing belt support 60 directly, unlike the linear heater, the induction coil does not heat components other than the fixing belt support 60, that is, the reinforcement 23, for example. Hence, the induction coil heats the fixing belt support 60 effectively.

On the other hand, as shown in FIG. 24, the flange assembly 50B is inserted and secured inside the fixing belt support 60 at each lateral end in the longitudinal direction thereof parallel to the axial direction AD of the fixing belt 21. In addition to the fixing belt support 60, the flange assembly 50B supports the nip formation pad 26, the outer bracket 70, the inner bracket 71, the reinforcement 23, and the heater 22*h* depicted in FIG. 20. The fixing belt 21 is rotatably wound around the outer circumferential surface of the fixing belt support 60. These components, that is, the fixing belt 21, the fixing belt support 60, the nip formation pad 26, the inner bracket 71, the outer bracket 70, the reinforcement 23, and the heater 22*h*, are assembled into a fixing belt unit 21U depicted in FIG. 20 detachably attached to the side plates 42 of the fixing device 20T depicted in FIG. 25.

As shown in FIG. 20, the fixing belt support 60 comes into contact with the fixing belt 21 at the heating portion 63, thus heating the fixing belt 21 effectively. Conversely, the fixing belt support 60 facilitates separation of the recording medium P from the fixing belt 21 at the separation portion 64. To attain these objectives, the fixing belt support 60 has the predetermined shape as described above with reference to FIGS. 20 and 23. However, since the fixing belt support 60 is manufactured by stamping a thin metal plate such as a stainless steel plate having a thickness of about 0.1 mm, it is difficult to attain the precise outer dimension for a plurality of fixing belt supports 60, causing variation in dimension among the plurality of fixing belt supports 60 that results in variation in performance among them. For example, if the maximum outer diameter D18 of about 30.86 mm depicted in FIG. 23 decreases for a predetermined amount or more, a part of the fixing belt support 60 that is disposed downstream from the fixing nip N in the rotation direction D2 of the fixing belt 21 is isolated from the fixing belt 21, destabilizing movement of the fixing belt 21. As a result, the recording medium P does not separate from the fixing belt 21 smoothly or the fixing belt 21 is partially lifted from the fixing belt support 60. Moreover, as the fixing belt 21 rotates and slides over the fixing belt support 60, the fixing belt support 60 vibrates unstably.

To address these problems, the flange assembly 50B supporting each lateral end of the fixing belt support 60 in the longitudinal direction thereof incorporates the tube 50*a* having the shape described below to stabilize the shape and movement of the fixing belt support 60 as the fixing belt 21 slides thereover and the shape of the fixing belt 21.

Referring to FIG. 26, the following describes a configuration of the flange assembly 50B incorporated in the fixing device 20T depicted in FIG. 20.

FIG. 26 is a perspective view of the flange assembly 50B. It is to be noted that although the flange assembly 50B incorporates the groove 50*m* and the slip ring 51 depicted in FIG. 11A, they are omitted in FIG. 26. As shown in FIG. 26, the flange assembly 50B includes the tube 50*a* inserted into the substantial loop formed by the fixing belt support 60 depicted in FIG. 20 at each lateral end of the fixing belt support 60 in the longitudinal direction thereof, retaining the shape of each lateral end of the fixing belt support 60; the flange 50*b* mounted on the side plate 42 of the fixing device 20T depicted in FIG. 25; and the collar 50*c* interposed between the tube 50*a* and the flange 50*b* and mounting the flange face 50*f* constituting a location face struck by an circumferential edge of the fixing belt support 60 during assembly and regulating skew of the fixing belt 21 as it rotates.

The tube 50*a* includes a notch 50*a*1, produced in a part thereof along the circumferential direction, which houses the nip formation pad 26 depicted in FIG. 20 and the recess 61 of the fixing belt support 60 depicted in FIG. 21. The flange 50*b* supports the nip formation pad 26 and the fastener 70*a* of the outer bracket 70 that retains the shape of the recess 61 of the fixing belt support 60 depicted in FIG. 21.

The tube 50*a* further includes a shape retention face 50*a*2 constituting a part of the outer circumferential surface of the tube 50*a*. The shape retention face 50*a*2 includes a region A contiguous to the notch 50*a*1 at an upstream edge of the notch 50*a*1 in the recording medium conveyance direction D4 corresponding to the entry to the fixing nip N. Thus, the shape retention face 50*a*2 retains the shape of the fixing belt support 60 at each lateral end of the fixing belt support 60 in the longitudinal direction thereof. The region A corresponds to the heating portion 63 of the fixing belt support 60 depicted in FIG. 20 and a heating portion 63' of the tube 50*a* described below. Thus, the shape retention face 50*a*2 of the tube 50*a* is disposed opposite the heating portion 63 of the fixing belt support 60. In other words, the shape retention face 50*a*2 constitutes a part of an outer circumferential face of the tube 50*a* that retains the arc shape of the heating portion 63 of the fixing belt support 60 at each lateral end of the fixing belt support 60 in the longitudinal direction thereof. A circumferential edge of the tube 50*a* in the longitudinal direction of the fixing belt support 60 is chamfered to facilitate insertion of the tube 50*a* into the fixing belt support 60 at each lateral end of the fixing belt support 60 in the longitudinal direction thereof.

The tube 50*a* mounts a guide 50*d* that projects from a part of the circumferential edge of the tube 50*a* in the axial direction AD of the fixing belt 21 toward a center of the fixing belt 21 in the axial direction AD thereof. Specifically, the guide 50*d* is tilted in such a manner that an inboard edge 50*d*1 of the guide 50*d* is directed toward a center of the tube 50*a* in a diametrical direction thereof. Thus, the guide 50*d* facilitates insertion of the tube 50*a* into the fixing belt support 60 at each lateral end of the fixing belt support 60 in the longitudinal direction thereof.

The guide 50*d* is situated in a region B, contiguous to the region A in the circumferential direction of the tube 50*a*, where the shape retention face 50*a*2 is not provided. The region B corresponds to at least the isolation portion 65 of the fixing belt support 60 depicted in FIG. 20. That is, the region B may correspond to a part of the separation portion 64 and the intermediate portion 66 in addition to the isolation portion 65 of the fixing belt support 60 depicted in FIG. 20. Accordingly, the guide 50*d* is disposed opposite at least the isolation portion 65 of the fixing belt support 60. For example, the guide 50*d* mounted on the circumferential edge of the tube 50*a* is disposed downstream from the fixing nip N in the rotation direction D2 of the fixing belt 21 and situated opposite the heater 22*h* via the reinforcement 23 depicted in FIG. 20.

As described above with reference to FIG. 20, the substantially tubular fixing belt support 60 is disposed inside the loop formed by the fixing belt 21 and heated by the heater 22*h*. As the inner circumferential surface of the fixing belt 21 slides over the outer circumferential surface of the fixing belt support 60, the fixing belt support 60 supports and heats the fixing belt 21. The tube 50*a* of the flange assembly 50B is inserted into the substantial loop formed by the substantially tubular fixing belt support 60 at each lateral end of the fixing belt support 60 in the longitudinal direction thereof. The shape retention face 50*a*2 constituting a part of the outer circumferential surface of the tube 50*a* contacts the heating portion 63 of the fixing belt support 60, retaining the shape of the fixing belt support 60 at each lateral end of the fixing belt support 60 in the longitudinal direction thereof.

The shape of at least the shape retention face 50*a*2 of the tube 50*a* is substantially identical to the shape of the inner circumferential surface of the heating portion 63 of the fixing belt support 60 where the fixing belt support 60 conducts heat from the heater 22*h* to the fixing belt 21. For example, the shape of at least the shape retention face 50*a*2 of the tube 50*a* is substantially identical to the shape and dimension of the inner circumferential surface of the fixing belt support 60, thus retaining the desired shape and dimension of the fixing belt support 60 as shown in FIG. 23.

Figure 27:
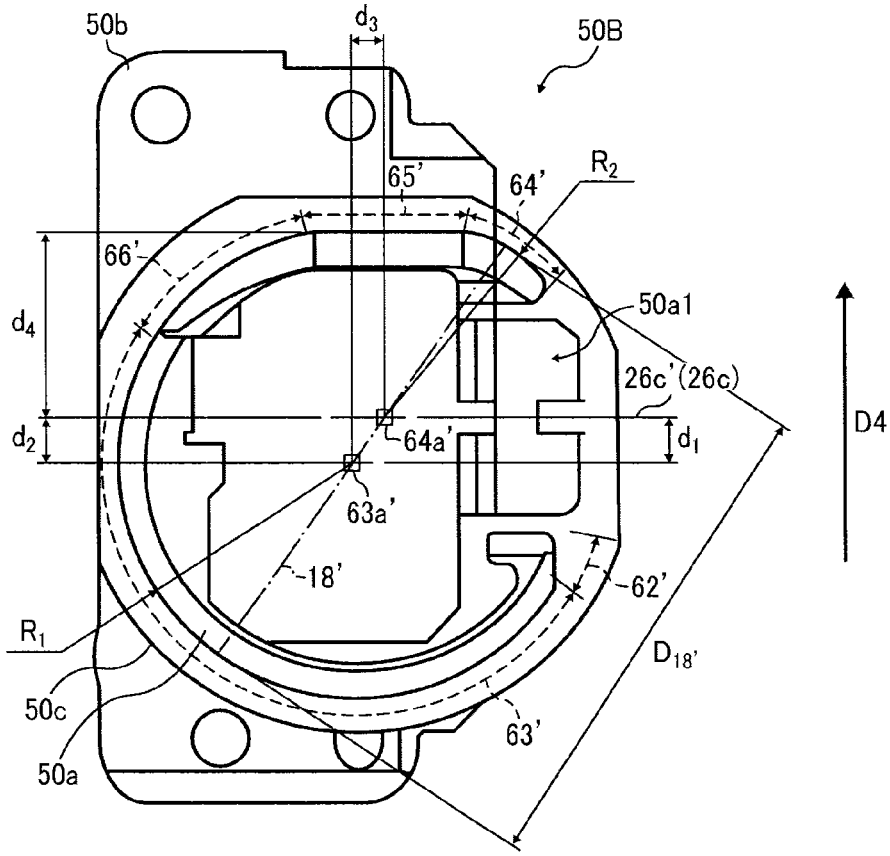
FIG. 27 is a vertical sectional view of the flange assembly shown in FIG. 26.

Referring to FIG. 27, a detailed description is now given of the shape of the flange assembly 50B.

FIG. 27 is a vertical sectional view of the flange assembly 50B. As shown in FIG. 27, the shape of an outer circumferential surface of the heating portion 63' of the tube 50*a* corresponding to the region A depicted in FIG. 26 where the heater 22*h* heats the fixing belt 21 via the fixing belt support 60 is an arch having a radius substantially identical to that of the inner circumferential surface of the fixing belt support 60. An arc axis 63*a'* of the arch is situated upstream from the center line 26*c* of the nip formation pad 26 in the recording medium conveyance direction D4.

The heating portion 63' of the tube 50*a* situated at the entry to the fixing nip N projects from the center line 26*c* outward in the diametrical direction of the tube 50*a* farther than a separation portion 64' of the tube 50*a* situated at an exit of the fixing nip N. A planar isolation portion 65' of the tube 50*a* is disposed downstream from the separation portion 64' in the rotation direction D2 of the fixing belt 21.

Referring to FIG. 27, a detailed description is now given of the shape of the outer circumferential surface of the tube 50*a* of the flange assembly 50B.

As shown in FIG. 27, the tube 50*a* includes the notch 50*a*1 disposed opposite the recess 61 depicted in FIG. 21 of the fixing belt support 60 and housing the nip formation pad 26; a nip entrance portion 62' contiguous to and disposed upstream from the notch 50*a*1 in the rotation direction D2 of the fixing belt 21; the heating portion 63' contiguous to and upstream from the nip entrance portion 62' in the rotation direction D2 of the fixing belt 21; the separation portion 64' contiguous to and disposed downstream from the notch 50*a*1 in the rotation direction D2 of the fixing belt 21; the planar isolation portion 65' contiguous to and disposed downstream from the separation portion 64' in the rotation direction D2 of the fixing belt 21; and an intermediate portion 66' contiguous to the isolation portion 65' and the heating portion 63' and disposed downstream from the isolation portion 65' in the rotation direction D2 of the fixing belt 21.

For example, the heating portion 63' is an arch having a radius R1 and originating from the upstream edge of the notch 50*a*1 in the rotation direction D2 of the fixing belt 21. The heating portion 63' of the tube 50*a* is disposed opposite the heating portion 63 of the fixing belt support 60 depicted in FIG. 20 that is heated by the heater 22*h*. The arc axis 63*a'* of the heating portion 63' is disposed at a distance d1 from a center line 26*c'* of the notch 50*a*1 in the recording medium conveyance direction D4 that is identical to the center line 26*c* of the nip formation pad 26 in the recording medium conveyance direction D4. Hence, the heating portion 63' of the tube 50*a* supports the heating portion 63 of the fixing belt support 60 at each lateral end of the fixing belt support 60 in the longitudinal direction thereof. For example, the radius R1 is about 14.3 mm; the distance d1 is about 2.7 mm.

The nip entrance portion 62' is disposed at a distance from the arc axis 63*a'* that is smaller than the radius R1. Specifically, the nip entrance portion 62' is substantially a plane having a decreased curvature that supports the nip entrance portion 62 of the fixing belt support 60 at each lateral end of the fixing belt support 60 in the longitudinal direction thereof.

The separation portion 64' is an arch having a radius R2 smaller than the radius R1 of the heating portion 63' and supporting the separation portion 64 of the fixing belt support 60. Specifically, the separation portion 64' of the tube 50*a* supports the separation portion 64 of the fixing belt support 60 situated at the exit of the fixing nip N in such a manner that the separation portion 64' neither deforms the separation portion 64 nor causes the separation portion 64 to press the fixing belt 21 against the pressing roller 31 depicted in FIG. 20. An arc axis 64*a'* of the separation portion 64' is disposed at a distance d2 downstream from the arc axis 63*a'* of the heating portion 63' in the recording medium conveyance direction D4 and at a distance d3 rightward in FIG. 27 toward the fixing nip N, that is, the notch 50*a*1, in a direction orthogonal to the recording medium conveyance direction D4. Accordingly, a maximum outer diameter D18', that is, a diameter 18' of the tube 50*a*, through the arc axis 63*a'* of the heating portion 63' and the arc axis 64*a'* of the separation portion 64' defines a maximum outer diameter of the tube 50*a*. For example, the maximum outer diameter D18' of about 30.46 mm of the tube 50*a* causes the maximum outer diameter D18 of the fixing belt support 60 depicted in FIG. 23 to be greater than the inner diameter of the fixing belt 21 of about 30.00 mm. In a state in which the nip formation pad 26 is assembled into the recess 61 of the fixing belt support 60, the outer circumferential length L1 of the fixing belt support 60 is smaller than the inner circumferential length L2 of the fixing belt 21 by about 0.7 mm. For example, the radius R2 is about 12.8 mm; the distance d2 is about 2.7 mm; the distance d3 is about 2.0 mm; and the maximum outer diameter D18' is about 30.46 mm.

The intermediate portion 66' is an arch having an arc axis identical to the arc axis 63*a'* of the heating portion 63' and a radius identical to the radius R1 of the heating portion 63'.

The isolation portion 65' is a plane situated at a distance d4 downstream from the arc axis 64*a'* of the separation portion 64' in the recording medium conveyance direction D4 and interposed between the separation portion 64' and the intermediate portion 66' in the rotation direction D2 of the fixing belt 21. Thus, the isolation portion 65' of the tube 50*a* supports the isolation portion 65 of the fixing belt support 60 in such a manner that the isolation portion 65 of the fixing belt support 60 is isolated from the fixing belt 21 at each lateral end of the fixing belt support 60 in the longitudinal direction thereof as shown in FIG. 20. For example, the distance d4 is about 11.3 mm.

Figure 28:
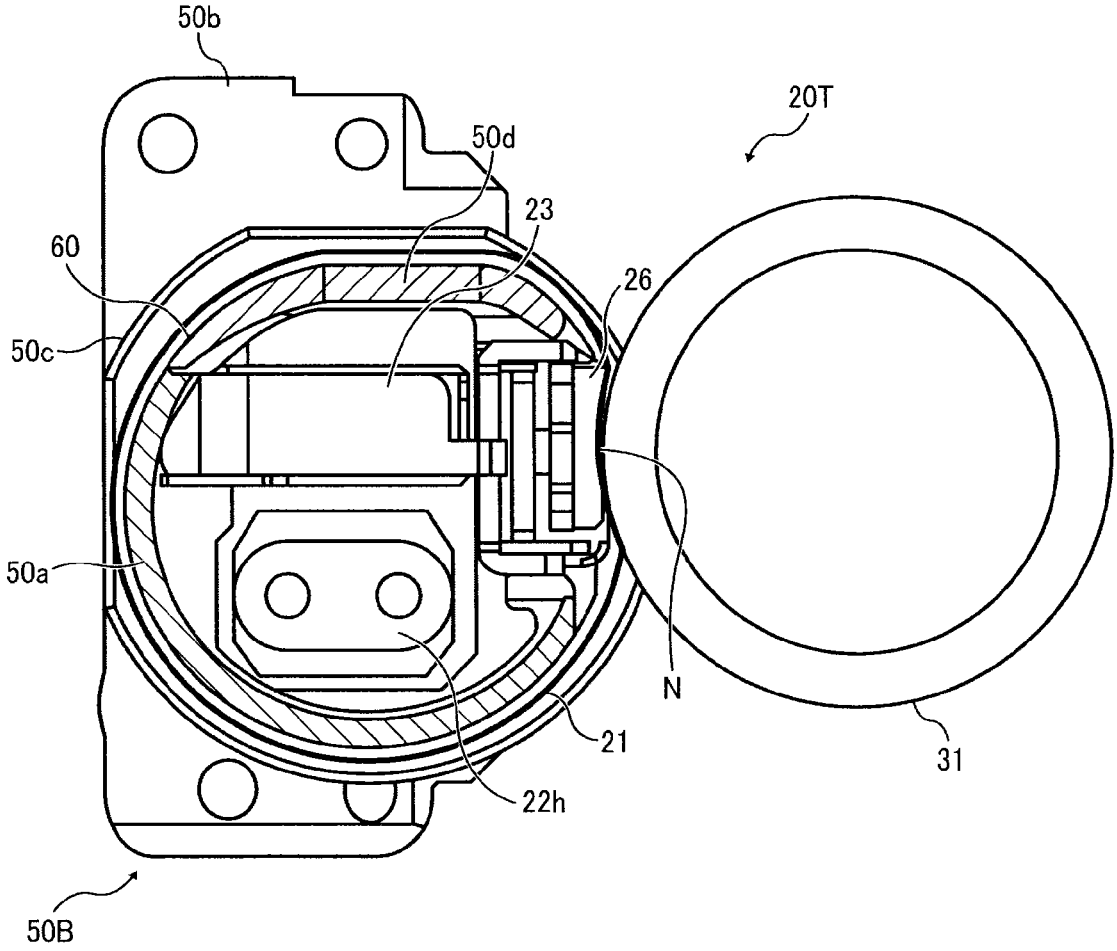
FIG. 28 is a vertical sectional view of the fixing device shown in FIG. 20 in a state in which the flange assembly is inserted into the fixing belt support.

FIG. 28 is a vertical sectional view of the fixing device 20T in a state in which the flange assembly 50B is inserted into the fixing belt support 60. As shown in FIGS. 27 and 28, the tube 50*a* of the flange assembly 50B includes the nip entrance portion 62', the heating portion 63', the separation portion 64', the isolation portion 65', and the intermediate portion 66', each of which has the predetermined shape described above that constitutes the outer circumferential surface of the tube 50*a*. Accordingly, the tube 50*a* contacts and supports the fixing belt support 60 in such a manner that the fixing belt support 60 retains the predetermined shape of the fixing belt 21 at each lateral end of the fixing belt 21 in the axial direction AD thereof, thus facilitating separation of a recording medium P, especially a wide recording medium P, from the fixing belt 21. The flange assembly 50B does not degrade retention of the shape of the fixing belt support 60, retaining the shape of the fixing belt support 60 and stabilizing behavior of the fixing belt support 60 as the fixing belt 21 is driven and rotated.

Since the flange assembly 50B is configured to contact and support each lateral end of the fixing belt support 60 in the longitudinal direction thereof, thus retaining the shape of the fixing belt support 60 at each lateral end of the fixing belt support 60 in the longitudinal direction thereof, the flange assembly 50B does not retain the shape of a center of the fixing belt support 60 in the longitudinal direction thereof. However, the flange assembly 50B that retains the desired shape of the fixing belt support 60 at each lateral end of the fixing belt support 60 in the longitudinal direction thereof attains at least three advantages below.

The first advantage is to facilitate separation of a wide recording medium P conveyed through both lateral ends of the fixing belt 21 in the axial direction AD thereof from the fixing belt 21. For example, the maximum outer diameter D18 of the fixing belt support 60 is about 30.86 mm. However, if the maximum outer diameter D18 of the fixing belt support 60 is smaller than a predetermined range, the fixing belt 21 is not stretched over the fixing belt support 60 and goes slack. Specifically, the fixing belt 21 is slackened at a position downstream from the fixing nip N in the rotation direction D2 of the fixing belt 21, increasing its curvature. Accordingly, the recording medium P does not separate from the fixing belt 21 easily. To address this problem, the fixing belt support 60 needs to retain the desired shape that allows the fixing belt 21 to be stretched over the fixing belt support 60 properly. The recording medium P has side margins in a width direction thereof orthogonal to the recording medium conveyance direction D4 where no toner image T is formed and therefore no toner is adhered. Since the side margins of the recording medium P bearing no toner readily separate from the fixing belt 21, the flange assembly 50B that retains at least the desired shape of the fixing belt support 60 at each lateral end of the fixing belt support 60 in the longitudinal direction thereof enhances separation of the recording medium P from the fixing belt 21 at each lateral end of the fixing belt 21 in the axial direction AD thereof, thus facilitating separation of the entire recording medium P from the fixing belt 21. The flange assembly 50B attains the first advantage described above significantly for the wide recording medium P, the side margins of which pass over both lateral ends of the fixing belt support 60 in the longitudinal direction thereof via the fixing belt 21.

The second advantage is to regulate behavior of the fixing belt support 60 when the fixing belt 21 is driven and rotated. Since the fixing belt 21 is driven and rotated by the pressing roller 31 that presses against the fixing belt 21 at the fixing nip N, the fixing belt 21 is pulled by the pressing roller 31 at a position upstream from the fixing nip N and is slackened at a position downstream from the fixing nip N in the rotation direction D2 of the fixing belt 21. Accordingly, the fixing belt 21 sliding over the fixing belt support 60 exerts pressure to the fixing belt support 60 constantly at the position upstream from the fixing nip N in the rotation direction D2 of the fixing belt 21, destabilizing behavior, that is, the shape and position, of the fixing belt support 60. To address this problem, the flange assembly 50B retains the shape and position of the fixing belt support 60 at the position upstream from the fixing nip N in the rotation direction D2 of the fixing belt 21, thus stabilizing the shape and position of the fixing belt support 60.

The third advantage is to regulate lifting of the fixing belt 21 from each lateral end of the fixing belt support 60 in the longitudinal direction thereof. The fixing belt 21 may lift from the fixing belt support 60 more easily at both lateral ends than at the center of the fixing belt support 60 in the longitudinal direction thereof. This is because it takes some time to uniformly heat the entire fixing belt support 60 made of a thin metal plate. Specifically, before the fixing belt support 60 is uniformly heated, an amount of thermal expansion varies in the longitudinal direction of the fixing belt support 60. Since the flange assembly 50B regulates behavior of the fixing belt support 60 at each lateral end of the fixing belt support 60 in the longitudinal direction thereof, the center of the fixing belt support 60 expands and warps outward more than both lateral ends of the fixing belt support 60 in the longitudinal direction thereof. Especially, the center of the fixing belt support 60 in the longitudinal direction thereof expands and warps substantially in the heating portion 63 thereof where the heater 22*h* heats the fixing belt support 60. Accordingly, the warped center of the fixing belt support 60 adheres to the fixing belt 21.

By contrast, each lateral end of the fixing belt support 60 in the longitudinal direction thereof regulated by the flange assembly 50B does not warp. Accordingly, the warped center of the fixing belt support 60 that presses against the center of the fixing belt 21 in the axial direction AD thereof lifts each lateral end of the fixing belt 21 in the axial direction AD thereof. To address this circumstance, the flange assembly 50B retains the shape of the fixing belt support 60 at each lateral end of the fixing belt support 60 in the longitudinal direction thereof, stabilizing behavior of the fixing belt support 60 and thereby regulating lifting of the fixing belt 21 from each lateral end of the fixing belt support 60 in the longitudinal direction thereof.

Figure 29B:
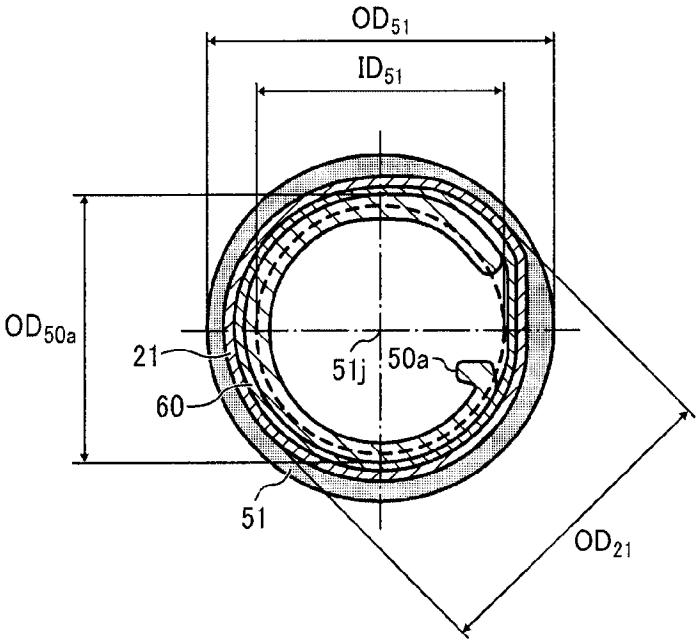
FIG. 29B is a vertical sectional view of the fixing belt support, the fixing belt, the tube, and the slip ring incorporated in the fixing device shown in FIG. 29A.
Figure 29A:
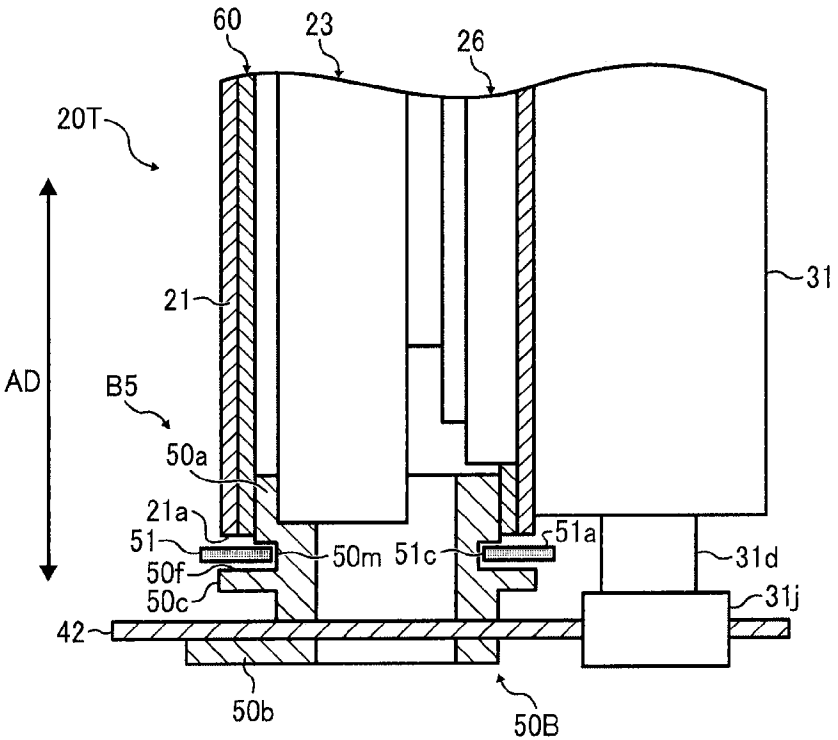
FIG. 29A is a partial horizontal sectional view of the fixing device shown in FIG. 20.

Referring to FIGS. 29A and 29B, the following describes a construction of the flange assembly 50B and its peripherals incorporated in the fixing device 20T depicted in FIG. 20.

FIG. 29A is a partial horizontal sectional view of the fixing device 20T incorporating a belt device B5 including the fixing belt 21 and the flange assembly 50B. FIG. 29B is a vertical sectional view of the slip ring 51, the fixing belt 21, the fixing belt support 60, and the tube 50*a* of the flange assembly 50B. As shown in FIG. 29A, the flange assembly 50B is situated at one lateral end of the fixing belt 21 in the axial direction AD thereof. Although not shown, another flange assembly 50B is situated at another lateral end of the fixing belt 21 in the axial direction AD thereof. The flange assembly 50B incorporated in the fixing device 20T shown in FIGS. 29A and 29B is designed based on a concept similar to that of the flange assemblies 50A, 50A1, 50A2, and 50A3 depicted FIGS. 11A, 12, 13, and 15A, respectively. As illustrated in FIG. 29A, the fixing device 20T includes the rotatable, endless fixing belt 21; the pressing roller 31 disposed outside the loop formed by the fixing belt 21 and pressed against the fixing belt 21; the nip formation pad 26 disposed inside the loop formed by the fixing belt 21 and pressed by the pressing roller 31 to form the fixing nip N between the pressing roller 31 and the fixing belt 21 through which a recording medium P bearing a toner image T is conveyed; the substantially tubular, fixing belt support 60 disposed inside the loop formed by the fixing belt 21 and rotatably supporting the fixing belt 21; the heater 22*h* (depicted in FIG. 20) disposed inside the loop formed by the fixing belt support 60 to heat the fixing belt 21 via the fixing belt support 60; the reinforcement 23 disposed inside the loop formed by the fixing belt support 60 and supporting the nip formation pad 26; the flange assembly 50B disposed at each lateral end of the fixing device 20T in the longitudinal direction thereof, that is, at each lateral end of the fixing belt 21 in the axial direction AD thereof; and the side plates 42 (e.g., frames), each of which supports the flange assembly 50B. The flange assembly 50B includes the flange 50*b* mounted on the side plate 42, that is, a frame of the fixing device 20T; the collar 50*c* mounting the flange face 50*f*; and the tube 50*a* projecting from the flange face 50*f* and inserted into the loop formed by the fixing belt support 60 at each lateral end of the fixing belt support 60 in the longitudinal direction thereof, thus rotatably supporting the fixing belt 21 indirectly via the fixing belt support 60. The groove 50*m* is created on the outer circumferential surface of the tube 50*a* along the circumferential direction thereof. The slip ring 51 is a doughnut having the through-hole 51*c* rotatably contacting the groove 50*m* and the inner disk face 51*a* separatably contacted by the circumferential edge 21*a* of the fixing belt 21. As shown in FIG. 29B, the diameters of the slip ring 51, the tube 50*a*, and the fixing belt 21 through the rotation axis 51*j* of the slip ring 51 satisfy the formula (2) above. It is to be noted that although satisfying the identical formula (2), the fixing belt 21 supported by the flange assembly 50A depicted in FIG. 11A creates a circular track; the fixing belt 21 supported by the flange assembly 50B depicted in FIG. 29A creates a non-circular track, for example, an elliptical track.

As shown in FIG. 29B, the inner diameter ID51 defines the inner diameter of the slip ring 51; a minimum outer diameter OD50*a* defines the minimum outer diameter of the tube 50*a*, that is, the smallest outer dimension of the tube 50*a*; the maximum outer diameter OD21 defines the maximum outer diameter of the fixing belt 21, that is, the greatest outer dimension of a non-circular track, for example, an elliptical track, of the rotating fixing belt 21; and the outer diameter OD51 defines the outer diameter of the slip ring 51. The size of the diameters defined above has the relation shown by the formula (2) above.

Figure 30:
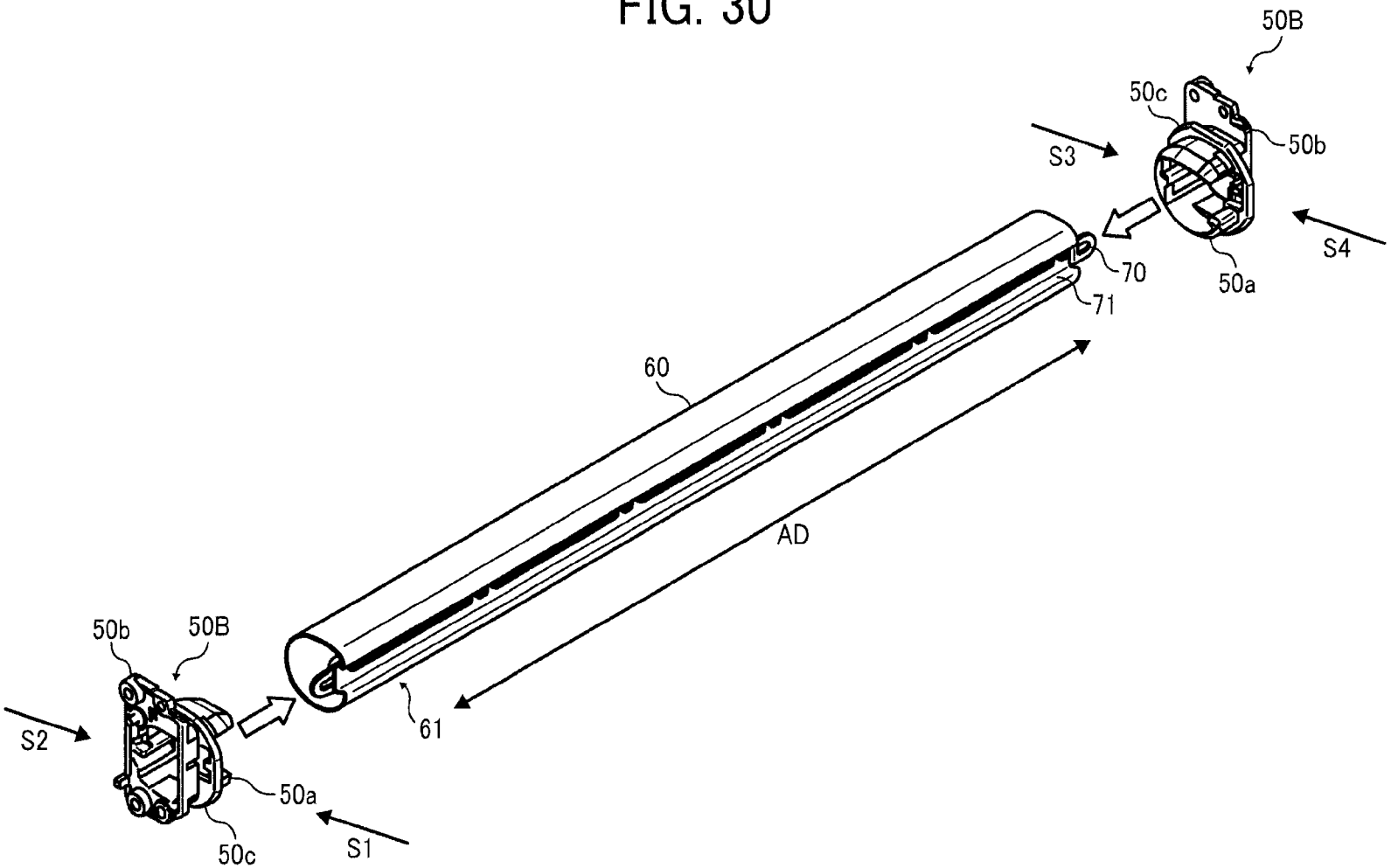
FIG. 30 is a perspective view of the flange assembly and the fixing belt support incorporated in the fixing device shown in FIG. 29A.

Referring to FIGS. 20, 29A, and 30, the following describes assembly of the fixing belt unit 21U depicted in FIG. 20.

FIG. 30 is a perspective view of the flange assembly 50B and the fixing belt support 60.

In a first step, as shown in FIG. 30, the right tube 50*a* of the flange assembly 50B is inserted into the loop formed by the fixing belt support 60 at one lateral end, that is, the right end in FIG. 30, of the fixing belt support 60 in the longitudinal direction thereof parallel to the axial direction AD of the fixing belt 21, which is attached with the outer bracket 70 and the inner bracket 71 until the slip ring 51 attached to the tube 50*a* depicted in FIG. 29A comes into contact with the one lateral end of the fixing belt support 60.

In a second step, as shown in FIG. 20, the fixing belt 21 is attached to the outer circumferential surface of the fixing belt support 60. Simultaneously, the nip formation pad 26 is inserted into the recess 61 depicted in FIG. 30 of the fixing belt support 60 until an edge of the nip formation pad 26 comes into contact with a predetermined position on the flange 50*b*. The reinforcement 23 and the heater 22*h* are inserted into the loop formed by the fixing belt support 60 until an edge of each of the reinforcement 23 and the heater 22*h* comes into contact with a predetermined position on the flange 50*b* as shown in FIG. 29A.

In a third step, as shown in FIG. 30, the left tube 50*a* is inserted into the loop formed by the fixing belt support 60 at another lateral end, that is, the left end in FIG. 30, of the fixing belt support 60 in the longitudinal direction thereof until the slip ring 51 attached to the tube 50*a* comes into contact with the another lateral end of the fixing belt support 60. Thus, assembly of the fixing belt unit 21U is completed.

Figure 31A:
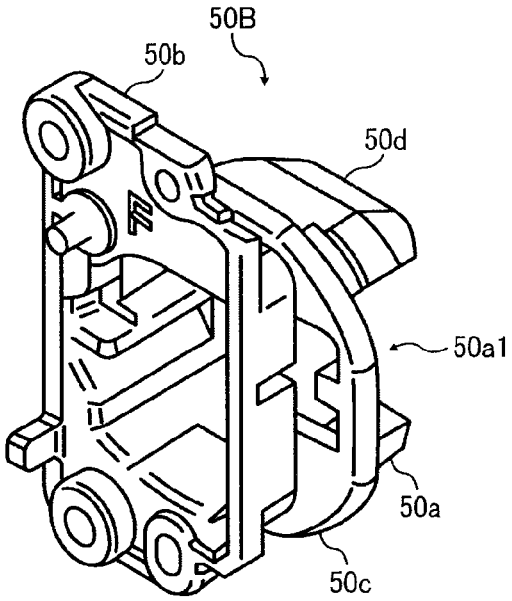
FIG. 31A is a perspective view of the flange assembly attached to the left end of the fixing belt support in FIG. 30 seen from a direction S1.
Figure 31B:
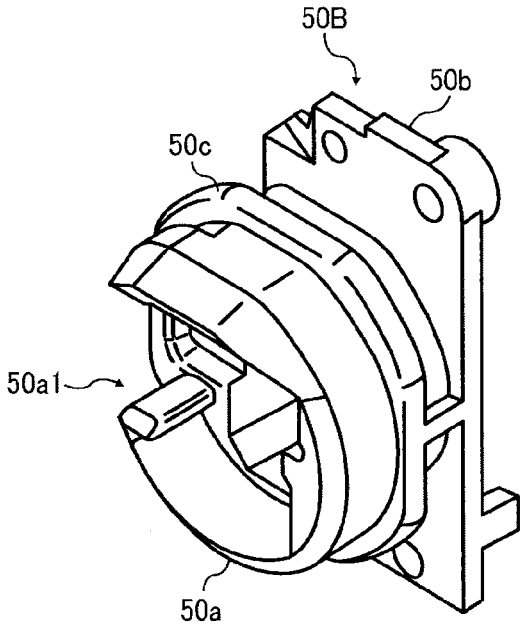
FIG. 31B is a perspective view of the flange assembly attached to the left end of the fixing belt support in FIG. 30 seen from a direction S2.
Figure 31C:
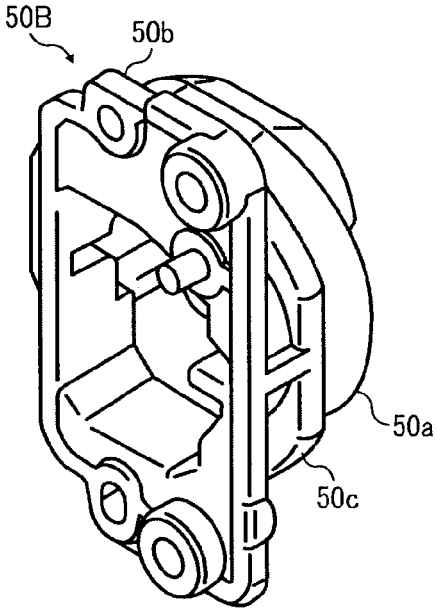
FIG. 31C is a perspective view of the flange assembly attached to the right end of the fixing belt support in FIG. 30 seen from a direction S3.
Figure 31D:
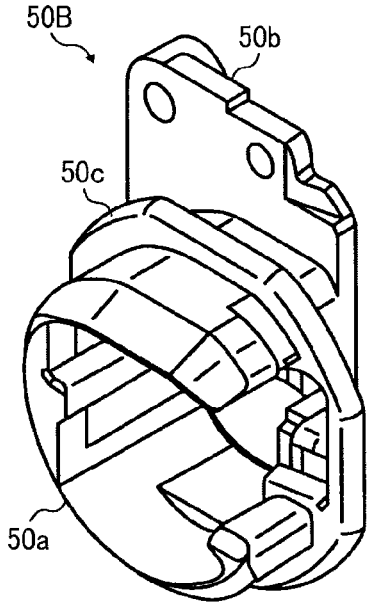
FIG. 31D is a perspective view of the flange assembly attached to the right end of the fixing belt support in FIG. 30 seen from a direction S4.

Since the two flange assemblies 50B are attached to both lateral ends of the fixing belt support 60 in the longitudinal direction thereof, respectively, as described above, the two flange assemblies 50B have the identical size and are symmetric with respect to the fixing belt support 60 interposed between the two flange assemblies 50B in the axial direction AD of the fixing belt 21 as shown in FIGS. 31A, 31B, 31C, and 31D. FIG. 31A is a perspective view of the flange assembly 50B attached to the left end of the fixing belt support 60 in FIG. 30 seen from a direction S1. FIG. 31B is a perspective view of the flange assembly 50B attached to the left end of the fixing belt support 60 in FIG. 30 seen from a direction S2. FIG. 31C is a perspective view of the flange assembly 50B attached to the right end of the fixing belt support 60 in FIG. 30 seen from a direction S3. FIG. 31D is a perspective view of the flange assembly 50B attached to the right end of the fixing belt support 60 in FIG. 30 seen from a direction S4.

Thereafter, the two flange assemblies 50B are mounted on the two side plates 42 depicted in FIG. 25, respectively, in such a manner that each flange 50*b* is mounted on each side plate 42, thus completing installation of the fixing belt unit 21U in the fixing device 20T.

With the above-described configuration of the flange assembly 50B shown in FIGS. 29A and 29B, as the fixing belt 21 rotates in accordance with rotation of the pressing roller 31, the fixing belt 21 may be skewed toward one of both lateral ends in the axial direction AD thereof. However, the diameters of the tube 50*a*, the fixing belt 21, and the slip ring 51 through the rotation axis 51*j* of the slip ring 51 have the relation defined by the formula (2) above, bringing the circumferential edge 21*a* of the fixing belt 21 into contact with the inner disk face 51*a* of the slip ring 51 and thus preventing the circumferential edge 21*a* of the fixing belt 21 from wearing the flange face 50*f* of the flange 50*b* of the flange assembly 50B. Specifically, the inner diameter ID51 of the slip ring 51 is smaller than the minimum outer diameter OD50*a* of the tube 50*a*; the minimum outer diameter OD50*a* of the tube 50*a* is smaller than the maximum outer diameter OD21 of the track of the rotating fixing belt 21; the maximum outer diameter OD21 of the track of the rotating fixing belt 21 is smaller than the outer diameter OD51 of the slip ring 51.

As the circumferential edge 21*a* of the fixing belt 21 comes into contact with the slip ring 51, the fixing belt 21 and the slip ring 51 rotate in a state in which the fixing belt 21 presses the slip ring 51 against the flange face 50*f* of the flange 50*b*. Accordingly, the slip ring 51 slides over the flange face 50*f* of the flange 50*b*, scraping particles off the slip ring 51. To address this circumstance, the groove 50*m* is created on the tube 50*a* of the flange assembly 50B and the inner diameter ID51 of the slip ring 51 that is equivalent to the diameter of the bottom of the groove 50*m* is smaller than the minimum outer diameter OD50*a* of the tube 50*a* of the flange assembly 50B. Hence, even if particles scraped off the slip ring 51 enter the through-hole 51*c* of the slip ring 51, the outer circumferential surface of the tube 50*a* constitutes a step from the bottom of the groove 50*m* that prohibits the scraped particles from moving to the gap between the inner circumferential surface of the fixing belt 21 and the outer circumferential surface of the fixing belt support 60 and between the inner circumferential surface of the fixing belt support 60 and the outer circumferential surface of the tube 50*a*. That is, the step from the bottom of the groove 50*m* drops the particles scraped off the slip ring 51 onto a place isolated from the fixing belt 21, thus minimizing increase of the rotation torque of the fixing belt 21. It is to be noted that the configurations depicted in FIGS. 12 to 15B are also applicable to the fixing device 20T.

Figure 32:
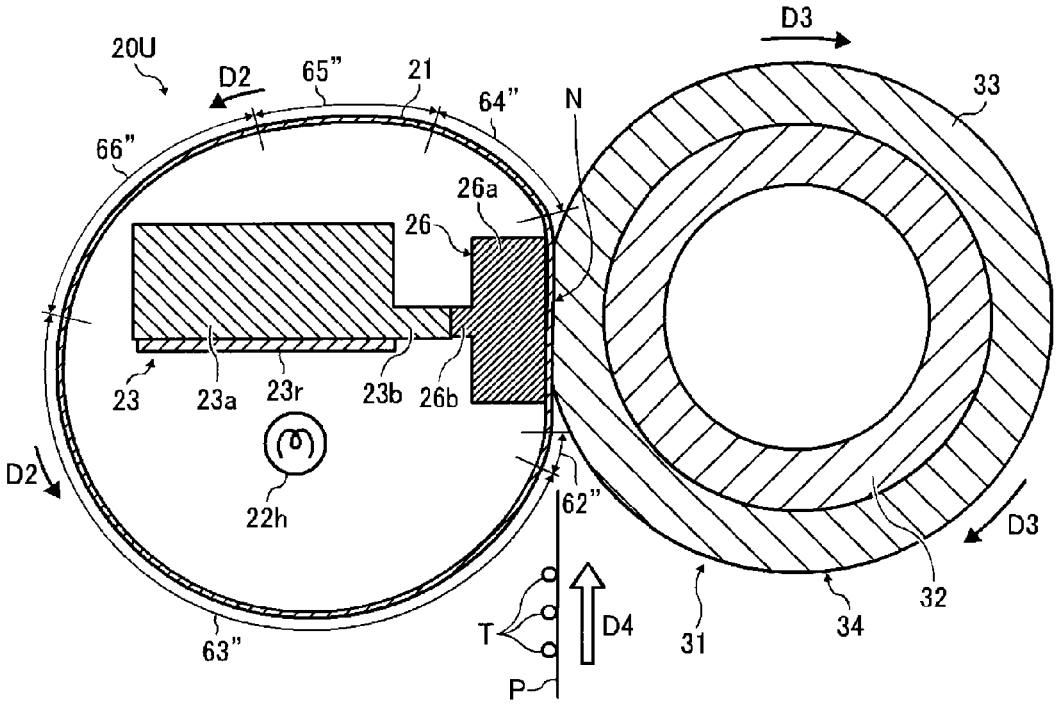
FIG. 32 is a vertical sectional view of a fixing device according to a fourth exemplary embodiment.
Figure 33B:
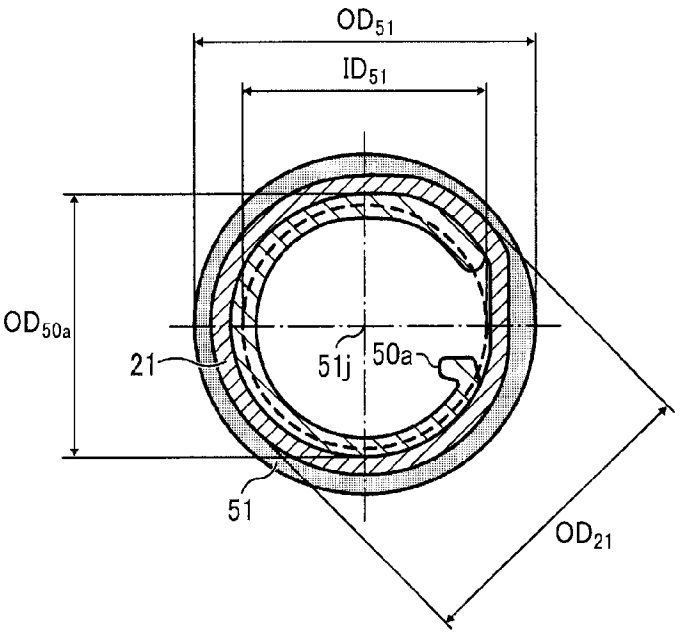
FIG. 33B is a vertical sectional view of the fixing belt, the tube, and the slip ring incorporated in the fixing device shown in FIG. 33A.
Figure 33A:
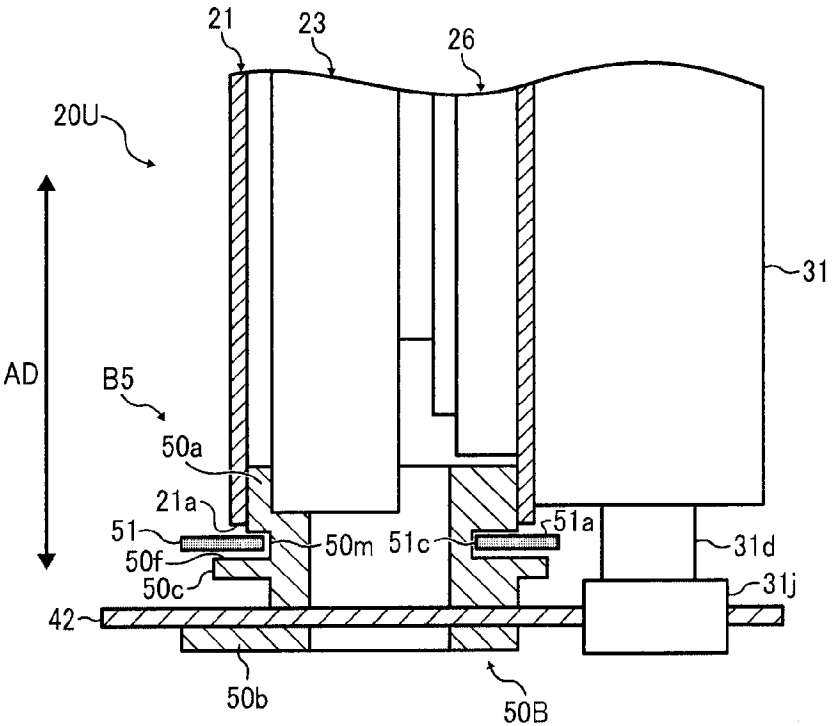
FIG. 33A is a partial horizontal sectional view of the fixing device shown in FIG. 32.

Referring to FIGS. 32, 33A, and 33B, the following describes a configuration of a fixing device 20U according to a fourth exemplary embodiment.

FIG. 32 is a vertical sectional view of the fixing device 20U. FIG. 33A is a partial horizontal sectional view of the fixing device 20U incorporating the belt device B5 including the fixing belt 21 and the flange assembly 50B. FIG. 33B is a vertical sectional view of the fixing belt 21, the tube 50*a*, and the slip ring 51. As shown in FIG. 33A, the flange assembly 50B is situated at one lateral end of the fixing belt 21 in the axial direction AD thereof. Although not shown, another flange assembly 50B is situated at another lateral end of the fixing belt 21 in the axial direction AD thereof. As shown in FIG. 32, unlike the fixing device 20T depicted in FIG. 20, the fixing device 20U does not incorporate the fixing belt support 60. Instead, as shown in FIG. 33A, the tube 50*a* of the flange assembly 50B is inserted into the loop formed by the fixing belt 21 at each lateral end of the fixing belt 21 in the axial direction AD thereof, thus contacting and supporting the fixing belt 21 directly. Since the fixing belt support 60 is not provided inside the fixing belt 21, the heater 22*h* disposed inside the fixing belt 21 heats the fixing belt 21 directly.

The tube 50*a* of the flange assembly 50B directly contacts and supports the fixing belt 21 at each lateral end of the fixing belt 21 in the axial direction AD thereof, thus retaining the shape of the fixing belt 21 at least at each lateral end of the fixing belt 21 in the axial direction thereof.

A detailed description is now given of the shape of the outer circumferential surface of the tube 50*a* of the flange assembly 50B installed in the fixing device 20U without the fixing belt support 60.

The shape of at least the shape retention face 50*a*2 depicted in FIG. 26 of the tube 50*a* that is disposed opposite a heating portion 63" depicted in FIG. 32 of the fixing belt 21 heated by the heater 22*h* is substantially identical to the shape of an inner circumferential surface of the heating portion 63" of the fixing belt 21 depicted in FIG. 32. For example, the shape of at least the shape retention face 50*a*2 of the tube 50*a* is substantially identical to the shape and dimension of the inner circumferential surface of the fixing belt 21 depicted in FIG. 32, thus retaining the desired shape and dimension of the fixing belt 21 as shown in FIG. 33B.

For example, as shown in FIG. 33B, the shape retention face 50*a*2, that is, the outer circumferential surface of the heating portion 63' of the tube 50*a* in the region A depicted in FIG. 26 where the heater 22*h* heats the fixing belt 21 is an arch having a radius substantially identical to that of the inner circumferential surface of the fixing belt 21. An arc axis of the arch is situated upstream from the center line 26*c* depicted in FIG. 23 of the nip formation pad 26 in the recording medium conveyance direction D4.

As shown in FIG. 27, the heating portion 63' of the tube 50*a* situated at the entry to the fixing nip N and disposed opposite the heating portion 63" of the fixing belt 21 depicted in FIG. 32 projects from the center line 26*c* outward in the diametrical direction of the tube 50*a* farther than the separation portion 64' of the tube 50*a* situated at the exit of the fixing nip N and disposed opposite a separation portion 64" of the fixing belt 21.

The planar isolation portion 65' of the tube 50*a* depicted in FIG. 27 is disposed downstream from the separation portion 64' in the rotation direction D2 of the fixing belt 21 and disposed opposite an isolation portion 65" of the fixing belt 21 depicted in FIG. 32. The intermediate portion 66' of the tube 50*a* depicted in FIG. 27 is disposed opposite an intermediate portion 66" of the fixing belt 21 depicted in FIG. 32. The nip entrance portion 62' of the tube 50*a* depicted in FIG. 27 is disposed opposite a nip entrance portion 62" of the fixing belt 21 depicted in FIG. 32.

For example, the tube 50*a* of the flange assembly 50B has the shape shown in FIG. 27 defined by the dimensions below. The radius R1 of the heating portion 63' of the tube 50*a* from the arc axis 63*a*' is about 14.5 mm. The radius R2 of the separation portion 64' of the tube 50*a* from the arc axis 64*a*' is about 13.0 mm. The distance d1 between the center line 26*c* of the nip formation pad 26 and the arc axis 63*a*' of the heating portion 63' of the tube 50*a* in the recording medium conveyance direction D4 is about 3.4 mm.

The distance d2 between the arc axis 63*a*' of the heating portion 63' and the arc axis 64*a*' of the separation portion 64' of the tube 50*a* in the recording medium conveyance direction D4 is about 2.7 mm. The distance d3 between the arc axis 63*a*' of the heating portion 63' and the arc axis 64*a*' of the separation portion 64' of the tube 50*a* in the direction orthogonal to the recording medium conveyance direction D4 is about 2.0 mm. The distance d4 between the isolation portion 65' and the arc axis 64*a*' of the separation portion 64' of the tube 50*a* in the recording medium conveyance direction D4 is about 11.5 mm. The maximum outer diameter D18' of the tube 50*a* through the arc axis 63*a*' of the heating portion 63' and the arc axis 64*a*' of the separation portion 64' is about 30.86 mm.

As described above, the outer circumferential surface of the tube 50*a* of the flange assembly 50B has the predetermined shape, retaining the shape of the fixing belt 21 at each lateral end of the fixing belt 21 in the axial direction AD thereof by contacting the fixing belt 21 directly and thereby facilitating separation of the recording medium P, especially the wide recording medium P, from the fixing belt 21. Since the fixing device 20U does not incorporate the fixing belt support 60 depicted in FIG. 20, the fixing device 20U attains the first advantage of the flange assembly 50B described above.

The flange assembly 50B attains the advantages described above if it is installed in a wide fixing device through which an A3 size recording medium P is conveyed in a portrait direction. Also, the flange assembly 50B attains the advantages described above if it is installed in a narrow fixing device through which an A4 size recording medium P is conveyed in the portrait direction. With the narrow fixing device, the flange assembly 50B retains the shape of the fixing belt 21 at the center as well as each lateral end of the fixing belt 21 in the axial direction AD thereof.

A detailed description is now given of a construction of peripheral components of the flange assembly 50B.

As shown in FIG. 33A, unlike the configuration of the fixing device 20T depicted in FIG. 29A, the fixing device 20U does not incorporate the fixing belt support 60 and therefore the tube 50*a* of the flange assembly 50B contacts and supports the fixing belt 21 directly. The other configuration of the fixing device 20U is equivalent to that of the fixing device 20T. As illustrated in FIG. 33A, the fixing device 20U includes the rotatable, endless fixing belt 21; the pressing roller 31 disposed outside the loop formed by the fixing belt 21 and pressed against the fixing belt 21; the nip formation pad 26 disposed inside the loop formed by the fixing belt 21 and pressed by the pressing roller 31 to form the fixing nip N between the pressing roller 31 and the fixing belt 21 through which a recording medium P bearing a toner image T is conveyed; the heater 22*h* (depicted in FIG. 32) disposed inside the loop formed by the fixing belt 21 to heat the fixing belt 21; the reinforcement 23 disposed inside the loop formed by the fixing belt 21 and supporting the nip formation pad 26; the flange assembly 50B disposed at each lateral end of the fixing device 20U in a longitudinal direction thereof; and the side plates 42 (e.g., frames), each of which supports the flange assembly 50B. The flange assembly 50B includes the flange 50*b* mounted on the side plate 42, that is, a frame of the fixing device 20U; the collar 50*c* mounting the flange face 50*f*; and the tube 50*a* projecting from the flange face 50*f* and inserted into the loop formed by the fixing belt 21 at each lateral end of the fixing belt 21 in the axial direction AD thereof, thus rotatably supporting the fixing belt 21. The groove 50*m* is created on the outer circumferential surface of the tube 50*a* along the circumferential direction thereof. The slip ring 51 is a doughnut having the through-hole 51*c* slidably contacting the groove 50*m* and the inner disk face 51*a* separatably contacted by the circumferential edge 21*a* of the fixing belt 21. As shown in FIG. 33B, the diameters of the slip ring 51, the tube 50*a*, and the fixing belt 21 through the rotation axis 51*j* of the slip ring 51 satisfy the formula (2) above.

As shown in FIG. 33B, the inner diameter ID51 defines the inner diameter of the slip ring 51; the minimum outer diameter OD50*a* defines the minimum outer diameter of the tube 50*a*, that is, the smallest outer dimension of the tube 50*a*; the maximum outer diameter OD21 defines the maximum outer diameter of the fixing belt 21, that is, the greatest outer dimension of a non-circular track, for example, an elliptical track, of the rotating fixing belt 21; and the outer diameter OD51 defines the outer diameter of the slip ring 51. The size of the diameters defined above has the relation shown by the formula (2) above.

With the above-described configuration of the flange assembly 50B shown in FIGS. 33A and 33B, as the fixing belt 21 rotates in accordance with rotation of the pressing roller 31, the fixing belt 21 may be skewed toward one of both lateral ends of the fixing belt 21 in the axial direction AD thereof. However, the diameters of the tube 50*a*, the fixing belt 21, and the slip ring 51 through the rotation axis 51*j* of the slip ring 51 have the relation defined by the formula (2) above, bringing the circumferential edge 21*a* of the fixing belt 21 into contact with the inner disk face 51*a* of the slip ring 51 and thus preventing the circumferential edge 21*a* of the fixing belt 21 from wearing the flange face 50*f* of the flange 50*b* of the flange assembly 50B. Specifically, the inner diameter ID51 of the slip ring 51 is smaller than the minimum outer diameter OD50*a* of the tube 50*a*; the minimum outer diameter OD50*a* of the tube 50*a* is smaller than the maximum outer diameter OD21 of the track of the rotating fixing belt 21; the maximum outer diameter OD21 of the track of the rotating fixing belt 21 is smaller than the outer diameter OD51 of the slip ring 51.

As the circumferential edge 21*a* of the fixing belt 21 comes into contact with the slip ring 51, the fixing belt 21 and the slip ring 51 rotate in a state in which the fixing belt 21 presses the slip ring 51 against the flange face 50*f* of the flange 50*b*. Accordingly, the slip ring 51 slides over the flange face 50*f* of the flange 50*b*, scraping particles off the slip ring 51. To address this circumstance, the groove 50*m* is created on the tube 50*a* of the flange assembly 50B and the inner diameter ID51 of the slip ring 51 that is equivalent to the diameter of the bottom of the groove 50*m* is smaller than the minimum outer diameter OD50*a* of the tube 50*a* of the flange assembly 50B. Hence, even if particles scraped off the slip ring 51 enter the through-hole 51*c* of the slip ring 51, the outer circumferential surface of the tube 50*a* constitutes a step from the bottom of the groove 50*m*, which prohibits the scraped particles from moving to the gap between the inner circumferential surface of the fixing belt 21 and the outer circumferential surface of the tube 50*a*. That is, the step from the bottom of the groove 50*m* drops the particles scraped off the slip ring 51 onto a place isolated from the fixing belt 21, thus minimizing increase of the rotation torque of the fixing belt 21. It is to be noted that the configurations depicted in FIGS. 12 to 15B are also applicable to the fixing device 20U.

The fixing devices 20, 20S, 20T, and 20U depicted in FIGS. 2, 16, 20, and 32, respectively, are installable in the image forming apparatus 1 depicted in FIG. 1, shortening the warm-up time and the first print time and thereby saving energy. Even if various types of recording media P are conveyed through the image forming apparatus 1 at increased speed, the image forming apparatus 1 forms a high quality toner image T on the recording medium P without fixing failure. Additionally, the image forming apparatus 1 performs image forming operation for an extended period of time stably.

The present invention is not limited to the details of the exemplary embodiments described above, and various modifications and improvements are possible. For example, according to the exemplary embodiments described above, the fixing belt 21 is an endless belt. Alternatively, the fixing belt 21 may be an endless film or the like. Further, according to the exemplary embodiments described above, the pressing roller 31 serves as a pressing rotary body. Alternatively, the pressing rotary body may be an endless belt or the like. Further, according to the exemplary embodiments described above, the belt devices B1 to B5 depicted in FIGS. 11A, 12, 13, 15A, 19A, 29A, and 33A are installed in the fixing devices 20, 20S, 20T, and 20U. Alternatively, the belt devices B1 to B5 may be installed in the intermediate transfer unit 85 depicted in FIG. 1 that incorporates the intermediate transfer belt 78, for example.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A belt device comprising:

an endless belt formed into a loop rotatable in a predetermined direction of rotation; and a flange assembly disposed at each lateral end of the endless belt in an axial direction thereof to support the endless belt, the flange assembly including:

a flange having a substantially circular flange face facing a circumferential edge of the endless belt;

a tube projecting from the flange face of the flange and inserted into the loop formed by the endless belt at each lateral end of the endless belt in the axial direction thereof;

a groove mounted on an outer circumferential surface of the tube along a circumferential direction thereof; and a slip ring slidably contacting the groove and including:

a through-hole contacting the groove; and an inner disk face separatably contacting the circumferential edge of the endless belt, wherein ID51<OD50*a*<OD21<OD51 where ID51 is an inner diameter of the slip ring through a rotation axis of the slip ring, OD50*a* is a minimum outer diameter of the tube through the rotation axis of the slip ring, OD21 is a maximum outer diameter of a track of the endless belt rotating in the predetermined direction of rotation through the rotation axis of the slip ring, and OD51 is an outer diameter of the slip ring through the rotation axis of the slip ring.

2. The belt device according to claim 1, wherein a maximum outer diameter of the flange face of the flange is smaller than the outer diameter OD51 of the slip ring.

3. The belt device according to claim 1, wherein the track of the endless belt rotating in the predetermined direction of rotation is elliptical.

4. The belt device according to claim 1, wherein the slip ring further includes an outer disk face opposite the inner disk face and facing the flange face of the flange, the outer disk face constituting a slope from an inner circumference to an outer circumference of the slip ring that gradually separates from the endless belt in the axial direction thereof, and wherein the flange face of the flange constitutes a slope from the groove to an outer circumference of the flange that gradually separates from the endless belt in the axial direction thereof to correspond to the slope of the outer disk face of the slip ring.

5. The belt device according to claim 4, wherein the flange assembly further includes a storage provided between the outer disk face of the slip ring and the flange face of the flange, the storage to store particles scraped off the slip ring contacted by the endless belt.

6. The belt device according to claim 1, wherein the slip ring further includes a slit extending from an outer circumference of the slip ring to the through-hole.

7. The belt device according to claim 1, wherein the tube includes:

a first tubular portion having a first diameter; and a second tubular portion projecting from the flange face of the flange and having a second diameter smaller than the first diameter of the first tubular portion, and wherein the first tubular portion is inserted into the loop formed by the endless belt at each lateral end of the endless belt in the axial direction thereof and attached to the second tubular portion to create the groove between the first tubular portion and the flange face of the flange across the second tubular portion.

8. The belt device according to claim 1, wherein the flange of the flange assembly includes a collar mounting the flange face.

9. A fixing device comprising:

the belt device according to claim 1;

a heater disposed opposite the endless belt to heat the endless belt;

a pressing rotary body contacting an outer circumferential surface of the endless belt; and a nip formation pad disposed inside the loop formed by the endless belt and pressing against the pressing rotary body via the endless belt to form a fixing nip between the endless belt and the pressing rotary body through which a recording medium bearing a toner image is conveyed.

10. The fixing device according to claim 9, further comprising a substantially tubular, endless belt support disposed inside the loop formed by the endless belt to support the endless belt, wherein the tube of the flange assembly is inserted into the endless belt support at each lateral end thereof in the axial direction of the endless belt to support the endless belt support.

11. The fixing device according to claim 10, wherein the endless belt support includes a recess housing the nip formation pad, and wherein the tube of the flange assembly includes a notch produced in a part of the tube along the circumferential direction thereof and housing the nip formation pad and the recess of the endless belt support.

12. The fixing device according to claim 10, wherein the endless belt support further includes an arc-shaped, first heating portion disposed opposite the heater to conduct heat from the heater to the endless belt, and wherein the tube of the flange assembly further includes an arc-shaped, shape retention face contacting the first heating portion of the endless belt support to retain the arc shape of the first heating portion.

13. The fixing device according to claim 12, wherein the shape retention face of the tube has an arc axis disposed at a predetermined distance upstream from a center line of the nip formation pad in a recording medium conveyance direction.

14. The fixing device according to claim 10, wherein the endless belt support further includes a substantially planar, first isolation portion disposed downstream from the fixing nip in the direction of rotation of the endless belt and isolated from the endless belt, and wherein the tube of the flange assembly further includes a substantially planar, second isolation portion contacting the first isolation portion of the endless belt support.

15. The fixing device according to claim 14, wherein the flange assembly further includes a guide projecting from the second isolation portion of the tube in the axial direction of the endless belt and disposed opposite the first isolation portion of the endless belt support.

16. The fixing device according to claim 15, wherein the guide is tilted toward a center of the tube in a diametrical direction thereof.

17. The fixing device according to claim 9, wherein the heater includes one of a laminated heater and a halogen heater and the pressing rotary body includes a pressing roller.

18. An image forming apparatus comprising the belt device according to claim 1.

* * * * *